US010453597B2

(12) United States Patent
Meinke et al.

(10) Patent No.: US 10,453,597 B2
(45) Date of Patent: Oct. 22, 2019

(54) METHOD FOR FORMING SADDLE COIL AND OTHER CONDUCTOR ASSEMBLIES

(71) Applicant: Advanced Magnet Lab, Inc., Palm Bay, FL (US)

(72) Inventors: Rainer Meinke, Melbourne, FL (US); Gregory J Shoultz, Melbourne, FL (US); Gerald M Stelzer, Palm Bay, FL (US)

(73) Assignee: Advanced Magnet Lab, Inc., Palm Bay, FL (US)

( * ) Notice: Subject to any disclaimer, the term of this patent is extended or adjusted under 35 U.S.C. 154(b) by 137 days.

(21) Appl. No.: 15/823,427

(22) Filed: Nov. 27, 2017

(65) Prior Publication Data

US 2018/0158586 A1 Jun. 7, 2018

Related U.S. Application Data

(62) Division of application No. 14/650,303, filed as application No. PCT/US2013/073749 on Dec. 6, 2013, now Pat. No. 9,831,021.

(60) Provisional application No. 61/734,116, filed on Dec. 6, 2012.

(51) Int. Cl.

| | |
|---|---|
| ***H01F 6/00*** | (2006.01) |
| ***H01F 7/20*** | (2006.01) |
| ***H01F 41/04*** | (2006.01) |
| ***H01F 6/06*** | (2006.01) |
| ***H01F 27/29*** | (2006.01) |
| ***B65H 39/16*** | (2006.01) |
| ***H05H 7/04*** | (2006.01) |
| *H01F 41/071* | (2016.01) |

(52) U.S. Cl.

CPC ..... *H01F 7/20* (2013.01); *B65H 39/16* (2013.01); *H01F 6/06* (2013.01); *H01F 7/202* (2013.01); *H01F 27/29* (2013.01); *H01F 41/04* (2013.01); *H01F 41/048* (2013.01); *H05H 7/04* (2013.01); *H01F 2041/0711* (2016.01); *Y10T 29/49016* (2015.01); *Y10T 29/49021* (2015.01)

(58) Field of Classification Search

CPC ..... H01F 41/048; H01F 41/06; H01F 6/06; H01F 27/00–27/30; B65H 39/16; H01H 5/00; B21F 3/04

USPC ..... 335/216

See application file for complete search history.

(56) References Cited

U.S. PATENT DOCUMENTS 3,428,925 A * 2/1969 Bogner ..... C25D 3/42 174/110 R 3,626,341 A * 12/1971 Dao ..... H01F 6/06 335/216

(Continued)

*Primary Examiner* — Shawki S Ismail

*Assistant Examiner* — Lisa N Homza

(74) *Attorney, Agent, or Firm* — Stephen C. Thomas

(57) ABSTRACT

A conductor assembly and method for making an assembly of the type which, when conducting current, generates a magnetic field or which, in the presence of a changing magnetic field, induces a voltage. In one series of embodiments the assembly comprises a spiral configuration, positioned along paths in a series of concentric cylindrical planes, with a continuous series of connected turns, each turn including a first arc, a second arc and first and second straight segments connected to one another by the first arc. Each of the first and second straight segments in a turn is spaced apart from an adjacent straight segment in an adjoining turn.

6 Claims, 45 Drawing Sheets

(56) References Cited

U.S. PATENT DOCUMENTS

| | | | | |
|---|---|---|---|---|
| 4,814,731 | A * | 3/1989 | Sato | H01F 6/06 242/437.3 |
| 6,921,042 | B1 * | 7/2005 | Goodzeit | H01F 7/202 242/430 |
| 7,798,441 | B2 * | 9/2010 | Stelzer | H01F 5/02 242/430 |
| 7,880,578 | B2 * | 2/2011 | Meinke | G01R 33/34007 242/430 |
| 7,889,042 | B2 * | 2/2011 | Meinke | H01F 5/00 336/170 |
| 7,915,990 | B2 * | 3/2011 | Stelzer | G01R 33/3804 242/430 |
| 2009/0251270 | A1 * | 10/2009 | Meinke | G01R 33/3804 336/208 |
| 2009/0289753 | A1 * | 11/2009 | Meinke | G21K 1/093 336/222 |
| 2015/0318102 | A1 * | 11/2015 | Meinke | H05H 7/04 335/216 |

* cited by examiner

METHOD FOR FORMING SADDLE COIL AND OTHER CONDUCTOR ASSEMBLIES

PRIORITY BASED ON RELATED APPLICATIONS

This application is a divisional of U.S. patent application Ser. No. 14/650,303, filed in the USPTO under 35 U.S.C. 371(c) on Jun. 7, 2015, issuing on Nov. 28, 2017 as U.S. Pat. No. 9,831,021, which was a national stage filing under 35 U.S.C 371 of international application PCT/US13/073749 filed in the United States Receiving Office on Dec. 6, 2013, which claimed priority to U.S. Provisional Application No. 61/734,116 filed in the United States Patent and Trademark office Dec. 6, 2012, all of which are incorporated herein by reference in their entirety. This application also incorporates by reference all subject matter in U.S. Pat. No. 6,921,042 titled "Concentric Tilted Double-Helix Dipoles and Higher-Order Multipole Magnets" issued Jul. 26, 2005 and U.S. Pat. No. 7,864,019 titled "Wiring Assembly and Method of Forming a Channel in a Wiring Assembly for Receiving Conductor", issued Jan. 4, 2011.

FIELD OF THE INVENTION

This application relates to wiring assemblies and methods of forming wiring assemblies and systems including wiring assemblies which, when conducting current, generate a magnetic field or which, in the presence of a magnetic field, induce a voltage.

BACKGROUND AND SUMMARY OF THE INVENTION

Numerous magnet applications require provision of a magnetic field on the inside or the outside of a cylindrical structure with a varied number of magnetic poles. Examples of such applications are use of magnets for charged particle beam optics such as used in particle accelerator applications, particle storage rings, beam lines for the transport of charged particle beams from one location to another, and spectrometers to spread charged particle beams in accord with particle mass. Magnets of various multi pole orders are needed for charged particle beam optics. In such charged particle beam applications dipole magnets are needed for steering the particle beam, quadrupoles are needed for focusing the beam, and higher-order multi pole magnets provide the optical equivalent of chromatic corrections.

Any field errors (i.e., deviations from the ideal field strength distribution for a given application) in such systems are known to degrade the performance of the beam optics, leading to a rapid increase in beam cross sections, or beam loss within the system. In the case of mass spectrometry, field uniformity is a limiting factor in the ability to separate particles of differing masses. Analogous to light optical systems, for which the lenses conform to predefined geometries and are ground accordingly with very high precision to render satisfactory resolution of the transmitted image, the invention is based on recognition that optimal performance of magnets in charged particle beam systems is dependent on creation of optimal and practical conductor winding configurations and achievement of mechanical tolerances to which the fabricated systems conform to the predefined configurations.

In some applications using charged particle beam optics, magnetic fields of modest strength, e.g., less than 2 Tesla, are required. In these instances, the shapes of the iron poles which are magnetized with current-carrying windings are highly determinative of the field quality. That is, with field uniformity almost completely defined by the shape of the iron poles, precision in the placement of the current-carrying winding is of much less importance. However, beam optics for high particle energy applications require very strong magnetic fields to control the particle beam. This can best be achieved with superconducting, current-carrying windings, eliminating the requirement for iron which, due to its non-linear magnetization and saturation, would have detrimental effects on field uniformity. Nonetheless, optimal positions have to be determined for the current-carrying conductors and placement of the winding with very high levels of accuracy can result in generation of magnetic fields with improved high field uniformity. In some normal conducting charged particle beam optical systems the magnets for the beam optics have to operate in the presence of high magnetic background fields, in which the iron is fully saturated. In such systems the magnetic field also has to be completely defined by the current-carrying windings.

The current-carrying winding configurations used for charged particle beam optics are typically of cylindrical shape, with the windings surrounding an evacuated tube, also of cylindrical shape, that contains the particle beam. The field-generating winding configurations for such applications, in most cases, consist of multiple saddle shaped layers of winding. Each layer comprises multiple turns of winding as shown in FIGS. 1A and 1B. The shape of the saddle coil winding closely matches the shape of the cylindrical beam tube. Such saddle-shaped winding configurations for generating magnetic fields with a given pole number are typically produced by winding the conductor over itself and around a central island. The present invention is based, in part, on recognition that definition of the winding configuration in a saddle coil magnet (i.e., the conductor path) and accuracy of conductor placement in the winding configuration are critical to acquiring satisfactory or optimal field uniformity, especially in the case of superconducting windings. Other applications of magnetic fields, which are unrelated to charged particle beam optics, also have potential for improved performance based on improved field uniformity. Again, improvements can be realized based on definition of more optimal winding configurations and positioning of the coil conductors to substantially conform to defined configurations in order to produce magnetic fields with acceptable high field uniformity. In the case of rotating electrical machines, e.g., motors and generators, for which torque transfer is achieved with magnetic fields that act between the rotor and the stator, the rotor and stator both produce magnetic fields with various numbers of magnetic poles. For most of these machines, the iron-poles dominate the fields such that minor deviations in placement of coils in the winding configuration has little effect on machine performance. On the other hand, a feature of the invention is that performance of superconducting electrical machines, which provide unmatched power density, can be improved based on more optimal definition of wiring configurations to improve the quality of the magnetic fields. The field uniformity is largely determined by the accuracy of and stability in placement of the coils. As in the case of charged particle beam optics, electrical machines are of cylindrical shape, and saddle-shaped windings have provided an efficient configuration to generate the required magnetic fields. However, if the coils of the rotor or stator windings typically contain lower or higher order harmonics. Another feature of the invention is based on recognition that, in superconducting rotating machines, such resulting non-uniformities in the field can generate torque ripple or vibrations, which will stress shaft bearings and lead to fatigue of these components. For fully superconducting machines, non-uniform fields lead to increased AC losses in the windings, reducing machine efficiency.

According to embodiments a series of conductor assemblies are provided of the type which, when conducting current, generates a magnetic field or which, in the presence of a changing magnetic field, induces a voltage. In one example, a conductor having a spiral configuration is positioned along a path in a cylindrical plane. The conductor extends along an axis central to the cylindrical plane, and positions along the path vary in azimuthal angle. The azimuthal angle of each position is measurable in a plane orthogonal to the axis and relative to a reference point in the plane orthogonal to the axis. The configuration comprises a continuous series of connected turns, $T_n$, for which n is an integer ranging from one to N. Each turn, $T_n$, includes a first arc, a second arc and first and second straight segments connected to one another by the first arc. The second arc connects the turn, $T_n$, to an adjoining turn, $T_{n+1}$ or $T_{n-1}$. For a given value of n, each of the first and second straight segments in a turn $T_n$ is spaced apart from an adjacent parallel segment in an adjoining turn $T_{n+1}$ or $T_{n-1}$. For each parallel segment in each turn, $T_n$, the azimuthal angle, $\theta_n$, defines a sufficient number of positions according to the relationship $$\sin(m*\theta_n) = \frac{n-\frac{1}{2}}{N}$$

that all positions along a majority of the length of each straight segment in each turn, $T_n$, conform to the relationship $$\sin(m*\theta_n) = \frac{n-\frac{1}{2}}{N}$$

Each first arc in the saddle coil magnet winding structure may conform to the relationship $$F(x)*\sin(m*\theta_n) = \frac{n-\frac{1}{2}}{N}$$

where x is a position along the axis and F(x) varies in value along the arc from zero to one. In one embodiment, some of the positions along the path of a first arc in one of the turns conform to the relationship $$F(x)*\sin(m*\theta_n) = \frac{n-\frac{1}{2}}{N}$$

where x is a position along the axis and F(x) varies in value along the arc from zero to one. Also, each second arc may conform to the relationship $$F(x)*\sin(m*\theta_n) = \frac{n-\frac{1}{2}}{N}.$$

In the above-described saddle coil magnet winding structure the entire length along each straight segment in each turn, $T_n$, may conforms to the relationship $$\sin(m*\theta_n) = \frac{n-\frac{1}{2}}{N}.$$

and the winding structure may include one or more additional spiral configurations each in a different cylindrical plane concentrically positioned about the axis wherein conductor in each spiral configuration is spaced apart from conductor in each other spiral configuration.

For an embodiment with the saddle coil magnet winding structure including one or more additional spiral configurations, for each additional configuration:

the azimuthal angle of each position is measurable in a plane orthogonal to the axis and relative to a reference point in the plane orthogonal to the axis, and the configuration comprises a continuous series of connected turns, $T_n$. Each turn, $T_n$, includes a first arc, a second arc and first and second parallel segments connected to one another by the first arc. The second arc connects each turn, $T_n$, to an adjoining turn, $T_{n+1}$ or $T_{n-1}$.

Also, for each additional configuration of connected turns, $T_n$, all positions along a majority of the length of each straight segment in each turn, $T_n$, may conform to $$\sin(m*\theta_n) = \frac{n-\frac{1}{2}}{N}$$

and the structure may comprise a support body having a groove formed therein and centered about the axis, wherein the first spiral configuration and at least one additional spiral configuration are positioned in the groove. With a first such centered about the axis, a second groove may be formed in the support body, also centered about the axis and spaced away from the first groove, such that at least the first spiral configuration is positioned in the first groove and at least one additional spiral configuration is positioned in the second groove.

In another set of embodiments, a conductor assembly includes a body having a first channel formed therein defining a first path extending along a first cylindrical plane and along a direction parallel to an axis central to the cylindrical plane. The first channel is in a configuration comprising a continuous series of connected turns, $GT_j$, providing a first spiral pattern. A length of conductor comprises two or more electrically connected segments each positioned in the first channel, with a first segment of the conductor positioned in the first cylindrical plane. The first segment provides a first layer of the conductor closest to the axis. Each of the other segments provides an additional layer, with each additional layer positioned over another layer. The body of the conductor assembly may include a second channel formed therein defining a second path extending along a second cylindrical plane and along a direction parallel to an axis central to the cylindrical plane, with the second channel in a configuration comprising a continuous series of connected turns, $GT_j$, providing a second spiral pattern wherein the length of conductor extends from the first spiral pattern into the second spiral pattern with another segment of the conductor positioned in the second channel. Such a segment of the conductor positioned in the second channel may be positioned as a first layer of the conductor in the second channel, with the assembly including one or more additional segments of the conductor in the second channel with each segment in the second channel providing an additional layer of the conductor positioned over another layer of the conductor. Each layer of the conductor may be positioned in a different concentric plane about the axis, and the conductor may be a splice-free wire comprising each of the segments. The body may be insulative, such as the type formed of a fiberglass resin composite material or may be a laminate structure comprising a metal body having an insulative layer formed thereon, or a metal body which receives insulated conductor to provide a helical wiring configuration.

A conductor assembly is also provided in which a conductor having a spiral configuration is positioned along a path in a cylindrical plane and extends along an axis central to the cylindrical plane, with positions along the path varying in azimuthal angle, $\theta_n$. The azimuthal angle of each position is measurable in a plane orthogonal to the axis and relative to a reference point in the plane orthogonal to the axis. The configuration comprises a continuous series of connected turns, $T_n$, for which n is an integer ranging from one to N. Each turn, $T_n$, includes a first arc and a first straight segment. The configuration includes a spacing between at least one turn, $T_n$, and an adjacent turn $T_{n+1}$ or $T_{n-1}$. For a given value of n:

(i) a spacing between one of the straight segments in a turn $T_n$ and an adjacent straight segment in an adjoining turn $T_{n+1}$ or $T_{n-1}$ in the cylindrical plane is determined according to the relationship $$\sin(m*\theta_n) = \frac{n-\frac{1}{2}}{N}$$

where positions between which the spacing exists are defined by the azimuthal angle, $\theta_n$, or (ii) a spacing between one of the arcs in a turn $T_n$ and an adjacent arc in an adjoining turn $T_{n+1}$ or $T_{n-1}$ in the cylindrical plane is determined according to the relationship $$F(x)*\sin(m*\theta_n) = \frac{n-\frac{1}{2}}{N},$$

where m is an integer greater than zero, x is a position along the axis and F(x) varies in value along the arc from zero to one, and positions between which the spacing exists are defined by the azimuthal angle, $\theta_n$. In one variant of this embodiment, the conductor is positioned along a path in a sequence of multiple cylindrical planes, positions along the path in each cylindrical plane vary in azimuthal angle, $\theta_n$, where in the first cylindrical plane the conductor path begins in an innermost turn and ends in an outermost turn in a first spiral pattern, and in the second cylindrical plane the conductor path begins in an outermost turn and ends in an innermost turn in a second spiral pattern.

According to another embodiment of conductor assemblies of the type which, when conducting current, generates a magnetic field or which, in the presence of a changing magnetic field, induces a voltage, a body has a first channel formed therein defining a first path extending along a first cylindrical plane and along a direction parallel to an axis central to the cylindrical plane (with positions along the path varying in azimuthal angle based on position along the axis) where the first channel is in a configuration comprising a continuous series of connected turns, $GT_j$, providing a first spiral pattern. The configuration comprises a continuous series of connected groove turns, $GT_j$, for which j is an integer ranging from one to N. Each turn, $GT_j$, includes a first arc, a second arc and first and second straight segments connected to one another by the first arc. The second arc connects the turn, $GT_j$ to an adjoining turn, $GT_{j+1}$ or $GT_{j-1}$. For a given value of n, each of the first and second straight segments in the turn $GT_j$ is spaced apart from an adjacent parallel segment in an adjoining turn $GT_{j+1}$ or $GT_{j-1}$, and for each straight segment in each turn, $GT_j$, the azimuthal angle, $\theta_n$, defines a sufficient number of positions according to the relationship $$\sin(m*\theta_n) = \frac{n-\frac{1}{2}}{N},$$

where m is an integer greater than zero, that all positions along a majority of the length of each straight segment in each turn, $GT_j$, conform to $$\sin(m*\theta_n) = \frac{n-\frac{1}{2}}{N}.$$

A related method for constructing a conductor assembly of the type which, when conducting current, generates a magnetic field or which, in the presence of a changing magnetic field, induces a voltage, includes providing a conductor having a spiral configuration, positioned along a path in a first cylindrical plane, which conductor extends along an axis central to the cylindrical plane, with positions along the path varying in azimuthal angle. The azimuthal angle of each position is measurable in a plane orthogonal to the axis and relative to a reference point in the plane orthogonal to the axis. The configuration comprises a first plurality of N turns, $T_n$, connected to one another in a continuous series in the first cylindrical plane, with each turn, $T_n$, including first and second coil ends which are each a portion of a turn not parallel with the axis. For a given value of n, each of the turns $T_n$ is spaced apart from an adjacent parallel segment in an adjoining turn $T_{n+1}$ or $T_{n-1}$, and for each turn, $T_n$, a sufficient number of positions along a majority of the length of the turn are in accord with the relationship $$F(x)*\sin(m*\theta_n) = \frac{n-\frac{1}{2}}{N},$$

where m is an integer greater than zero, x is a position along the axis and F(x) varies in value along the coil ends between zero and one, such that all positions along a majority of the length of each turn, $T_n$, conform to $$F(x)*\sin(m*\theta_n)=\frac{n-\frac{1}{2}}{N}.$$

In one embodiment of this method all positions along the entire length of each first coil end turn, $T_n$, may conform to $$F(x)*\sin(m*\theta_n)=\frac{n-\frac{1}{2}}{N}.$$

Also, all positions along the entire length of a first of the turns, $T_n$, except for positions along a portion of the second coil end turn, may conform to $$F(x)*\sin(m*\theta_n)=\frac{n-\frac{1}{2}}{N}.$$

In one embodiment of the method, the step of providing the conductor having a spiral configuration includes providing, as a portion of the second end turn in the first of the turns, a segment which extends to an adjoining turn which segment continues the spiral configuration from the first of the turns to the adjoining turn.

In another embodiment of the method, the step of providing a conductor having a spiral configuration includes positioning the path of the conductor to extend along the axis in a second cylindrical plane concentric with the first cylindrical plane, and the configuration further includes a second plurality of turns connected to one another in a continuous series in the second cylindrical plane, with positions in the second cylindrical plane varying in azimuthal angle. As a portion of the second end turn in the first of the turns, a segment is provided which extends from the first of the turns to one of the turns in the second cylindrical plane. This segment connects portions of the spiral configuration in the first cylindrical plane with portions of the spiral configuration in the second cylindrical plane.

In still another embodiment of the method, along the path of each turn in the second cylindrical plane, the azimuthal angle, $\theta_n$, defines a sufficient number of positions according to the relationship $$F(x)*\sin(m*\theta_n)=\frac{n-\frac{1}{2}}{N},$$

that all positions along a majority of the length of each turn, $T_n$, conform to $$F(x)*\sin(m*\theta_n)=\frac{n-\frac{1}{2}}{N}.$$

Also according to the invention, a length of conductor extends in a continuous spiral pattern in a first cylindrical plane extending along a central axis to create a saddle coil shape. The pattern comprises N turns, $T_n$, with each turn having a fixed position in the same cylindrical plane, each turn including a pair of straight segments parallel to one another. The straight segments are arranged in spaced-apart relation as a function of azimuthal angle, $\theta_n$, about the axis, according to $$\sin(m*\theta_n)=\frac{n-\frac{1}{2}}{N}$$

where m is an integer greater than zero and the azimuthal angle, $\theta_n$, of each position along each straight segment is measured in a plane orthogonal to the axis and relative to a reference point in the plane orthogonal to the axis.

In a method of forming a conductor assembly of the type which, when conducting current, generates a magnetic field or which, in the presence of a changing magnetic field, induces a voltage, (i) a series of closed conductor paths, n, is defined, where n ranges from 1 to N. All of the closed paths reside in one cylindrical plane positioned about an axis in accord with the relationship $$F(x)*\sin(m*\theta_n)=\frac{n-\frac{1}{2}}{N}.$$

where m is an integer value greater than one, and θ is the azimuthal angle of each position, measured in a plane orthogonal to the axis and relative to a reference point in the plane orthogonal to the axis, the relationship providing a suitable approximation for an ideal current density distribution according to cos(mθ), where x is a position along the axis and F(x) is a shape function which varies in value from zero to one;

(ii) a set of conductive winding turns is created by modifying the contours of the closed conductor paths with respect to the axial direction, X, to transform the closed shapes into a set of open shapes which each connect to another open shape to create a spiral configuration which departs from the ideal current density distribution.

In one embodiment the open shapes are spiral turns created by modifying the lengths of straight sections in closed shapes or by modifying the curvature imparted by the shape function F(x), with respect to position along the axis. This imparts a spiral shape that connects with a straight section in a portion of an adjacent conductor shape in the set of open shapes.

There is also provided a method for constructing a conductor assembly of the type which, when conducting current, generates a magnetic field or which, in the presence of a changing magnetic field, induces a voltage. A conductor is provided in a spiral configuration, positioned along a path in a first cylindrical plane, which conductor extends along an axis central to the cylindrical plane, positions along the path varying in azimuthal angle. The azimuthal angle of each position is measured in a plane orthogonal to the axis and relative to a reference point in the plane orthogonal to the axis. The configuration comprises a first plurality of N turns, $T_n$, connected to one another in a continuous series in the first cylindrical plane, each turn, $T_n$, including first and second coil ends which are each a portion of a turn not parallel with the axis. For a given value of n, each of the turns $T_n$ is spaced apart from an adjacent turn $T_{n+1}$ or $T_{n-1}$, and, for at least one turn, $T_n$, the positions along a majority of the length of the turn are in accord with the afore-defined relationship $$F(x) * \sin(m * \theta_n) = \frac{n - \frac{1}{2}}{N},$$

wherein multipole content which would otherwise be present in a field generated by the spiral configuration, relative to a pure multipole field of order m, which would theoretically be generated by a configuration having an ideal cos(nθ) current distribution, is reduced by applying a numerical optimization technique which modifies the shapes of turns to more closely conform the field pattern generated by the spiral configuration to the pure multipole field of order m.

In a method for constructing a conductor assembly of the type which, when conducting current, generates a magnetic field or which, in the presence of a changing magnetic field, induces a voltage, with a channel in the assembly having a spiral configuration for a multipole field configuration of order m. The method includes inserting multiple layers of the conductor in the channel to conform each layer of the conductor to the spiral configuration, with each layer of the conductor positioned along a path in a different one of multiple concentric cylindrical planes, which paths extend along an axis central to the cylindrical planes, positions along the paths varying in azimuthal angle. Each layer in the configuration comprises a plurality of N turns, $T_n$, connected to one another in a continuous series in the first cylindrical plane. Each turn, $T_n$, includes first and second coil ends which are each a portion of a turn not parallel with the axis, and, for a given value of n, each of the turns $T_n$ is spaced apart from an adjacent turn $T_{n+1}$ or $T_{n-1}$. Paths are defined for straight portions of the channel or for curved portions of the channel, which result in path segments which deviate from ideal channel path segments, into which one or more segments of conductor turns in one or more conductor layers are placed. In one embodiment, for at least one turn, $T_n$, the positions along a majority of the length of the turn are in accord with the relationship $$F(x) * \sin(m * \theta_n) = \frac{n - \frac{1}{2}}{N},$$

where m is an integer greater than zero, x is a position along the axis and F(x) varies in value along the coil ends between zero and one. In one embodiment multipole content which would otherwise be present in a field generated by the spiral configuration, relative to a pure multipole field of order m (which would theoretically be generated by a configuration having an ideal cos(mθ) current distribution), is reduced by applying a numerical optimization technique which modifies the shapes of turns to more closely conform the field pattern generated by the spiral configuration to the pure multipole field of order m. The numerical optimization technique may modify the shapes of turns to more closely conform the field generated by the spiral configuration to the multipole field which would theoretically be generated by a configuration having an ideal cos(mθ) current distribution.

A conductor assembly is also provided which comprises a body member having a series of spaced-apart, concentric channels formed therein, with each channel formed in a different one of multiple concentric cylindrical planes formed about a central axis. A conductor is positioned in each of the channels with multiple layers of the winding stacked in each channel. The conductor may be formed in a saddle coil spiral configuration. In a related method for making a multi-level conductive winding, a series of concentric channels is formed about an axis of a body member, with each channel passing through a different cylindrical plane and extending in a radial direction away from the axis. Multiple layers of conductor are placed within each of the channels with each layer positioned in a different concentric cylindrical plane. The winding may be a continuous, splice-free element.

Also according to the invention, a configuration is provided for a conductive winding of the type which, when conducting current, generates a magnetic field or which, in the presence of a changing magnetic field, induces a voltage. A conductor having a spiral shape comprising turns, $T_n$, is positioned along a path in a first cylindrical plane. The conductor extends along an axis central to the cylindrical plane, with positions along the path varying in azimuthal angle. Each turn, $T_n$, includes a first arc, a second arc and first and second straight segments. A first turn $T_n$ and a second turn $T_{n+1}$ or $T_{n-1}$ adjoin one another in the series and are spaced apart from one another, with a first segment of the conductor in the first turn and a second segment of the conductor in the second turn $T_{n+1}$ or $T_{n-1}$ each following a path in accord with $$F(x) * \sin(m * \theta_n) = \frac{n - \frac{1}{2}}{N}$$

where m is an integer greater than zero, x is a position along the axis and F(x) varies in value along the coil ends between zero and one. The conductor further comprises a third segment which does not follow a path in full accord with $$F(x) * \sin(m * \theta_n) = \frac{n - \frac{1}{2}}{N},$$

the third segment providing electrical connection between the first and second segments. In one embodiment of this configuration the first segment of the conductor in the first turn is an arc. The second segment of the conductor in the second turn may be an arc. The first segment of the conductor in the first turn may be a straight segment and the second segment of the conductor in the second turn may be a straight segment.

Also in a channel configuration for a conductive winding of the type which, when conducting current, generates a magnetic field or which, in the presence of a changing magnetic field, induces a voltage, a spiral channel is formed in a body comprising a continuous series of connected channel turns, $GT_n$, positioned along a path in a first cylindrical plane, which channel extends along an axis central to the cylindrical plane, with positions along the path varying in azimuthal angle. Each turn, $GT_n$, includes a first arc, a second arc and first and second straight segments.

A first turn $GT_n$ and a second turn $GT_{n+1}$ or $GT_{n-1}$ adjoin one another in the series. A first segment of the channel in the first turn $GT_n$ and a second segment of the channel in the second turn $GT_{n+1}$ or $GT_{n-1}$ each follow a path in accord with $$F(x)*\sin(m*\theta_n)=\frac{n-\frac{1}{2}}{N},$$

where m is an integer greater than zero, x is a position along the axis and F(x) varies in value along each of the arcs between zero and one. The channel further comprises a third segment which does not follow a path in accord with $$F(x)*\sin(m*\theta_n)=\frac{n-\frac{1}{2}}{N}.$$

The third segment provides a path for a conductive segment to provide electrical connection between conductor in the first and second segments. The first segment of the channel in the first turn or in the second turn may be an arc or a straight segment.

In another configuration for a conductive winding of the type which, when conducting current, generates a magnetic field or which, in the presence of a changing magnetic field, induces a voltage, a conductor has a spiral pattern comprising a first continuous series of connected turns positioned along a path in a first cylindrical plane, and at least a second continuous series of connected turns positioned along a path in a second cylindrical plane. The conductor extends along an axis central to the cylindrical plane, with positions along the path varying in azimuthal angle. Each turn includes a first arc, a second arc and first and second straight segments. The azimuthal angle of each position is measurable in a plane orthogonal to the axis and relative to a reference point in the plane orthogonal to the axis. A first segment of the conductor in a first turn in the first continuous series in the first cylindrical plane and a second segment of the conductor in the second continuous series in the second cylindrical plane each follow a path in accord with $$F(x)*\sin(m*\theta_n)=\frac{n-1/2}{N},$$

where m is an integer greater than zero, x is a position along the axis and F(x) varies in value along the coil ends between zero and one. The conductor further comprises a third segment which does not follow a path in accord with $$F(x)*\sin(m*\theta_n)=\frac{n-1/2}{N}.$$

The third segment provides electrical connection between the first and second segments. The first segment of the conductor in the first turn or in the second turn may be an arc or a straight segment.

In a channel configuration for a conductive winding a spiral channel formed in a body includes a first continuous series of connected channel turns positioned along a path in a first cylindrical plane, and at least a second continuous series of connected channel turns positioned along a path in a second cylindrical plane, which channel extends along an axis central to the cylindrical plane. Positions along the path vary in azimuthal angle. Each channel turn includes a first arc, a second arc and first and second straight segments. The azimuthal angle of each position is measured in a plane orthogonal to the axis and relative to a reference point in the plane orthogonal to the axis. The first segment of the channel in a first turn in the first continuous series in the first cylindrical plane and a second segment of the channel in the second continuous series in the second cylindrical plane each follow a path in accord with $$F(x)*\sin(m*\theta_n)=\frac{n-1/2}{N},$$

where m is an integer greater than zero, x is a position along the axis and F(x) varies in value along the coil ends between zero and one. The channel further comprises a third segment which does not follow a path in accord with $$F(x)*\sin(m*\theta_n)=\frac{n-1/2}{N},$$

the third segment providing a path for a conductive segment to provide electrical connection between conductor in the first and second segments. The first segment of the channel in the first turn or the second turn may be an arc or a straight segment.

A method of fabricating a spiral winding structure includes defining a spiral shaped channel about an axis in a body to provide a path. The channel comprises a series of N spaced apart and connected channel turns $T_n$ (n=1 to N), each channel turn having a first arc, a second arc and first and second straight segments, where spacings between adjoining turns in the series are in accord with $$F(x)*\sin(m*\theta_n)=\frac{n-1/2}{N},$$

along the majority of each channel turn. A conductive material is conformed to the path of the spiral shaped channel, wherein m is an integer greater than zero, $\theta_n$ is an angle measured in a plane orthogonal to the axis and relative to a reference point in the plane orthogonal to the axis, x is a position along the axis, and F(x) varies in value along each arc between zero and one.

Also according to the invention, a structure includes at least first and second layers positioned about one another and two or more conductor portions, each conductor portion positioned along a different one of the layers, the first of the conductor portions in a first cylindrical plane centered about an axis and the second of the conductor portions in a second cylindrical plane also centered about the axis, with the second plane a greater distance from the axis than the first cylindrical plane, wherein at least the first and second conductor portions are segments in a continuous conductive path extending from along the first of the layers to along at least the second of the layers. The conductive path is arranged so that when conducting current a magnetic field can be generated or so that when, in the presence of a changing magnetic field, a voltage is induced. The first and second conductor portions each have a spiral configuration positioned along the path in one of the cylindrical planes and each extend along the axis, with positions along the path varying in azimuthal angle. Each conductor portion comprises a continuous series of connected turns, $T_n$, for which n is an integer ranging from one to N. Each turn, $T_n$, includes a first arc, a second arc and first and second straight segments connected to one another by the first arc. The second arc connects the turn, $T_n$, to an adjoining turn, $T_{n+1}$ or $T_{n-1}$. In one embodiment of the structure of claim 160 the first and second conductor portions are each positioned in a groove formed in one of the first and second layers which groove defines positions of each conductor portion along the path. For a given value of n, each of the first and second straight segments in a turn $T_n$ may be spaced apart from an adjacent straight segment in an adjoining turn $T_{n+1}$ or $T_{n-1}$. For each straight segment in each turn, $T_n$, the azimuthal angle, $\theta_n$, may define a sufficient number of positions according to the relationship $$\sin(m*\theta_n) = \frac{n-1/2}{N}$$

that all positions along a majority of the length of each straight segment in each turn, $T_n$, conform to $$\sin(m*\theta_n) = \frac{n-1/2}{N}$$

In one embodiment of the structure each first arc in one of the conductor portions conforms to the relationship $$F(x)*\sin(m*\theta_n) = \frac{n-1/2}{N},$$

where x is a position along the axis and F(x) varies in value along the arc from zero to one, and in another embodiment all positions along a majority of the length of each turn, $T_n$, in one of the conductor portions conforms to the relationship $$F(x)*\sin(m*\theta_n) = \frac{n-1/2}{N}.$$

In another embodiment fewer than all positions along the length of each turn, $T_n$, conform to the relationship $$F(x)*\sin(m*\theta_n) = \frac{n-1/2}{N}.$$

A configuration for a conductive winding includes a length of conductor and a spiral channel in which two or more layers of the conductor are positioned, one layer over another layer, the channel including a first series of N connected channel turns formed in a portion of a body, the turns positioned along a path so that the channel extends along an axis, the channel having a depth extending in a radial direction with respect to the axis to contain the two or more layers. The configuration may include J layers of conductor in the channel each electrically connected in series to another layer in the channel to provide one conductor having J*N turns. Each of the layers of conductor may be positioned in a different one of multiple concentric cylindrical planes about the axis. The conductor may be continuous and splice free. Further, the configuration may include a second spiral channel in which two or more additional layers of the conductor are positioned, one layer over another layer, the second channel including a second series of connected channel turns formed in another portion of the body in a cylindrical plane positioned radially outward from the first series of connected channel turns with respect to the axis, the second channel having a depth extending in a radial direction with respect to the axis to contain the additional layers. The body in which the channel is formed may be a layer of insulative material or a layer of conductive material.

A method of forming a conductive winding includes forming a spiral channel in a portion of a body in which two or more layers of conductor are to be positioned, one layer over another layer. The channel includes a first series of connected channel turns, with the turns positioned along a path so that the channel extends along an axis. The channel has having a depth extending in a radial direction with respect to the axis to contain the two or more layers, the turns each comprising a straight section of the channel path and a curved section of the channel path, wherein the straight sections are formed with parallel channel walls by cutting into the body with a saw blade. A length of conductor is positioned in the channel by laying one portion of the length over another portion of the conductor length to provide one conductive layer over another conductive layer. The step of cutting into the body with a saw blade may provide a cut in a single path or a single pass to define the entire depth of the channel instead of requiring multiple paths of a cutting tool to machine the full depth of the channel to accommodate two or more layers of the conductor.

A method is provided for securing multiple layers of conductor in a single channel. A channel is formed in a spiral configuration comprising a series of channel turns with the channel having a restricted opening of a first dimension smaller than a thickness dimension of the conductor. A first portion of the conductor is pushed through the restricted channel opening with application of a force so that the channel receives the conductor to create a first level of conductor turns in the channel turns. A second portion of the conductor is also pushed through the restricted channel opening with application of a force so that the channel receives a portion of the conductor to create a second level of conductor turns in the channel turns. The step of pushing the first portion of the conductor through the restricted channel opening may expand or deform the dimension of the channel opening, allowing a portion of each conductor turn to be pushed through the opening, after which the dimension of the opening may revert from an expanded dimension to a size which is substantially the same as the first dimension. Also, the thickness dimension of the conductor may be the smallest dimension of the conductor and the difference between the first dimension of the restricted opening and the thickness dimension of the conductor may be between seven and nine percent.

According to a method of forming a channel with a restricted opening that secures multiple layers of conductor in a single channel, a channel is formed in a spiral configuration comprising a series of channel turns with the channel having a restricted opening of a first dimension smaller than a thickness dimension of the conductor by providing a first cut to a body to create a first width for an opening in the channel through which portions of the conductor are received into the channel. The thickness dimension may be the smallest dimension of the conductor. A second cut is made to create a second width in the channel larger than the first width. The first cut and the second cut may each be created with a tool and each may be created with a different tool. The first cut may create the majority of the depth of the channel to receive multiple layers of conductor with one layer stacked over another layer. Also, the first cut may provide a uniform width along a path defined by multiple ones of the channel turns, and the second cut may create a second width in the channel larger than the first width without altering the width of the opening.

In a method of forming a channel with a restricted opening a channel is formed which has a spiral configuration comprising a series of channel turns with the channel having a restricted opening of a first dimension smaller than a thickness dimension of the conductor by providing a first cut to a body to create an initial opening. At least a portion of the channel with the initial opening has a first width and a portion of the interior of the channel also has the first width. The initial opening is covered with a layer of removable material and a second cut creates the restricted opening through the layer of removable material. The restricted opening has the second width which is smaller than the first width. The first cut and the second cut may each be each created with a different tool, and the first cut may create the majority of the depth of the channel to receive multiple layers of conductor with one layer stacked over another layer. The first cut may provide a uniform channel width along a path defined by multiple ones of the channel turns, and the second cut may provide a uniform width to the restricted opening along a path defined by multiple ones of the channel turns.

Another configuration for a conductive winding is also of the type which, when conducting current, generates a magnetic field or which, in the presence of a changing magnetic field, induces a voltage. This configuration includes a length of conductor and a spiral channel which accommodates two or more layers of the conductor for positioning therein, with one layer positioned over another layer. The channel includes a series of connected channel turns formed in a portion of a body, with the turns positioned along a path so that the channel extends along an axis, the channel having a depth extending in a radial direction with respect to the axis to contain the two or more layers. The channel includes a series of shaped repository openings along walls of the channel. Each repository opening is positioned a different radial distance from the axis to provide a series of repository positions, with one or more of the repository positions positioned over another one of the repository positions. Each repository opening is of a dimension smaller than a thickness dimension of the conductor to restrict passage of the conductor into an adjoining repository position such that a force must be applied to push the conductor through the repository opening and into the repository position. In one embodiment each repository opening is positioned in a different one of several cylindrical planes concentrically positioned about the axis. The conductor may be a splice-free continuous length, with a different portion of the conductor occupying a different repository position to provide a series of winding turns in each of several cylindrical planes concentrically positioned about the axis. In a set of embodiments, one or more of the repository spacers is formed in the channel walls.

According to a method of manufacturing a conductive winding of the type which, when conducting current, generates a magnetic field or which, in the presence of a changing magnetic field, induces a voltage, a spiral channel is created in a portion of a body, which channel accommodates two or more layers of conductor for positioning therein, one layer over another layer. The channel includes a series of connected channel turns formed in a portion of the body, and the turns are positioned along a path so that the channel extends along an axis. The channel has a depth extending in a radial direction with respect to the axis to contain the two or more layers, and the channel includes a series of shaped repository openings along walls of the channel, with each repository opening formed a different radial distance from the axis to provide a series of repository positions, with one or more of the repository positions positioned over another one of the repository positions. Each repository opening is of a dimension smaller than a thickness dimension of the conductor to restrict passage of the conductor into an adjoining repository position such that a force must be applied to push the conductor through the repository opening and into the repository position. Segments of the conductor are sequentially passed through one or more of the repository openings to place each segment in one repository position to create a multi-level helical winding path in a single groove. By sequentially passing segments of the conductor through the repository openings it is possible to position different levels of conductor segments in different spaced-apart cylindrical planes positioned about the axis. In a related embodiment a space is provided between a first repository position and a second repository position. The space provides for heat exchange to serve as a cooling channel for conductor in the first and second repository positions.

In a related method for providing cooling channels in a groove containing multiple levels of conductor, shaped repository openings are created along walls of the groove, which openings define repository positions for different layers of conductor placed in the groove and constrain movement of the conductor. A space is provided between a first repository position and a second repository position, and at least two segments of conductor are passed through one or more of the repository openings to position a first segment in the first repository position and to position a second segment in the second repository position. A space between the first repository position and the second repository position is retained without containing another segment of conductor positioned between the first and second segments. The space may provide for heat exchange and serve as a cooling channel for conductor in the first and second repository positions. The space may be formed in the shape of a repository opening and be positioned between the first repository opening and the second repository opening.

In a method of constructing a conductor assembly of the type which, when conducting current, generates a magnetic field or which, in the presence of a changing magnetic field, induces a voltage, a wiring assembly is configured as a series of spaced-apart spiral configurations of conductor with each configuration positioned in a different one of multiple cylindrical planes each centered about a common axis. Each spiral configuration includes a plurality of conductor turns. The step of configuring the wiring assembly includes positioning segments of the conductor to provide turn-to-turn transitions which connect turns in the same plane to form a multi-turn helical geometry in each plane. Conductor segments also extend out of the cylindrical planes to conductively connect pairs of spiral configurations of conductor in the adjoining cylindrical planes to form one continuous multi-level winding configuration. In the disclosed embodiments the step of positioning segments of the conductor to provide turn-to-turn transitions within each multi-turn helical geometry only positions each of extended conductor segments within the cylindrical plane in which the multi-turn helical geometry is disposed. The step of providing the turn-to-turn transitions to connect turns in each plane may form a multi-turn helical geometry in each plane.

A wiring assembly according to the invention includes a series of spaced-apart spiral configurations of conductor with each configuration positioned in a different one of multiple cylindrical planes each centered about a common axis. Each spiral configuration comprises a plurality of conductor turns, wherein the conductor includes (i) segments positioned to provide turn-to-turn transitions which connect turns in each plane to form a multi-turn helical geometry in each plane; and (ii) segments positioned out of the cylindrical planes to conductively connect pairs of spiral configurations of conductor in the adjoining cylindrical planes to form one continuous multi-level winding configuration. In one embodiment the turns in each of the spaced-apart spirals are serially connected to one another and are otherwise spaced apart from one another. In another embodiment all of the turns in each of the spaced-apart spirals are continuous and splice-free conductor.

A wiring assembly of the type which, when conducting current, generates a magnetic field or which, in the presence of a changing magnetic field, induces a voltage, is formed with a series of spaced-apart spiral configurations of conductor each positioned along a common cylindrical plane centered about an axis with each configuration having multiple layers of winding. A series of conductor segments provide electrical connections between one or more pairs of the spaced apart configurations. Layout of one or more pairs of the conductor segments which effect the connections measurably offset magnetic field magnitudes of order m generated by each conductor segment when the segments are conducting current. In an embodiment of this wiring assembly:

(i) a first conductor segment is positioned to carry current in a clockwise direction to or from one configuration and has a first field contribution of order m when carrying the current and a second conductor segment is positioned to carry current in a counterclockwise direction to or from another configuration and has a second field contribution of order m when carrying the current, (ii) at a position along the axis, when the segments are conducting current, the first field contribution of order m and the second field contribution of order m are additive to provide a measurable net magnitude of the combined first field contribution of order m, and (iii) the first and second conductor segments are positioned in sufficient proximity of one another that the magnitude of the net field contribution of order m resulting from the combined contributions of the first and second segments is less than the sum of the magnitudes of the individual field contributions of order m generated by each segment. In an embodiment of this assembly the first and second conductor segments are positioned in sufficient proximity of one another that the magnitude of the net field contribution of order m resulting from the combined contributions of the first and second segments is less than the magnitudes of the individual field contribution of order m generated by either segment. For each configuration, the layers of winding each comprise a series of turns and the layers may each be positioned in a different one of multiple cylindrical planes each centered about the axis.

In an assembly of the type which, when conducting current, generates a magnetic field or which, in the presence of a changing magnetic field, induces a voltage, a winding configuration includes multiple layers of conductor where each layer is a helically shaped, comprising a conductive material formed along a different cylindrical plane. Each of the cylindrical planes is centered about a common axis wherein the conductive material in each layer is electrically connected to conductive material in the other layers to provide a multi-layer helical winding configuration. In one embodiment the winding configuration is in the shape of a saddle coil. Each helically shaped layer may comprise a series of connected turns of the conductive material and the turns may be spaced apart from one another. The winding configuration may be in the shape of a multilayer saddle coil and each helically shaped layer may comprise a segment of conductor machined or otherwise patterned into a layer of conductive turns of a saddle coil geometry, and contact surfaces of conductor segments in adjacent ones of concentric coil rows may come into direct contact with one another to effect current flow from layer to layer.

Concentric coil rows may be laminate structures comprising a conductive material deposited thereon. Such laminated concentric coil rows may be cylindrically shaped bodies each comprising m spaced-apart winding configurations with each winding configuration approximating a $\cos(m\theta)$ current density relationship as a function of position along each winding configuration, where m is an integer value greater than zero and $\theta$ is an azimuthal angle measured about the axis. Each winding configurations may have a conductive material deposited thereon and patterned to form a helically shaped layer.

A method is provided for forming a superconductor in a channel having a spiral path comprising. Chemical precursor material for synthesizing the superconductor is placed in a tube. The tube containing the chemical precursor materials is placed in the channel. The precursor material is chemically reacted in the tube after the tube is placed in the groove to synthesize the superconductor in situ. The tube may comprise a combination of a barrier metal and a stabilizing metal. In one embodiment the superconductor is MgB2, the tube comprises copper and a surface along the inside of the tube is plated with niobium.

A method is also disclosed for fabricating a superconducting assembly which forms a superconducting material in situ during fabrication of a winding configuration. The assembly may, when conducting current, generate a magnetic field or, in the presence of a changing magnetic field, induce a voltage. According to the method precursor materials for synthesizing the superconducting material are mixed together in stoichiometric proportions. A plurality of channels are created in a support structure with each channel positioned along a different cylindrical plane but centered about a common axis, Each channel comprises multiple helically shaped turns connected to one another. The mixed precursor materials are placed in each of the channels and reacted to synthesize the superconductor in the channels. According to disclosed embodiments, the superconductor material in each channel of helically shaped layer is electrically connected to superconductor material in another of the channels to provide a multi-layer helical winding configuration. Multiple ones of the channels containing the precursor material may be sequentially formed in different cylindrical planes about the axis and then simultaneously heated to create a series of concentric channels each filled with one or more superconductive segments of wire. Also, the step of sequentially forming the channels may include:

initially forming each of the channels as a groove in a layer of material, each groove having an opening into which the precursor material is placed; and after placing the precursor material in the groove, covering the opening with another layer of material which closes the opening and provides further material in which another channel can be formed.

There is also presented another method for fabricating a superconducting assembly which forms superconducting material in situ during fabrication of a winding configuration. The precursor for synthesizing the superconducting material are mixed in stoichiometric proportions. A plurality of ports is created with each port positioned along a different cylindrical plane but centered about a common axis, with each channel comprising multiple helically shaped turns connected to one another. The mixed precursor materials are placed in each of the channels by causing the mixed precursor materials to flow into each port with a carrier liquid. The carrier liquid is allowed to evaporate so that the precursor materials build up along walls of the ports. The support structure is heated to chemically synthesize the superconductor material in the ports. The synthesized superconducting material may comprise $MgB_2$.

Another method for fabricating a superconducting assembly forms superconducting material in situ during fabrication of a winding configuration. An open channel is formed in a support structure followed by sequentially forming in the channel (i) a metal layer (e.g., copper) along a channel wall, (ii) a barrier layer (e.g., niobium) over the metal layer, and a first mixture of precursor materials in stoichiometric proportions over the barrier layer. The precursor materials are then heated to chemically synthesize a first layer of superconductor material in the channel. The mixture of precursor materials may be repeatedly injected, dried and compacted in the channel. The step of forming in the channel the mixture of precursor materials may include injecting a slurry containing the precursor materials in the channel. The method may also include forming over the first mixture of precursor materials an insulative layer, and then the repeating the steps of forming in the channel (i) a metal layer along a channel wall, (ii) a barrier layer over the metal layer, and a mixture of precursor materials in stoichiometric proportions over the barrier layer, followed by heating the precursor materials to form a second layer of superconductor material in the channel which is electrically isolated from the first layer of superconductive material. Also, the method may include that step of sealing the channel with silicon oxide or ceramic material before progressing to next level.

In numerous embodiments channels or ports may be formed with variable cross sections and the area in cross section of the superconductor material may be increased along curved portions of turns in helical wiring configurations to limit maximum current density or avoid reaching critical field levels when the assembly carries current through the superconducting material.

Portions of support structures on which wiring configurations are formed may be insulative and incorporate ceramic or glass fiber material in a resin composite to modify the temperature characteristics or mechanical properties of the support structure.

According to other embodiments a configuration for a superconducting winding, of the type which, when conducting current, generates a magnetic field or which, in the presence of a changing magnetic field, induces a voltage, includes a spiral channel which accommodates two or more layers of the superconductor material for positioning therein, one layer over another layer. The channel includes a series of connected channel turns formed in a portion of a body. The turns are positioned along a path so that the channel extends along an axis, the channel having a depth extending in a radial direction with respect to the axis to contain the two or more layers. The channel includes a series of shaped repository openings along walls of the channel, and each repository opening is positioned a different radial distance from the axis to provide a series of repository positions. One or more of the repository positions is positioned over another one of the repository positions, and each repository opening is of a dimension smaller than a thickness dimension of the conductor to be passed therethrough to restrict passage of each conductor into an adjoining repository position such that a force must be applied to push the conductor through the repository opening and into the repository position. The configuration includes (i) a first segment of copper conductor positioned in a first repository position closest to the axis;

(ii) a first barrier layer formed on a surface of the copper conductor;

(iii) a first mixture of precursor material for synthesizing the superconductor material in a second repository position over the first repository position;

(iv) an insulative space over the second repository position;

(v) a second segment of copper conductor positioned in a third repository position positioned over the second repository position;

(vi) a second barrier layer formed on a surface of the second segment of copper conductor;

(viii) a second mixture of precursor material for synthesizing the superconductor material in a fourth repository position over the third repository position; and (ix) an insulative layer over the fourth repository position.

The first segment of copper conductor may be a body of copper wire inserted into the first repository position, or deposited copper formed in the first repository position.

BRIEF DESCRIPTION OF THE DRAWINGS

Background information and features of the invention are described in conjunction with the figures wherein:

FIGS. 7A and 7C are plan views of groove segments taken from above an exposed cylindrically shaped surface of the insulative body. FIG. 7B is a perspective view from above the exposed cylindrically shaped surface of the insulative body. FIGS. 7E, 7F and 7G are, respectively, perspective views along planes 7C-7C, 7E-7E, 7F-7F, 7G-7G and 7H-7H indicated in FIG. 7C. Each plane 7C-7C, 7E-7E, 7F-7F, 7G-7G and 7H-7H is orthogonal to the equatorial plane EP. A key shown in FIGS. 7D, 7E, 7F, 7G and 7H identifies the illustrated conductor turns by layer number $L_i$ and turn number $T_i$.

DETAILED DESCRIPTION OF THE INVENTION

Figure 1A:
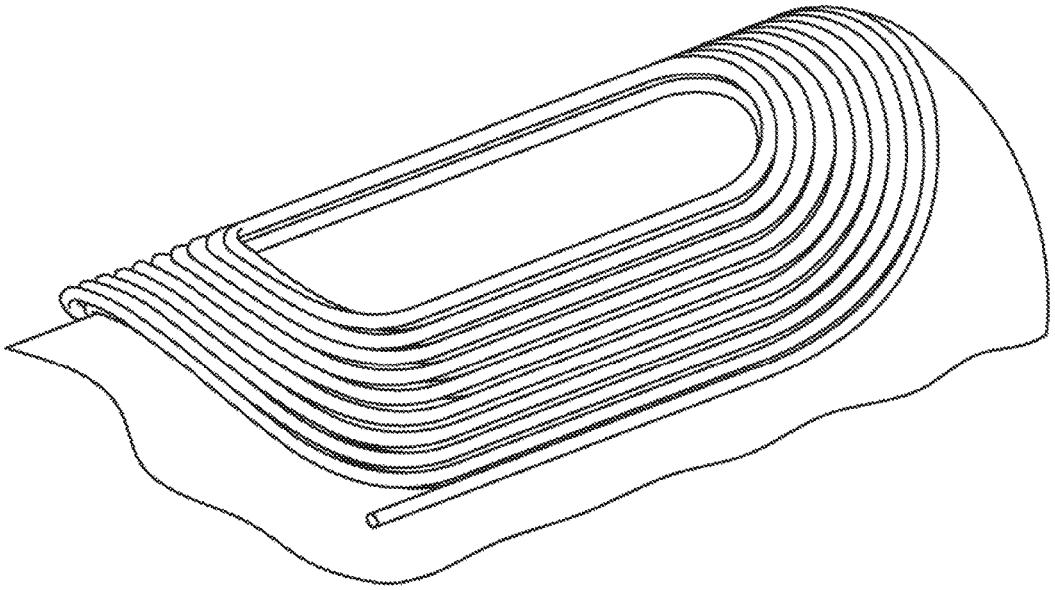
FIG. 1A is a perspective view of a conventional saddle coil positioned along a coil axis.
Figure 1B:
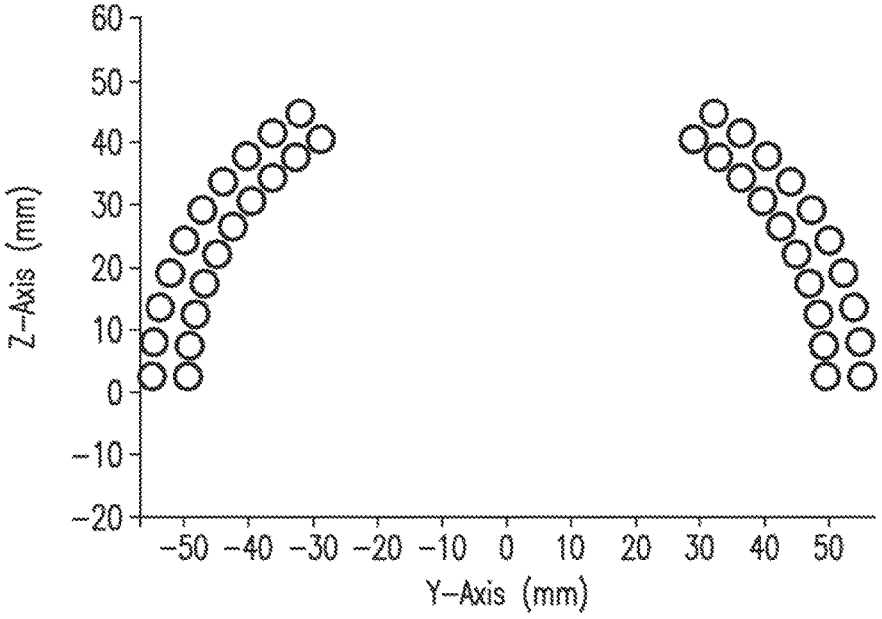
FIG. 1B is a view in cross section of the saddle coil shown in FIG. 1A, the view being taken along a plane passing through the coil axis.
Figure 2A:
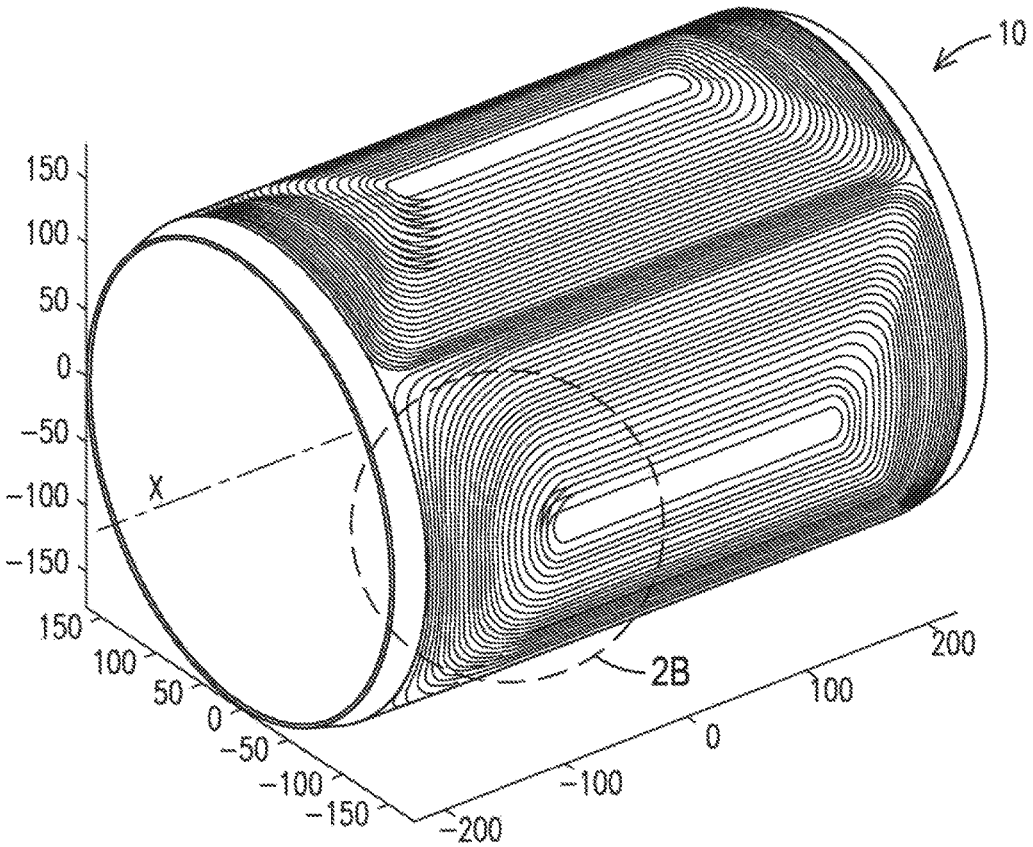
FIG. 2A is a perspective view illustrating a quadrupole magnet according to multiple embodiments of the invention as described herein, comprising four saddle coils positioned about a coil axis in a cylindrically shaped insulative body extending along an equatorial plane EP.
Figure 2B:
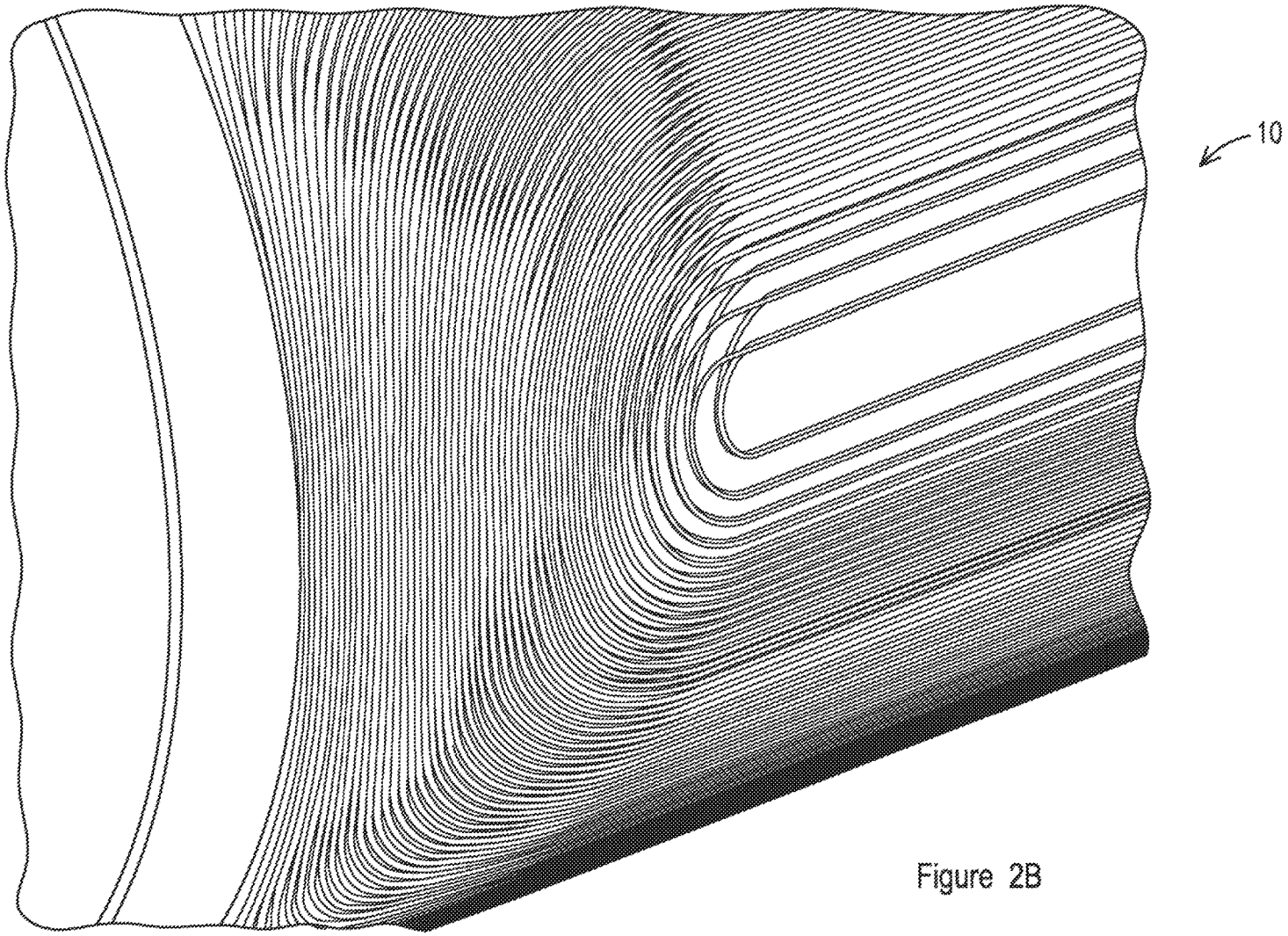
FIG. 2B is an enlarged view of a portion of a set of coil turns in the magnet of FIG. 2A.
Figure 2C:
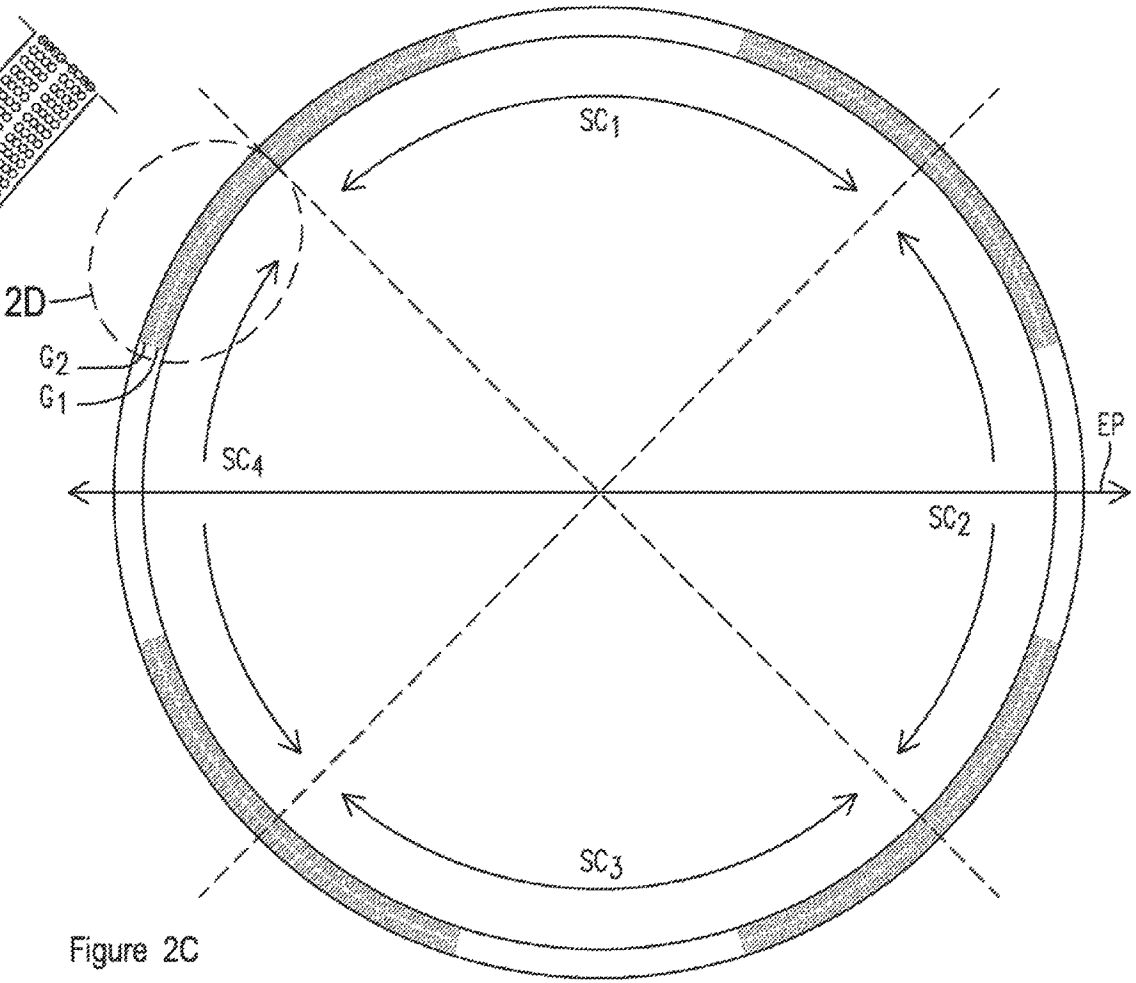
FIG. 2C is a view in cross section of the magnet shown in FIG. 2A taken along a plane passing through the coil axis to illustrate two grooves, i.e., an inner groove and an outer groove, formed about the coil axis, with four layers of conductor winding stacked in each groove. The coil turns as shown are symmetrically disposed about the equatorial plane EP.
Figure 2D:
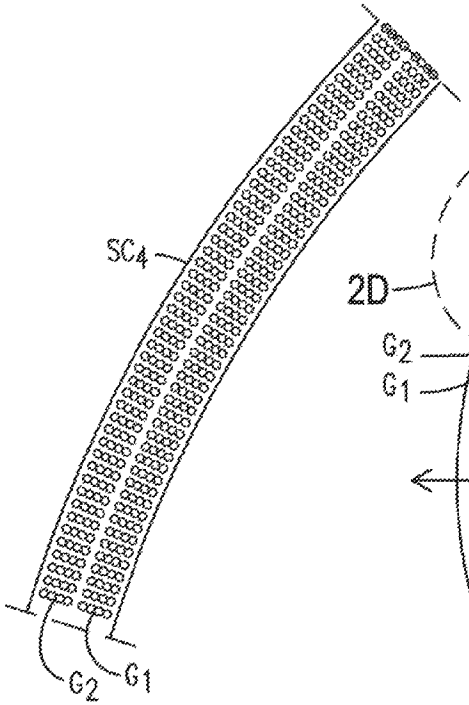
FIG. 2D is an enlarged view of a portion of the view shown in FIG. 2C to illustrate four layers of conductor winding stacked in each of the two grooves.

Before describing in detail particular methods, structures and assemblies related to embodiments of the invention, it is noted that the present invention resides primarily in a novel and non-obvious combinations of components and process steps. So as not to obscure the disclosure with details that will be readily apparent to those skilled in the art, certain conventional components and steps have been omitted or presented with lesser detail, while the drawings and the specification describe in greater detail other elements and steps pertinent to understanding the invention. Further, the following embodiments do not define limits as to structure or method according to the invention, but only provide examples which include features that are permissive rather than mandatory and illustrative rather than exhaustive.

According to embodiments of the invention, the current density distribution in any cross section perpendicular to the central axis of symmetry of the coil system is a function of the azimuth angle θ which function substantially follows a cos(mθ) current density distribution where m is a multiple order, i.e., an integer greater than zero. This will yield a substantially pure multipole field. In describing the invention, a central axis of symmetry for windings in a saddle coil magnet is referred to herein as an X axis as commonly understood in a cylindrical coordinate system, or in a Cartesian coordinate system comprising three orthogonal axes X, Y and Z. Also, in describing the invention, the angle θ is the azimuthal angle measured in a plane transverse to the X-axis. An exemplary configuration of a quadrupole coil magnet 10 according to the invention is shown in FIG. 2, consisting of four interconnected saddle coil windings $SC_1$, $SC_2$, $SC_3$ and $SC_4$, formed on a cylindrically shaped body 12 that surrounds a cylindrical aperture. The four saddle coil windings are formed along an exposed surface 20 of the cylindrically shaped body 12 and are symmetrically disposed about the X-axis, which is centrally positioned within the aperture. That is, the four saddle coil windings are spaced ninety degrees apart on center along the surface 20.

To generate high field uniformity in a magnet having a pole configuration of order n, the current density distribution has to be substantially proportional to the cosine of m times the azimuth angle, i.e., cos(mθ). In the past, designs for the winding of conductor around a central island have not been suitable for generating an optimum field uniformity, i.e., substantially in accord with a cos(mθ) distribution. Embodiments of the invention introduce multiple spacers between individual turns of the coil winding to enable a controlled placement of a coil winding in substantial accord with an ideal cos(mθ) and thereby improve the current density distribution for superior field uniformity distribution over the full length of the coil.

Double-helix coils, as described in U.S. Pat. No. 6,921,042 and U.S. Pat. No. 7,864,019, produce almost perfect cos(mθ) current density distributions over the central part of the winding configuration. However, for winding configurations with small aspect ratios of diameter to length, double-helix windings do not produce pure multipole fields, since the coil ends do not obey the required cos(mθ) current density distribution.

Coil turns that produce pure cos(mθ) current density distributions can be modeled. However, features of the invention are based on a recognition that conventional saddle coil layout and fabrication techniques are not well-suited for constructing saddle coil winding turns which are stable during operation and which sufficiently conform to these analytics. It is believed the reasons prior efforts have not been undertaken to construct saddle coil magnet configurations which produce pure cos(mθ) current density distributions include that (i) achievable benefits have not been fully recognized, especially in the context of fully superconducting, high current-carrying windings, and (ii) complexities in the ideal coil winding geometries render it difficult to design a suitable layout or fabrication process, i.e., to provide a series of turns in a saddle coil configurations which are both (a) stable during magnet operation and (b) in sufficient accord with the required non-linear analytics to realize desired high quality field components.

Embodiments of the invention are in recognition that the precision with which coil winding turns are positioned is highly determinative of whether fields can be generated with pure cos(mθ) current density distributions. According to one series of such embodiments it is possible to fabricate saddle coil configurations that satisfactorily replicate pure cos(mθ) current density distributions with the aid of multiple, discrete spacer elements positioned between adjacent winding turns over the full length of the coil. However, the spacer elements must be relatively complex and must vary, both in shape and thickness, in order to satisfactorily accommodate non-linear variations in coil position along the entire major axis of the saddle coil winding.

Requirements that spacers change in shape and size as a function of axial position add extensive design complexities, rendering it both costly and difficult to stabilize each coil winding turn in sufficient conformity with modeled analytics. It is especially difficult to rely on discrete spacers to conform the winding path with suitable precision to an ideal path along the axial ends of the coil.

Accordingly, other embodiments of the invention provide fabrication methodologies which yield highly accurate, repeatable and more cost effective means to substantially conform winding configurations to the ideal winding analytics required to generate pure cos(mω) current density distributions. In one embodiment of the invention, continuous body material functions as a variably dimensioned continuous series of discrete spacers which securely define the paths of winding turns according to spacings between adjacent winding turns as required for the cos(mω) current density distributions. The body material retains designated positioning of wiring turn conductor 14 under large Lorentz forces experienced during coil operation. By forming a path for saddle coil winding turns in solid media it is possible to provide the benefits of discrete spacer elements without incurring the difficult tasks associated with assembling multiple spacer elements of differing shapes and dimensions.

Assembly of the interconnected saddle coil windings, $SC_k$, (k=1 to 4) of the quadrupole magnet 10 is described in detail for a first of the saddle coil windings $SC_1$. Generally, conductor turns of the first saddle coil winding, $SC_1$, are securely and precisely positioned in one or more grooves that are each machined within a layer, or within a sublayer, of solid insulative material in the cylindrically shaped body 12. See FIG. 3A. Each groove is formed with a spiral geometry that accommodates the spiral pattern of the conductor turns. With this approach, it is possible to provide a novel structure comprising multiple levels of winding layers, $L_i$, in each groove. Each layer in the groove has multiple turns, $T_j$, to achieve a required number of ampere-turns. See FIGS. 3, 4 and 6.

With designs according to the invention, conductor turns, $T_j$, in each layer, $L_i$, are formed in a groove, and stacks of layers, $L_i$, can be formed in the same groove. Multiple grooves, each comprising a stack of layers, $L_i$, are concentrically formed about a common axis, X. The described embodiment includes an arbitrary number of concentrically formed grooves, G. Specific reference to each of two illustrated grooves, G, is made by identifying the groove closest to axis, X, as groove $G_1$, and the groove farthest from the axis, X, as groove $G_2$.

The turns, $T_j$, of conductor 14 within each layer $L_i$ are each formed in a turn, $GT_j$, of the groove, G. Stacks of conductor turns $T_j$ (each being a turn in a sequence of adjoining layers, e.g., $L_i$, $L_{i+1}$, $L_{i+2}$, $L_{i+3}$) can be formed or placed, one turn over another, in the same groove as illustrated in FIG. 3B.

Referencing of conductor turns $T_j$ in each layer $L_i$ is based on indexing in an alternating sequence as the conductor 14 progresses from layer to layer. That is, in the illustrated embodiments, the turns of a first and lowest level layer, $L_1$, begin from the outside of a spiral pattern with a first turn (i.e., j=1) and progress to an innermost and last, nth, turn in the layer, while the turns of a next, second, level layer, $L_2$, in the sequence of layers, begin from the inside of a spiral pattern with a first turn (i.e., j=1) and progress to an outermost and last, nth, turn in the second layer, $L_2$. The indexing of turns continues an alternating pattern of numbering which begins with the first turn $T_1$ at the outside of the spiral pattern in the third layer, and begins with the first turn $T_1$ at the inside of a spiral pattern in the fourth layer, and the alternating sequence continues for additional layers formed thereover.

For embodiments of the invention where n layers $L_i$ (i=1 to n) are positioned in the same spiral groove pattern, one over another, referencing of groove turns $GT_j$ does not vary in an alternating manner from layer to layer. Rather, an ordered numbering of the groove turns remains consistent, retaining the same designation, regardless which conductor segment $W_i$ is being viewed in the figures. For example, throughout FIG. 6 the outermost turn at the outside of the spiral groove pattern is always referred to as the groove turn $GT_1$ and the innermost turn at the inside of the spiral groove pattern is referred to as the groove turn $GT_n$.

The groove turns $GT_j$ are formed in a winding pattern that substantially meets the requirement of pure cos(mθ) current density as a function of azimuth angle θ. The following methodology provides paths along the groove turns to which conductor winding configurations conform in multipole magnets of arbitrary order, n, (such as the quadrupole magnet 10) to yield almost perfectly pure cos(mθ) current density distributions over the entire length (where length is measured along the direction of the axis, X) of each saddle coil winding, i.e., including the end regions. The combination of this methodology with methods of assembly, such as illustrated for the magnet 10, enables fabrication of magnets with small aspect ratios and high field uniformities.

A multipole saddle coil magnet of order n is generated with n identical saddle coil windings, $SC_k$, symmetrically arranged around the circumference of the cylindrically shaped body 12 as shown for the quadrupole magnet 10 in FIGS. 2 and 3. See, for example, U.S. Pat. No. 7,992,284 issued Aug. 9, 2011, and U.S. Pat. No. 7,880,578 issued Feb. 1, 2011, each assigned to the assignee of this application and now incorporated herein by reference. It can be shown that for N turns $T_j$ per layer $L_i$ (i.e., in each conductor segment, $W_i$, where j=1 to N, the following distribution in angles $\theta_n$ yields an excellent approximation of current density over the circumference of the cylindrically shaped body 12 for the straight sections of the winding:

$$\sin(m*\theta_n) = \frac{n-1/2}{N} \qquad \text{Equation (1)}$$

That is, for a series of straight lines parallel to the X axis, Equation 1 defines the angular distribution of those lines about the surface of the cylindrically shaped body on which a saddle coil is formed and which yield the cos(mθ) current density distribution. The length of these lines is arbitrary.

For a dipole magnet, the angle θ for each of the two saddle coils $SC_k$ will cover an angular interval of 180 degrees. Equation (1) can be solved for $\theta_n$ to obtain the azimuth angle of each turn in each layer $W_i$. The spacing between adjacent portions of conductor 14 in each conductor segment $W_i$, (when placed in the groove turns, $GT_j$) is, according to Equation (1), greatest near θ=0 and decreases to a minimum spacing near plus or minus 90 degrees. The four saddle coils $W_i$ of For the quadrupole magnet 10 the angle θ for each of the four saddle coils $SC_k$ each spans an angular interval of 90 degrees along the circumference of the cylindrically shaped body 12 with the turn-to-turn spacing again defined by equation (1). More specifically, when the angle is measured about the axis, X and from a plane of symmetry, $PS_1$, in which the axis, X, lies, the plane $PS_1$ extending from the axis, X, and through a line of symmetry of the saddle coil, $SC_1$: the spacing between adjacent portions of conductor according to Equation (1) is greatest near the plane $PS_1$ (i.e., near θ=0) and decreases to a minimum spacing near plus or minus 45 degrees relative to the plane $PS_1$. A similar plane of symmetry $PS_i$, in which the axis, X, lies, also extends from the axis, X, and through a line of symmetry of the saddle coil, $SC_k$.

To approximate a pure cos(mθ) current density distribution for the coil ends, i.e., in those portions of the coil turns which are not parallel with the axis, X, a shape function is introduced in the mathematics of equation (1) to yield:

$$F(x)*\sin(m*\theta_n) = \frac{n-1/2}{N} \qquad \text{Equation (2)}$$

The shape function F(x) determines the contour of the saddle coil with respect to the axial direction, x, and describes how far the turns in each layer of the winding configuration extend in axial direction. Selection of the shape function is constrained to two boundary conditions:

(i) the function having a value of one at or near the point at which the function intersects each straight section (i.e., at the end of each straight section) and (ii) the function having a value of zero at the farthest axial extension of the coil.

Figure 14:
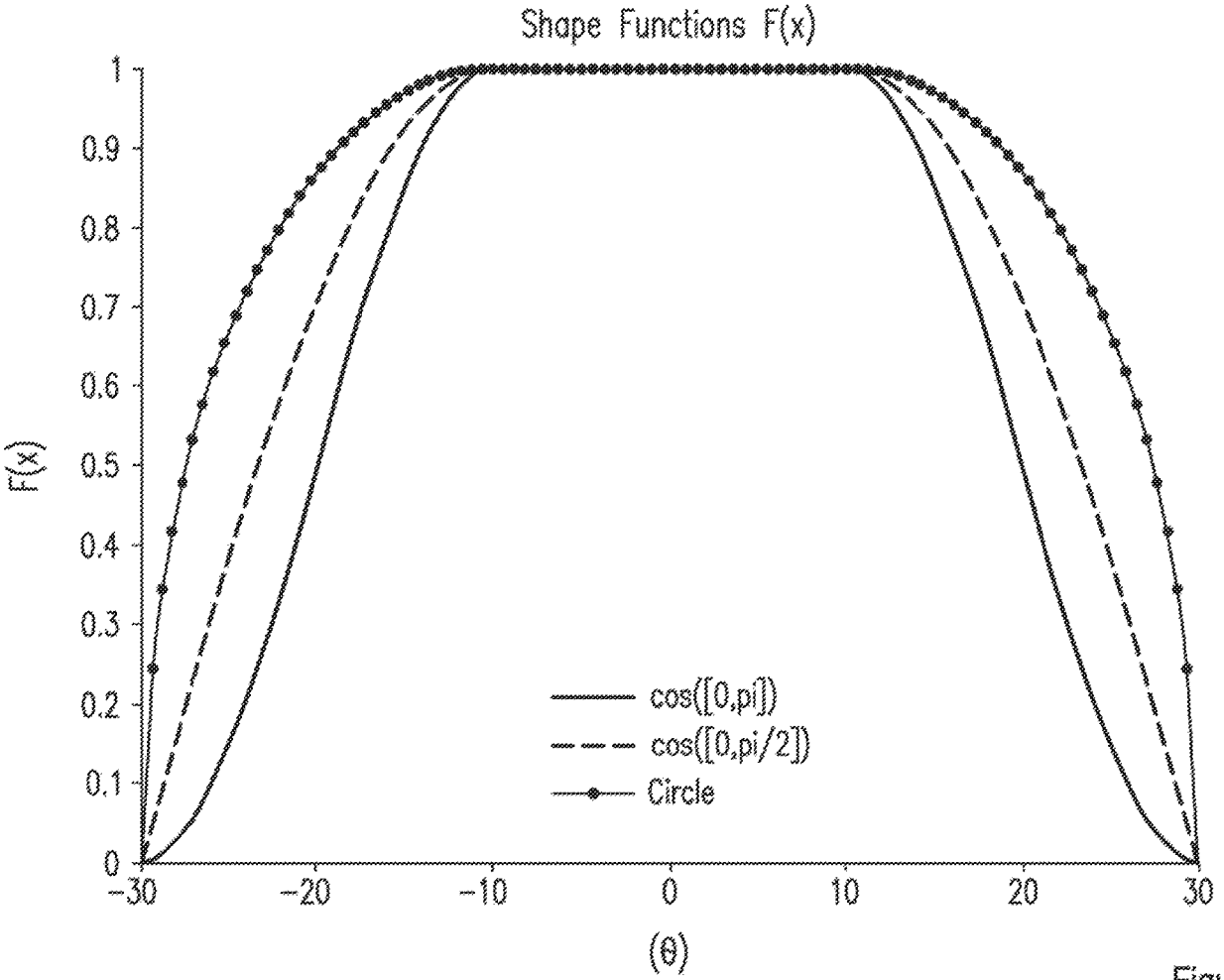
FIG. 14 illustrates a series of useful shape functions, F(x), which determine the contours of saddle coils in magnets according to the invention.

Given these boundary conditions for the shape function, the values provided by equation (2) provide continuity between curved portions of the wiring path defined by the shape function and portions of the wiring path parallel with the axis, X, these being consistent with the cos(mθ) current density distribution. Examples of shape functions, F(x) are shown in FIG. 14. With reference to Equations (1) and (2) it is to be understood that any characterization of a turn, $T_n$, or a spiral pattern constructed according to the invention as conforming to these equations refers to a conformity within reasonable fabrication tolerances.

An exemplary configuration of a quadrupole coil magnet 10 according to the invention is shown in FIG. 2, consisting of four interconnected saddle coil windings $SC_1$, $SC_2$, $SC_3$ and $SC_4$ formed on a cylindrically shaped body 12 that surrounds a cylindrical aperture. The four saddle coil windings are formed along an exposed surface 20 of the cylindrically shaped body 12 and are symmetrically disposed about the X-axis, which is centrally positioned within the aperture. That is, the four saddle coil windings are spaced ninety degrees apart on center along the surface 20.

Figure 18:
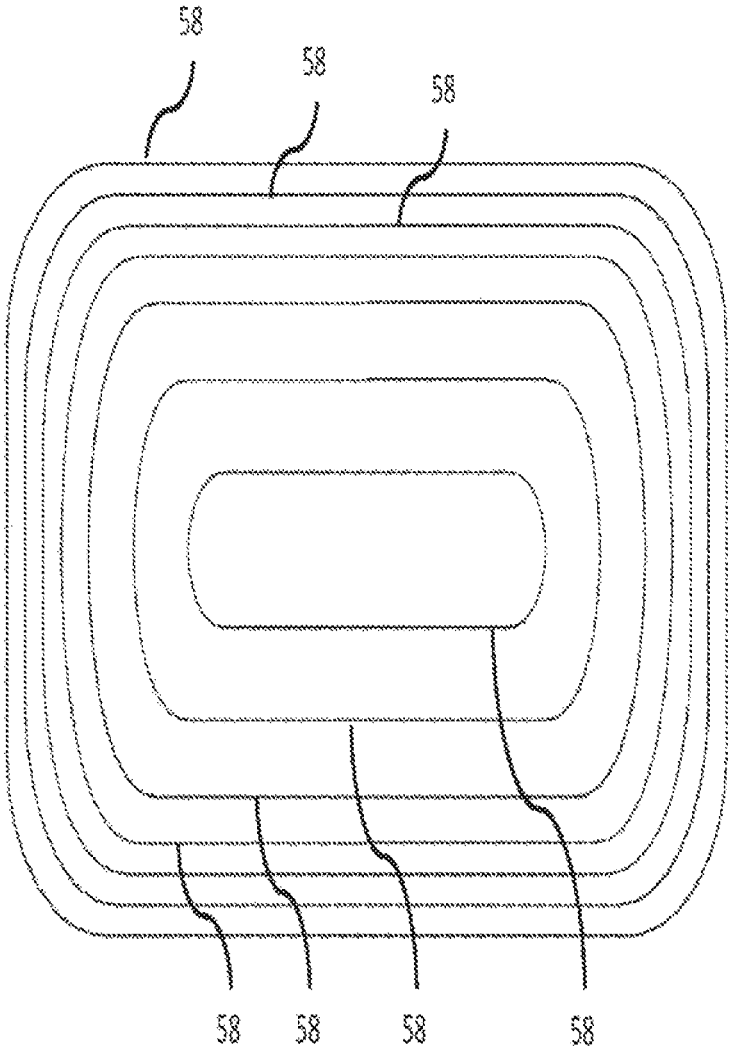
FIG. 18 illustrates a series of exemplary closed shapes of conductor according to Equation (2) herein.

The groove paths and winding configurations obtainable according to Equation (1) and Equation (2) correspond to closed shapes. Accordingly, they do not describe the spiral nature of the conductor segments $W_i$ comprising multiple interconnected turns $T_j$ formed in the groove turns $GT_j$ in saddle coils according to the invention. For comparative purposes FIG. 18 illustrates a series of exemplary closed shapes 58 of conductor according to Equation (2). Modifications of the shapes 58 shown in FIG. 18 can be computed numerically in a variety of ways to impart spiral shapes for the conductor 14 according to the invention. For example, the shape function can be spatially shifted while the length of a straight section of each turn $GT_j$ is shortened or lengthened to preserve continuity in the path function. This advances or delays the curvature imparted by the shape function F(x), with respect to position along the axis, X, e.g., on one side of the winding, thereby imparting a spiral shape that matches the next turn defined by Equation (2). The deviation introduced, relative to the ideal path required to generate pure fields in accord with a cos(mθ) current density distribution, has been assessed and found to be relatively small and tolerable. That is, notwithstanding providing a series of turns comprising multiple deviations of this nature, adverse effects on field quality appear tolerable for most if not all potential multipole saddle coil magnet applications. However, any adverse effects can nonetheless be offset by modifying the shapes of turns in a conductor segment to compensate for such perturbations using numerical optimization techniques. See, again, U.S. Pat. No. 7,992,284 and U.S. Pat. No. 7,880,578. Notwithstanding an ability to apply optimization techniques to reduce undesired multipole content, the discussion of the invention refers to construction of saddle coils with groove turns $GT_j$ and conductor segments $W_i$ or conductor turns $T_j$ positioned in groove turns which result in generation of fields that substantially conform to that required to produce pure multipole fields, and to generation of fields which substantially conform to pure multipole fields as may be ideally generated in accord with a pure cos(mθ) current density distribution throughout each conductor segment $W_i$.

Stacked layers of conductor turns positioned in the groove turns $GT_i$ of the same groove, G, individually or collectively, conduct current in a winding pattern that satisfactorily replicates fields corresponding to pure cos(mθ) current density distributions. In this context, the term turn, coil turn, or wiring turn, refers to a conductor turn. A conductor turn may be a partial or a complete revolution of a conductor 14, e.g., wire, positioned in a spiral pattern along a cylindrical plane. In this context, a layer, $L_i$, comprises all turns formed along one cylindrical plane of a single saddle coil, or comprises all turns of multiple saddle coils formed about the same axis, i.e., along a cylindrically shaped plane defined by a fixed radial distance from a central axis of symmetry. The turns in a layer form one or more helical-like patterns typical of a saddle coil design. For example, a dipole design may include two saddle coils, e.g., two distinct helical-like patterns, formed in the same cylindrical plane, with respect to the fixed radial distance from the central axis of symmetry. However, there is no requirement that every portion of every turn in a winding layer precisely follow a path to effect a pure cos(mθ) current density distribution, or be entirely within a cylindrical plane. To avoid spatial interference between turns in different layers, deviation from an ideal path may be required. In multi-layered saddle coils, it may be necessary for wiring to extend between different layers (i.e., between different cylindrical planes) as is the case when a multi-layer coil is fabricated with a single, continuous conductor 14. It may also be necessary for the wiring to depart from an ideal path in order to extend between ideal path portions of adjoining turns in the same layer.

Figure 3A:
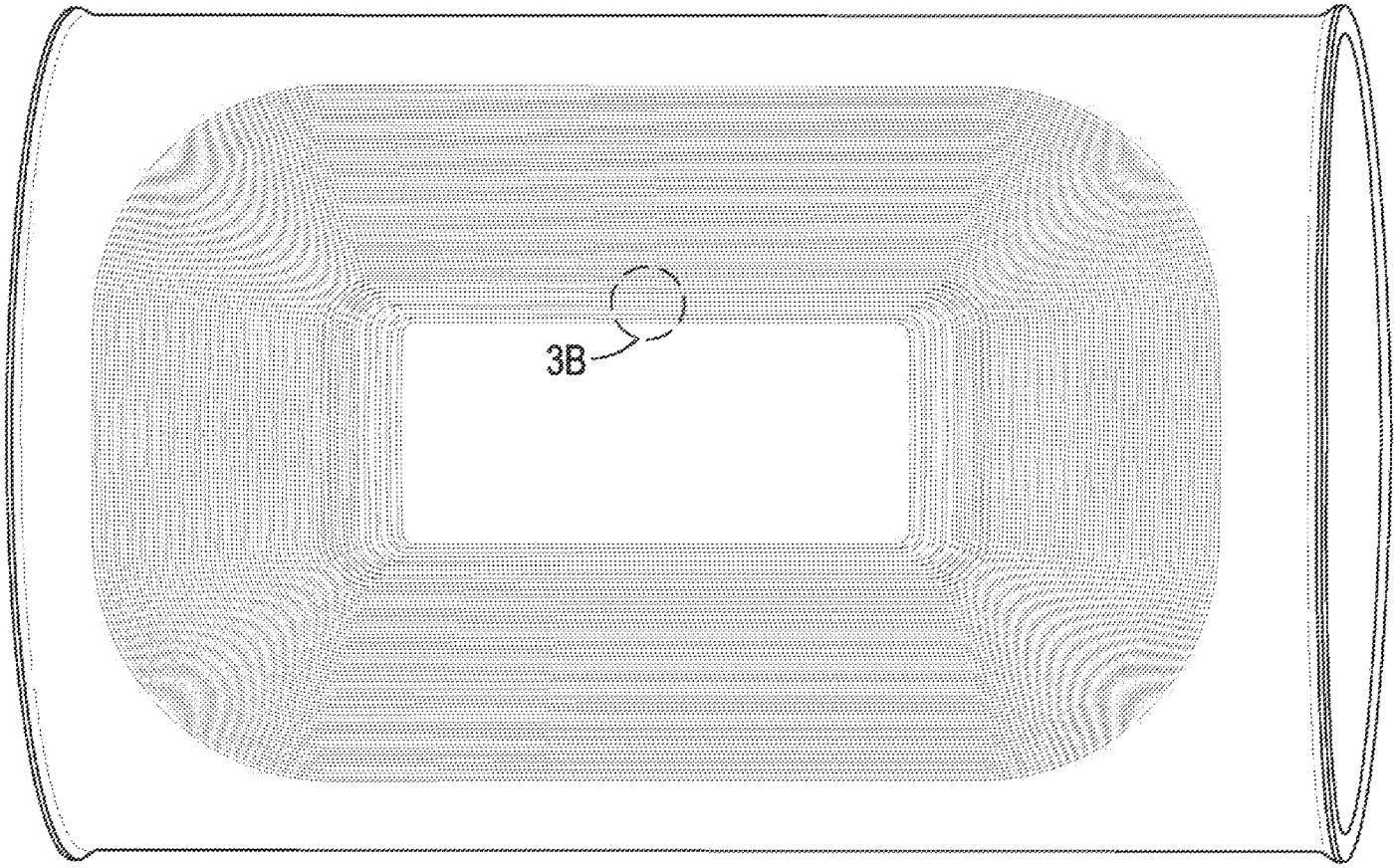
FIG. 3A is a perspective view of the quadrupole magnet shown in FIG. 2A during a stage of manufacture, illustrating placement of conductor in machined grooves which provide controlled conductor spacing.
Figure 3B:
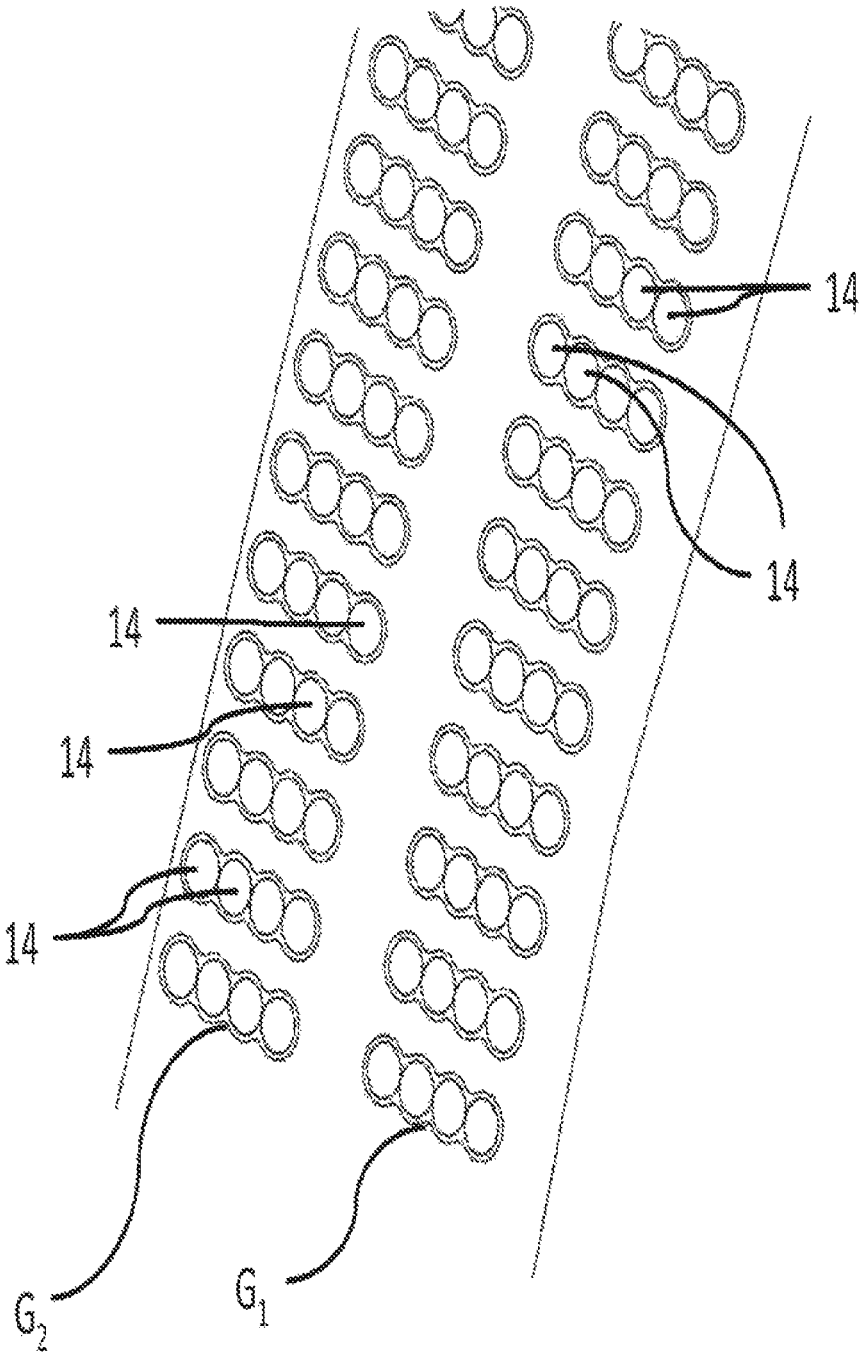
FIG. 3B is a partial view in cross section of the magnet shown in FIGS. 2A and 3A, also taken along the plane passing through the coil axis at a right angle, to illustrate four winding turns of different layers stacked one over another in turns of the inner groove.

FIG. 3A is a perspective view of a quadrupole magnet during a stage of fabrication in which each of four saddle coils are built up with multiple layers of helical-like coil patterns formed one over another. The helical-like patterns can include asymmetries as may be required to achieve an ideal, or substantially ideal, cos(mθ) current density distribution.

With reference also to FIG. 3B, during manufacture, the helical-like winding of each saddle coil in the magnet of FIG. 3A is formed in multiple layers, $L_i$, of winding turns. In this example, each layer of the groove, $G_1$, comprises fifty two helical turns and each layer of the groove, $G_2$, comprises fifty four helical turns. Each layer, $L_i$, is formed along a different one of several concentric cylindrical planes. According to another feature of the invention, each of the layers, $L_i$, in each saddle coil can, as shown in FIG. 3A, be formed in a layer of insulative material by cutting a groove in the layer of insulative material. In one embodiment (not shown), each layer, $L_i$, of saddle coil wire turns may be placed in a separate groove with different grooves formed one over another and containing one of the layers, $L_i$. However, for the magnet of FIG. 3, multiple adjoining layers of wire turns are placed one over another in one continuous groove, G. Multiple such grooves, G, each containing multiple adjoining layers of helical wire turns, are formed, one over another, with each groove formed in a different layer, or sublayer, of the insulative material. For the embodiment shown in FIG. 3A, FIG. 3B illustrates an exemplary groove, G, in which four layers $L_i$, i=1 to 4, are stacked, one over another, in the groove. The grooves, G, are each formed in a separate level or layer of insulative material. With the groove are formed to such depth that turns of four different layers, $L_1$, $L_2$, $L_3$ and $L_4$, of the helically wound wire are stacked, one over another, the layers of helical turns create a multi-level winding with one continuous wire element having a substantially circular cross section of substantially constant radius. To illustrate this feature, the partial view of FIG. 3B is a view in cross section of the four layers placed in one groove of the saddle coil of the magnet shown in FIG. 3A. The view of FIG. 3B is taken along a plane orthogonal to the central axis about which the saddle coil magnet is formed. The orthogonal plane passes through a straight portion of the helical turns of the coil. The exemplary view of FIG. 3B is taken within a region of the saddle coil indicated by a circle in FIG. 3A to illustrate eleven winding turns positioned in each of the four layers $L_i$ of conductor segments $W_i$ in the groove G1. In this embodiment the groove, $G_1$, contains two hundred and eight winding turns among four layers of the winding in the saddle coil $SC_1$ of the magnet 10.

Figure 3C:
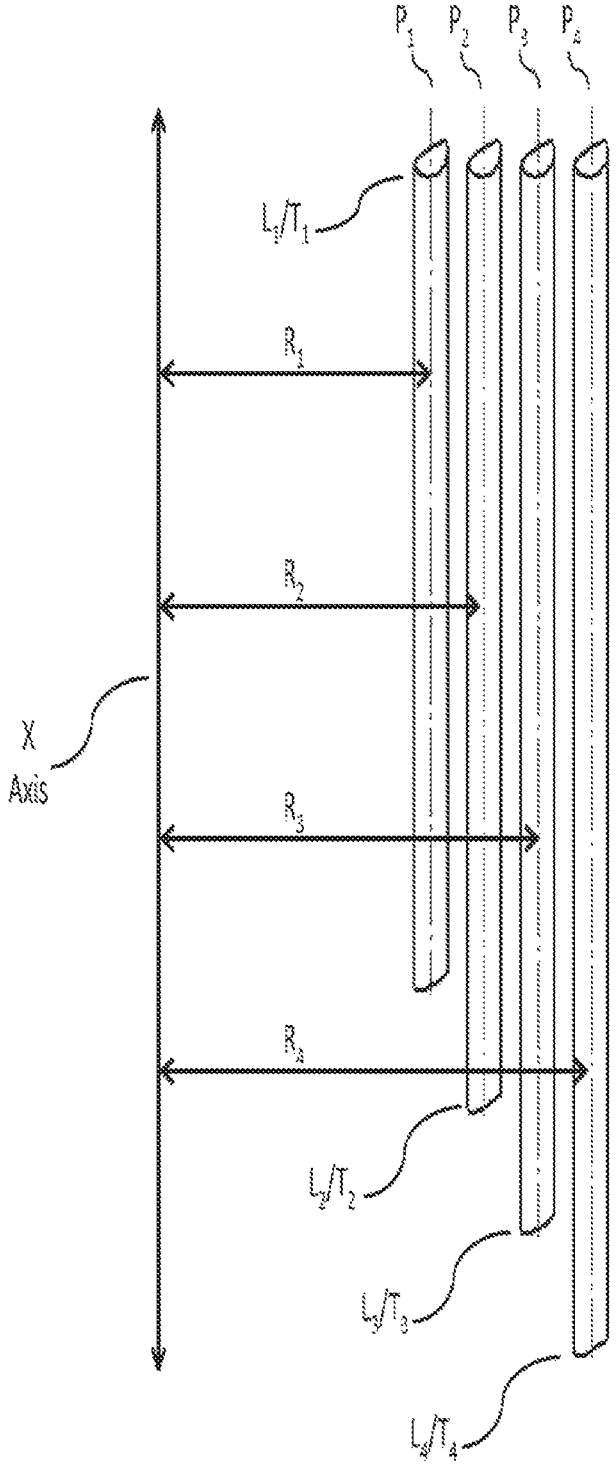
FIG. 3C is another partial view in cross section of the magnet shown in FIGS. 2A and 3A, also taken along the plane passing through the coil axis at a right angle, illustrating relative positions of four concentric cylindrical planes wherein each a the sequence of consecutive layers of helical conductor turns extends along a different one of the cylindrical planes.

FIG. 3C is a simplified view in cross section along the path of a straight portion of a groove formed in the region enclosed by the circle, C, illustrating relative positions of four concentric cylindrical planes, $P_i$ (i.e., $P_1$, $P_2$, $P_3$ and $P_4$). All of the cylindrical planes, $P_1$, are concentrically centered about a common axis, X. Each of the four planes passes through one groove. G, and each in the sequence of consecutive layers $L_1$, $L_2$, $L_3$ and $L_4$ of helical turns extends along a different one of the cylindrical planes. For example, layer $L_1$ extends along the plane $P_1$ and, generally, layer $L_i$ extends along a plane $P_i$. The axis, X, extends in a Cartesian (i.e., flat) plane (not illustrated) and along a straight line. The radial distance between each of the cylindrical planes $P_i$ and the axis, X, is $R_i$. The view of FIG. 3C is taken along the Cartesian plane in which the axis, X, extends, and through the four cylindrical planes $P_i$. The plane also passes through straight portions of adjoining turns of the groove, $G_1$, to illustrate relative positioning of stacked segments in each of the helical wire turns, $T_j$, positioned in the groove, $G_1$. Each turn is in a different one of the four layers, $L_i$, of fifty two helically wound wire turns. Each of the illustrated stacked segments of a wire turn, $T_j$, is positioned at a different radial distance from the central axis, X.

Figure 4A:
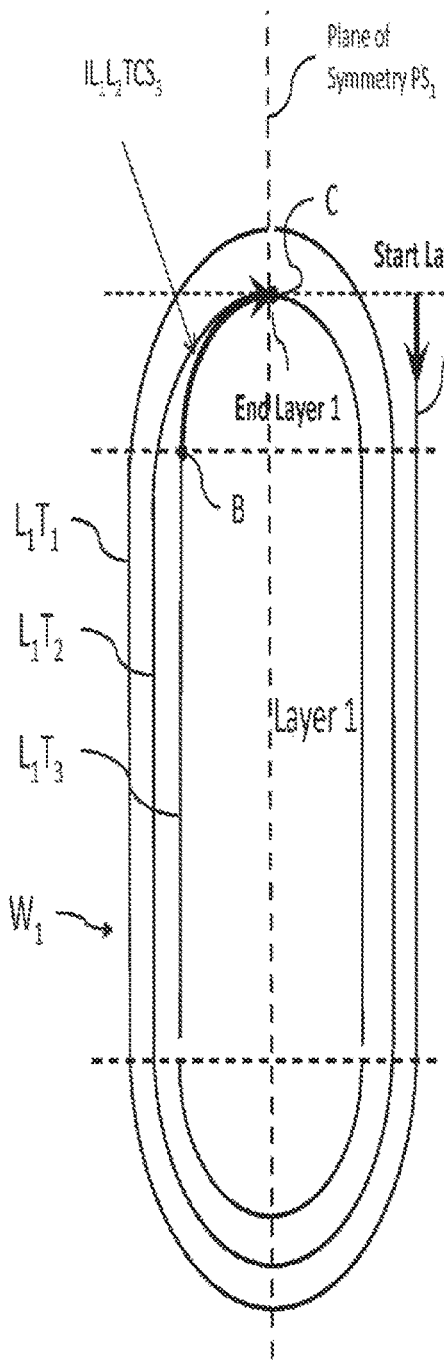
FIGS. 4A-4D are unrolled views of individual layers of conductor winding turns in the magnet of FIGS. 2 and 3, illustrating an exemplary method for providing a series of conductor turns in each of four conductor layers to provide one continuous conductor winding.
Figure 4B:
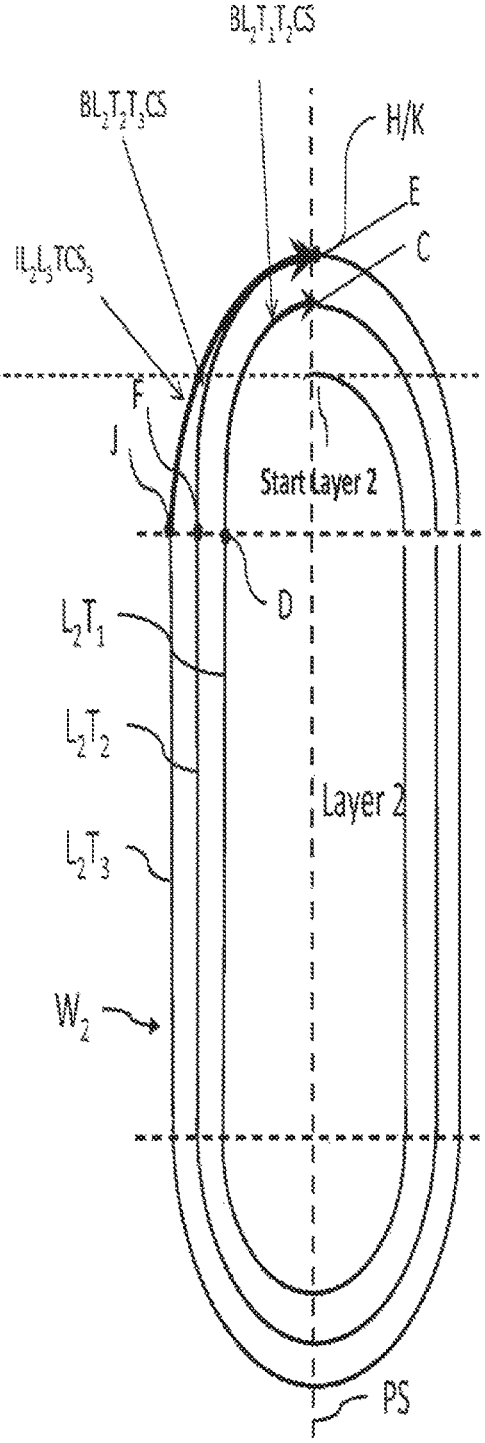
Figure 4C:
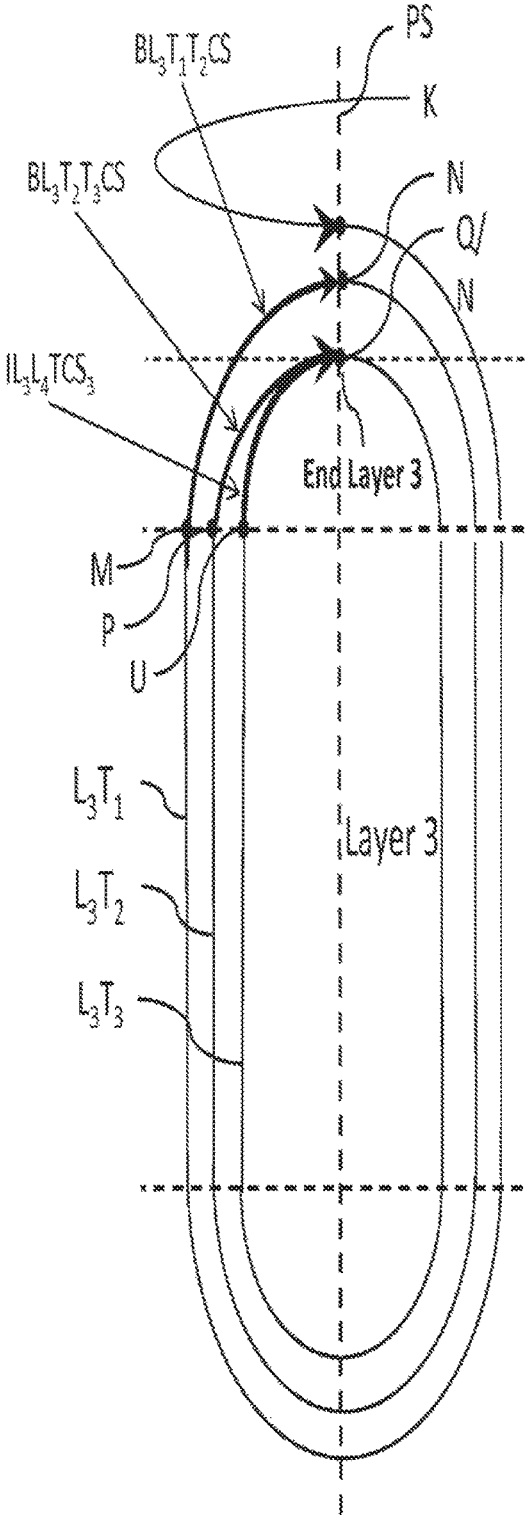
Figure 4D:
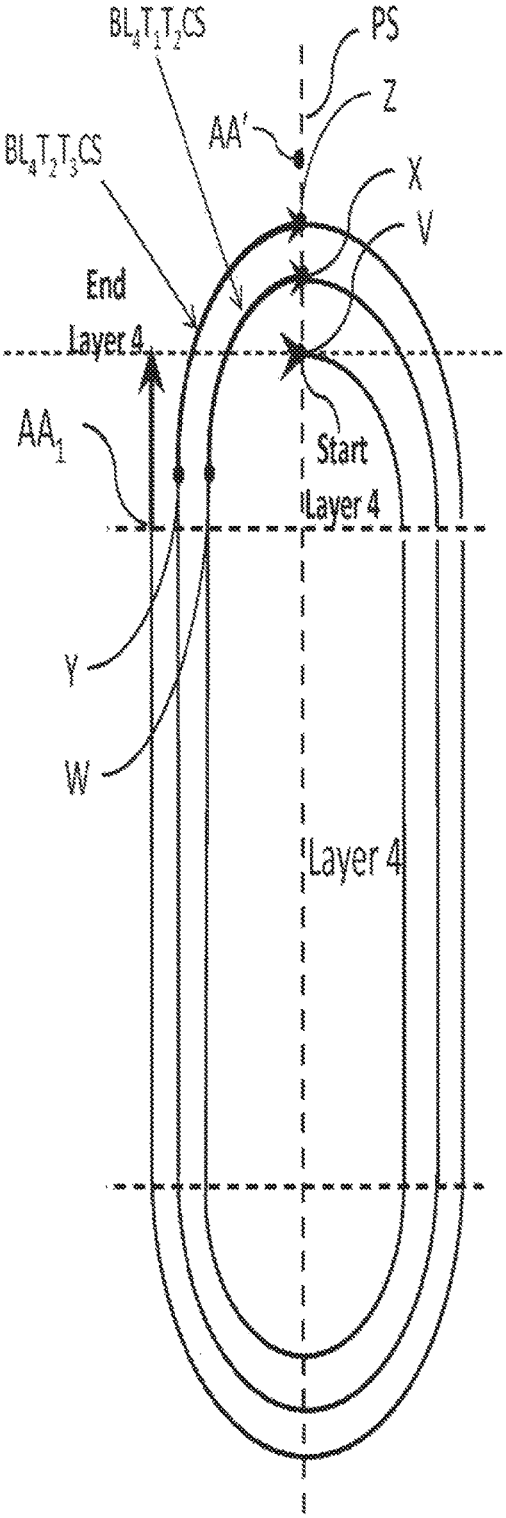
Figure 5:
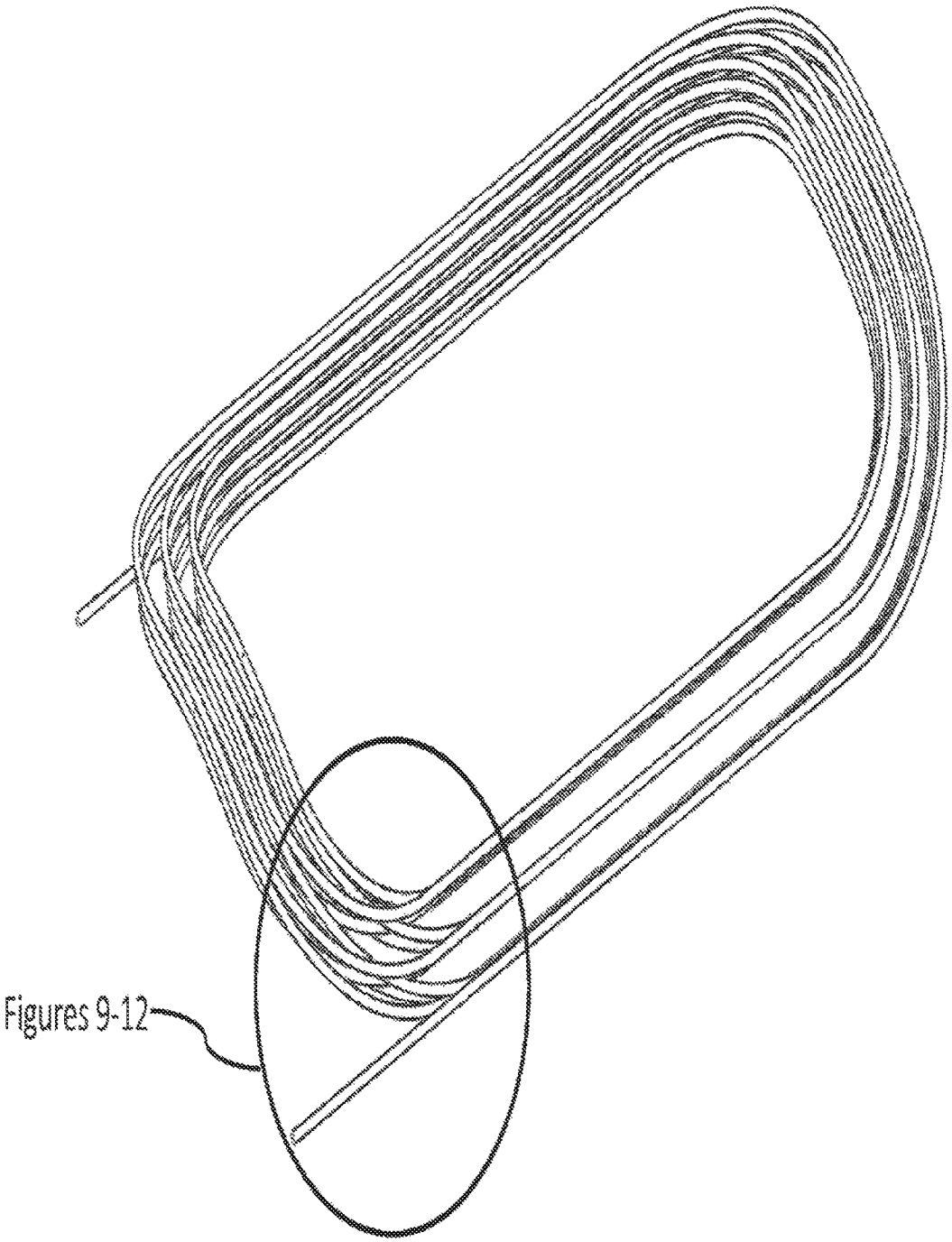
FIG. 5 is a perspective view showing a saddle coil comprising the multiple layers of continuous (unspliced) conductor winding turns, which are individually shown in FIG. 4.

As more fully illustrated in FIGS. 4 and 5, transitions between turns, $T_i$, in adjacent layers, $L_i$, $L_{i+1}$, and transitions between turns, $T_j$, in the same layer, $L_i$, can be effected with two types of transition conductor segments TCS:

(i) Bridge intraLayer Transition Conductor Segments, $BL_iT_jT_{j+1}CS$, where $L_i$ is a layer within which the transition conductor segment extends from one turn to another turn in the same layer; and (ii) InterLayer Transition Conductor Segments, $IL_iL_{i+1}TCS_j$ where $L_i$ is a layer from which a transition conductor segment extends toward another layer $L_{i+1}$, and where optional inclusion of the subscript j denotes the turn $T_j$ from which the InterLayer Transition Conductor Segment extends to a next level $L_i$.

The Bridge intraLayer Transition Conductor Segments, $IL_iTCS$, are portions of a wire conductor segment, $W_i$, which extend between adjoining turns $T_j$ and $T_{j+1}$ in a layer $L_i$.

For several of the described embodiments, the two types of transition conductor segments, TCS, are portions of several wire conductor segments, $W_i$, which form part of one continuous conductor 14 in the entire saddle coil winding of the quadrupole magnet shown in FIG. 3. Generally, each transition conductor segment TCS is positioned in a transition groove segment, TGS, which extends between two positions along the groove, G, in order to route wire formed in one turn in the groove, G, to a next turn formed in the same groove.

Also, for several of the described embodiments, transition groove segments, TGS, carry the transition conductor segments (TCS) (i) between turns $T_j$,$T_{j+1}$ within each layer, $L_i$, of the conductor winding; or (ii) between adjoining layers, e.g., $L_i$, $L_{i+1}$, of the conductor winding. With reference to FIG. 6, transition groove segments, TGS, which carry the transition conductor segments between turns within the same layer $L_i$ are referred to as Bridge Transition Groove Segments $BL_iT_jT_{j+1}TGS$. Groove segments, TGS, which carry conductor 14 between adjoining conductor layers $L_i$,$L_{i+1}$ in a groove, G, are referred to as InterLayer Transition Groove Segments $IL_iL_{i+1}TGS$. The transition conductor segments TCS are each routed along one of two types of transition groove segments to:

(i) extend portions of the conductor winding between positions on different turns in the same layer, $L_i$, e.g., between a first position along a groove turn $GT_j$ and a second position along an adjoining groove turn, $GT_{j+1}$; or (ii) extend the conductor 14 from a turn ($T_j$) in one layer, $L_i$, to a turn in an adjoining layer, $L_{i+1}$ or $L_{i-1}$.

The Bridge intraLayer Transition Conductor Segments $BL_iT_jT_{j+1}CS$ are positioned in Bridge Transition Groove Segments $BL_iT_jT_{j+1}TGS$ and the interlayer transition conductor segments $IL_iL_{i+1}TCS$ are positioned in Interlayer Transition Groove Segments, $IL_iL_{i+1}TGS$. In some instances a transition groove segment, TGS, can define a segment of the conductor winding path which substantially conforms with a desired cos(mθ) function to support an overall desired cos(mθ) current density distribution for the entire saddle coil winding. In other instances, the transition groove segment, TGS, may substantially depart from the winding path which conforms with a desired cos(mθ) function but adverse effects may be tolerable or negligible.

Bridge intraLayer Transition Conductor Segments, $BL_iT_jT_{j+1}CS$, are portions of turns which connect adjoining turns, $T_j$, in the same layer $L_i$. For a given layer $L_i$, a Bridge intraLayer Transition Conductor Segment, $BL_iT_jT_{j+1}CS$, is routed along a Bridge Transition Groove Segment, $BL_iT_jF_{j+1}GTS$, which extends between positions on different groove turns, $GT_j$, in the same groove, G. Each Bridge intraLayer Transition Conductor Segment $BL_iT_jT_{j+1}CS$ is positioned in a Bridge Transition Groove Segment, $BL_iT_jT_{j+1}TGS$, to carry conductor 14 from turn to turn within the layer $L_1$ and provide electrical continuity between adjoining turns in the layer $L_i$ of conductor winding. The Bridge Transition Groove Segments provide paths along which portions of conductor 14 (i.e., the Bridge Intralayer Transition Conductor Segments, $BL_iT_jT_{j+1}CS$), are placed to transition the conductor 14 within one layer, $L_i$, between different groove turns, $GT_j$, in the same groove, G. To effect such transition of the conductor 14, each Bridge Transition Groove Segment, $BL_iT_jT_{j+1}GTS$, extends between a first position in one groove turn $GT_j$ and a second position in an adjoining groove turn, i.e., $GT_{j+1}$ or $GT_{j-1}$, of the same groove.

Interlayer Transition Conductor Segments, $IL_iL_{i+1}TCS$, are each positioned in an InterLayer Transition Groove Segment, $IL_iL_{i+1}TGS_j$, (i.e., where optional inclusion of subscript j denotes the groove turn $GT_j$ from which the Interlayer Transition Groove Segment extends to a next level $L_i$. Such transitions between layers may be had by providing a path in an InterLayer Transition Groove Segment, $IL_iL_{1+1}TGS$, which, as the path progresses, increases in radial distance from the distance $R_i$ (i.e., from the axis, X) associated with one cylindrically shaped plane, $P_i$, to a radial distance $R_{i+1}$ (i.e., also from the axis, X) associated with the next cylindrically shaped plane $P_{i+1}$. Thus, placement of the InterLayer Transition Conductor Segment $IL_iL_{i+1}TCS$ in an InterLayer Transition Groove Segment, $IL_iL_{i+1}TGS_j$, enables the conductor 14 to extend in a direction away from the axis, X, and between one cylindrically shaped plane $P_i$ and a next cylindrically shaped plane $P_{i+1}$ such that the conductor wire may then continue, extending along the plane $P_{i+1}$ in the layer $L_{i+1}$, directly over other portions of conductor winding positioned in the plane $P_i$, i.e., in the underlying layer, $L_i$.

With reference to FIG. 7, the turns, $T_j$, of conductor 14 within each layer $L_i$ are each shown formed in a turn, $GT_j$, of the groove, G. With the possible exception of the Bridge Transition Groove Segments, $BL_iT_jT_{j+1}TGS$, the majority, or the entirety, of each groove turn $GT_j$, in which conductor is placed, substantially conforms to a path which complies with the same cos(mθ) function required for conductor 14 placed therein to generate a current density distribution which substantially conforms to a cos(mθ) function. Summarily, for each layer $L_i$ formed in the groove, the conductor winding comprises a series of turns $T_j$, wherein the majority or the entirety of each conductor turn conforms to a path within a groove turn which constrains the conductor 14 to generate a current density distribution substantially in accord with a pre-defined cos(mθ) function.

In the saddle coil magnet of FIG. 3, a series of helical wire turns, $T_j$, each extend along the groove to form a spiral conductor winding in a layer, $L_i$, at a distance $R_i$ from the axis, X. A first segment $W_1$ of the conductor extends in and along the groove to form the first layer, $L_1$, comprising a series of helical conductor turns $T_j$ at a distance $R_1$ from the axis, X. In a similar manner, a second segment $W_2$ the conductor extends over the first segment $W_1$, in and along the groove to form the second layer, $L_2$, of helical turns at a distance $R_2$ from the axis, X. A third segment $W_3$ of the conductor extends over the first and second segments $W_1$, and $W_2$ in and along the groove to form the third layer, $L_3$, of helical turns at a distance $R_3$ from the axis, X. A fourth wire segment $W_4$ of the conductor extends over the first, second and third segments $W_1$, $W_2$ and $W_3$ in and along the groove to form the fourth layer, $L_4$, of helical turns at a distance $R_4$ from the axis, X. Except for the relatively small portion of one turn in each of the layers which comprises an InterLayer Transition Conductor Segment $IL_iL_{i+1}TCS_j$, the majority of the conductor in each layer is in a cylindrical plane and distanced from the axis, X, such that $R_1<R_2<R_3<R_4$.

A stack of helical wire turns, $T_j$, each associated with a different layer $L_i$, is positioned in a groove, G. See FIG. 3C which illustrates segments of the turns, $T_j$, which may be in spaced apart relation or may be in contact with adjacent wire turns $T_j$. For illustrated embodiments in which adjacent wire segments in a groove are in contact with one another, the wire segments are electrically insulated from one another.

Secure placement of helical wire turns, $T_j$, of different layers in a single groove, to create a stack of conductor segments $W_i$, e.g., segments of wire, may be difficult, especially when the conductor 14 is preformed (i.e., pre-manufactured) wire that must be securely placed in a series of groove turns. According to embodiments of the invention, the preformed wire is placed so that the majority of each turn substantially conforms to a cos(mθ) function and remains stable in accord with the function during operation of the saddle coil magnet.

A design and process which facilitate such placement are now described for embodiments in which the conductor segments, $W_i$, are extruded or drawn wire, but it is to be understood that other embodiments of the invention include conductor formed in a groove of a saddle coil magnet which is not extruded conductor and which may be formed in place.

sing wire, the groove, G, for containing a stack of helical conductor turns, $T_j$, can sequentially receive each conductor segment, $W_i$, to form the stack of turns, $T_j$ in the groove. The wire conductor segment, $W_i$, of each layer, $L_i$, is securely positioned to stay in the groove, e.g., without movement of the wire out of the groove during fabrication and without unacceptable movement of the conductor 14 during operation of the coil magnet. In the simplified view, shown in FIG. 8A, a groove, G, is machined in the surface 40 of a cylindrically shaped layer or sublayer 42 of insulative material centered about the axis X (shown in FIG. 3C). The insulative material may, for example, be an epoxy resin composite material, but the material may be ceramic or other insulative material.

The groove, G, is illustrated as having parallel walls 50, 52, rendering the general shape of the groove rectangular, but the actual shape of the groove will depending on the cutting process. Generally, a suitable grove extends from the surface 40 inward toward the axis, X, of the cylindrical planes $P_i$ (see FIG. 3C), but numerous features can be incorporated within the groove to accommodate different types of conductor 14 and to enhance stability or desired positioning of the conductor. In the example groove of FIG. 8A, the conductor segments $W_i$ of wire used to place helical turns $T_j$ of conductor 14 in the groove, G, may have a circular shape in cross section. That is, at any point along the length of the helical winding, when viewed in a plane transverse to the direction along which the conductor segments $W_i$ extend, the shape of the wire is circular, having a characteristic diameter, D.

In order for wire conductor segments, $W_i$, of each layer, $L_i$, to be securely positioned to stay in the groove, the groove, has a restricted opening 46 along the surface 40. For conductor segments having circular shape of a given diameter, D, the restricted opening 46 is somewhat smaller than the diameter D. For example, for a wire diameter of 0.8 mm, the width of the opening may be 0.74 mm.

Machining the grooves, G, that define the turn spacing for individual stacks of conductor segments can lead to very long machining times. In particular, for small-diameter conductors, multiple paths of the cutting tool are needed to machine the full depth of the support groove. Such lengthy machining process can lead to unacceptable manufacturing costs. However, for the groove design of FIG. 8A, having parallel walls 50, 52, the straight sections 54 (FIG. 6A) of the turns, $GT_j$, often being of large lengths, can be rapidly cut with saw blades instead of rotating router bits, thereby significantly reducing the machining time. To cut a 1-mm wide groove with a rotating router bit requires several machining paths and a slow tool advance (feed rate). However, due to the significantly greater robustness of a saw blade the full depth of the required groove can be cut in a single path and in a single pass with a much faster linear advance. With this approach, only the arc sections 55 of the turns, $GT_j$, (FIG. 6A) need to be machined with router bits.

Figure 8A:
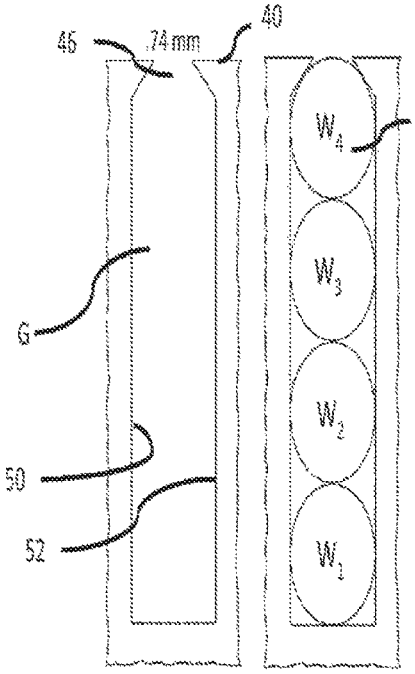
FIGS. 8A-8K are views in cross section illustrating a series of embodiments for design of a groove in which a conductor winding is placed.
Figure 8B:
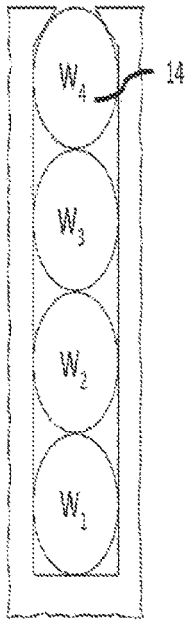

FIG. 8B illustrates the groove design of FIG. 8A with four conductor segments $W_i$ inserted therein. According to other embodiments, the shape of the conductor segments may vary and may, for example, be rectangular, elliptical or in the form of a ribbon.

Generally, when turns in each layer of the wire conductor segment are being inserted into the groove, individual portions of the wire turns, $T_j$, are pushed through the restricted groove opening 46 which is slightly smaller than the size of the wire. By sizing the width of the opening 46 slightly smaller in size than the wire diameter, secure placement of the wire in the groove can be achieved by continually and progressively pushing individual portions of each turn, $T_j$, into the groove to follow the helical winding path of each groove turn $GT_j$. With application of a modest force, the individual portions of each turn, $T_i$, are pushed against edges of the groove which border the restricted groove opening 46 along the surface 40. Application of the force temporarily expands or deforms the dimension of the opening 46, allowing the portions of each turn, $T_i$, to be pushed through the opening 46 in order to receive portions of the wire into the groove.

Once each portion of wire passes into the groove, the size of the adjoining groove opening reverts from the expanded dimension substantially back to the original dimension. That is, the reversion from the expanded dimension results in a restricted opening size suitable for containing the wire during and after completion of subsequent fabrication steps. The difference between the size of the opening 46 and the diameter of the wire may be on the order of seven to nine percent. With a circular shaped wire having a diameter in cross section of 0.8 mm, the opening may be in the range of 0.735 to 0.745 mm, e.g., 0.74 mm or 92.5 percent of the wire diameter. More generally, the difference between the size of the opening $46_i$ and the wire diameter may be in the range of 85 percent to 95 percent of the wire diameter. Larger ranges may be suitable depending on the material properties of the insulator machined to form the groove. For conductor having, in cross section, a variable thickness dimension, the difference between the size of the opening 46 and the smallest dimension of the wire may be on the order of seven to nine percent.

Figures 8C, 8D:
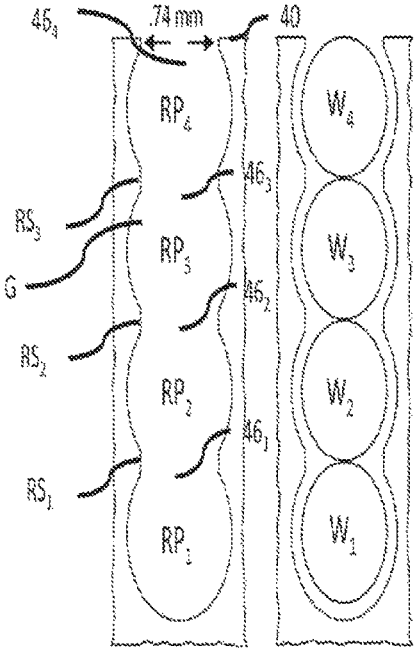

The design of the groove, G, can vary and may be specific to the size or shape of the wire being inserted as well as whether the wire is insulated. If the wire is not insulated, the shape of the groove can be designed to provide electrical separation of adjacent turns $T_j$ stacked in the groove. FIG. 8C illustrates a groove as it may appear after being formed with a cutting tool, and FIG. 8D illustrates placement of conductor segments in repository positions, $RP_i$, of the groove to secure the conductor in place.

The groove designs can be created in several ways. According to one example method, a groove is initially formed with a first rotating cutting tool which provides the opening 46, having a first width, along the surface 40, while also forming interior surfaces, i.e., a major portion, of the groove with a substantially rectangular shape, also of the first width. To begin this formation of the groove, the first cutting tool may initially penetrate the surface 40 in a downward direction (i.e., toward the axis, X) perpendicular to the surface, thereby cutting into the cylindrically shaped layer of insulative material to a predetermined depth. The first cutting tool then progresses along the surface 40 to cut the groove, G, along the cylindrical planes $P_i$ and thereby extend the initially formed opening along a groove path to define the groove turns $GT_j$.

After the entire groove extends beneath the surface 40 with the same first width, a second rotating cutting tool, having a slightly larger blade diameter than that of the groove opening 46 of the first width, enters the already formed groove to redefine major portions of the groove to a second width without altering the opening 46. The opening 46 retains the first width dimension while major portions of the groove, are expanded so that distances between opposing walls of the groove correspond to a second width. This resizing of the major portions of the groove to widen the width of the groove can be effected with a side entry into portions of the groove.

This may be accomplished by initially penetrating the second cutting tool into the groove at one end of the groove. The penetration occurs at one position along the surface 40, in a downward direction (i.e., toward the axis, X) perpendicular to the surface 40 such that the blade of the second cutter is positioned below the opening 46 and inserted to a predetermined depth before redefining the width of the major portions of the groove.

After the blade of the second cutting tool enters the groove from one position along the surface 40 of the groove, the tool is then moved through the groove to remove additional insulative material from the inside of the groove without cutting into or otherwise affecting the size of the opening 46. Consequently, interior portions of the initially formed groove are enlarged while not enlarging the opening 46 relative to the first width. Thus the opening 46 remains as formed with the first cutting tool, while the interior of the groove is expanded to a second width larger than that of the first width, the second width being suitable for movement of the wire within the groove for purposes of placing and securing each coil turn $T_j$ within a corresponding groove turn $GT_j$.

Figures 8E, 8F:
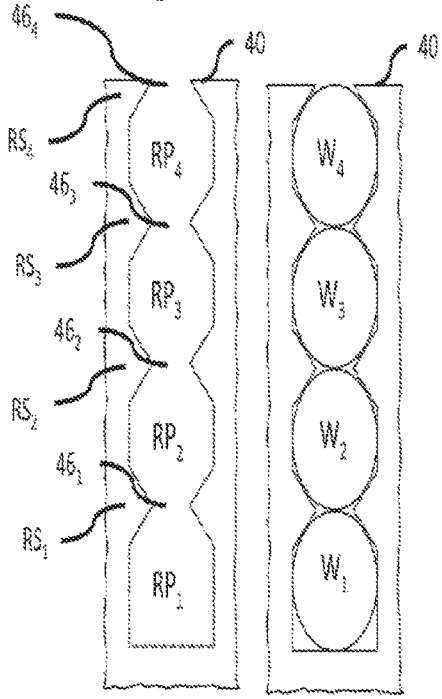

With a variant of this method, restrictive repository spacers $RS_i$ may be machined within the groove as shown in FIGS. 8C and 8E for controlling movement of, and securely positioning, each conductor segment $W_i$ in, each layer $L_i$ as shown in FIGS. 8D and 8F for four layers of conductor segments $W_i$ (for i=1 to 4). For example, instead of performing the step to widen the interior of the groove to a rectangular-like shape having a uniform second width, except, perhaps, at the bottom of the groove, a CNC machine can be programmed to pass a smaller cutting tool through the groove multiple times at a series of depth positions to define each in a series of variable width shaped repository positions. In this example variant of the method, the smaller cutting tool is patterned to yield a series of circular profiles as the variable width shaped positions when widening the groove. That is, with each pass of the smaller cutting tool through the groove, each pass being at a different groove depth relative to the surface 40, the depth of the smaller tool within in the groove defines a shaped wire repository position $RP_i$ at a different radial distance $R_i$ from the axis, X, to receive a corresponding wire conductor segment, $W_i$, for placement therein. Each repository position $RP_i$ occupies a position in a stacked sequence within the groove, G, such that the first and lower-most repository position $RP_1$ is a distance $R_1$ from the axis, X, the second repository position $RP_2$ in the sequence is a distance $R_2$ from the axis, X, the third repository position $RP_3$ in the sequence is a distance $R_3$ from the axis, X, and the fourth repository position $RP_4$ in the sequence is a distance $R_4$ from the axis, X. $R_1<R_2<R_3<R_4$.

As shown in FIG. 8B, with the groove containing four layers of winding turns, each wire conductor segment, $W_i$, can be locked into one in a stack of shaped repository positions, $RP_i$, of varying width formed within the groove, G. Each wire conductor segment, $W_i$, is positioned a desired distance $R_i$ from the axis, X. Each wire conductor segment, $W_i$, also follows along a path in the groove which conforms to a $\cos(m\theta)$ distribution, to yield a sufficiently pure multipole field. In an alternate embodiment, the cutting tool may be patterned to simultaneously cut all of the shaped positions in a single pass of the cutting tool through the groove.

With groove designs including shaped repository positions, $RP_i$, of varying width, as exemplified in the views of FIGS. 8C and 8E, each segment of wire $W_i$ can be securely locked in place to facilitate assembly of each layer $L_i$, and to further assure stability during operation of the saddle coil. See FIGS. 8D and 8F which each illustrate four layers of conductor segments $W_1$, $W_2$, $W_3$, $W_4$ positioned in the four repository positions $RP_i$ of the groove, G. To effect this arrangement, each repository position, $RP_i$ in the groove, G, is bounded by a repository opening $\mathbf{46}_i$ fashioned like the single restricted groove opening 46 shown in FIG. 8A. Each conductor segment $W_i$ enters the groove by being pushed through an uppermost opening (e.g., opening $\mathbf{46}_4$ shown in FIG. 8B) from along the surface 40. See, also, FIGS. 8G and 8H, further discussed herein, which illustrate a design where shapes of spaced apart repository openings facilitate secure positioning of insulated wire used to form the conductor segments $W_i$. Stabilization is further achieved by removal of gaseous pockets from the groove after the insertion of the conductor segments $W_i$. By way of example, removal of the pockets can be effected by vacuum impregnation with an epoxy resin that is part of a wet lay-up applied as an overlay. The magnet may be placed in a vacuum bag to facilitate movement of the resin to fill voids. The operation may be performed in an autoclave which elevates temperature and pressure to effect curing while the vacuum is sustained in the bag.

With further reference to the designs shown in FIG. 8, each repository opening $\mathbf{46}_i$ occupies a position along a different one of the repository positions, $RP_i$, in the stacked sequence of repository positions, such that a lower-most and first repository position opening $\mathbf{46}_1$ provides entry into the first repository position, $RP_1$, a second repository position opening $\mathbf{46}_2$ provides entry into the second repository position, $RP_2$, a third repository position opening $\mathbf{46}_3$ provides entry into the third repository position, $RP_3$, and a fourth and upper-most repository position opening $\mathbf{46}_4$ along the surface 40 provides entry into the upper-most and fourth repository position, $RP_4$.

Thus, like the four repository positions, $RP_i$, the four repository openings are in a stacked sequence such that during assembly the segment of wire $W_1$ is pushed through all four of the repository openings $\mathbf{46}_i$ and placed in the lower-most repository position, $RP_1$. Subsequently, the segment of wire $W_2$ is pushed through three of the repository openings $46_2$, $46_3$ and $46_4$ and is placed in the second repository position, $RP_2$; the segment of wire $W_3$ is pushed through two of the repository openings $46_3$ and $46_4$ and is placed in the third repository position, $RP_3$; and the segment of wire $W_4$ is pushed through the repository opening $46_4$ and placed in the fourth repository position, $RP_4$. See FIGS. 8D and 8F.

Each of the repository openings $46_i$ is defined by one of the restrictive repository spacers $RS_i$ that has been machined within the groove for controlling movement of each conductor segment $W_i$ and each segment of wire $W_i$ can be securely locked within a different $RP_3$ repository position. For superconducting coils, which require highest stability of the winding under Lorentz forces, the conductors can be bonded in the grooves. This can be achieved by a wet wound winding process and/or vacuum impregnation.

When the wire conductor segments, $W_i$, are each passed through one or more of the repository openings $46_i$, to reach a final repository placement position at a predetermined distance $R_i$ from the axis, X, each wire conductor segment, $W_i$, is pushed through a restricted opening as described for the opening 46 in FIG. 8A. That is, each repository opening $46_i$ is a restricted opening with respect to the diameter of the wire being inserted there through, being slightly smaller than the wire diameter. By sizing the width of each restricted repository opening $46_i$ slightly smaller in size than the wire diameter, the wire conductor segment can be passed through repository positions, to the extent necessary to reach the intended repository position for secure placement of each wire conductor segment, $W_i$, in a destined repository position, $RP_i$. This can be effected by continually and progressively pushing individual portions of each turn, $T_j$, of the conductor segment, $W_i$, into the groove to follow the helical winding path of each groove turn $GT_j$. As described for the opening 46 of FIG. 8A, with application of a modest force, the individual portions of each wire turn, $T_j$, are pushed against edges of the groove which border the restricted opening $46_i$ of each repository position $RP_i$. Application of the force temporarily expands or deforms the dimension of the opening $46_i$, allowing the portions of each turn, $T_j$, to be pushed through the opening $46_i$ in order to receive portions of the wire into the groove.

Once each portion of wire passes through a restricted repository opening $46_i$, and into a repository position, $RP_i$, the size of the adjoining restricted opening reverts from the expanded dimension substantially back to the original dimension. The difference between the size of the opening $46_i$ and the diameter of the wire may be on the order of seven to nine percent. For example, with a circular shaped wire having a diameter in cross section of 0.8 mm, the width of the opening may be in the range of 0.735 to 0.745 mm. More specifically, a wire diameter of 0.8 mm, the opening may be 0.74 mm or 92.5 percent of the wire diameter. Other larger or smaller proportions may be found suitable, with the difference between the size of the opening $46_i$ and the wire diameter being, for example, in the range of 85 percent to 95 percent of the wire diameter. Wider ranges may be suitable based on material properties of the insulator in which the groove is formed.

In one example illustration for assembling the saddle coil according to FIGS. 8C, 8D, 8E and 8F, the restricted repository openings $46_i$ are all the same size as the opening 46 illustrated in FIG. 8A, and the wire conductor segment, $W_1$, passes through all four openings $46_1$, $46_2$, $46_3$ and $46_4$ in order to occupy the lowest shaped position (i.e., the repository position, $RP_4$) as the lowest wire in the stack of helical windings to create the layer $L_1$. In contrast to this, after the wires $W_2$ and $W_3$ are placed in the groove in a similar manner to provide the next layers $L_2$ and $L_3$, the wire $W_4$ only passes through the upper most opening $46_1$ (along the surface 40).

Figures 8G, 8H:
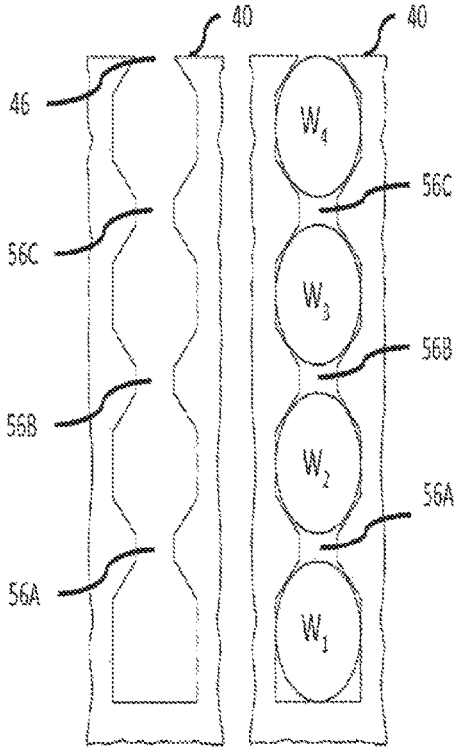

As shown in FIG. 8G, the groove design of FIGS. 8C and 8E may be further modified to accommodate cooling channels or to accommodate spaced-apart (e.g., uninsulated) wire conductor segments $W_i$. To this end, neck openings 56A through 56C are formed to provide a spacer function between adjacent wires, $W_i$. The neck openings extend in the radial direction, i.e., in directions parallel with lines extending from the axis, X, and through the groove, G. The neck openings 56A through 56C are deformable as in the example designs shown in FIGS. 8A through 8F for the openings 46 and $46_1$ through $46_4$, but for a given wire diameter the width of the neck openings may differ from that of the restricted repository openings $46_i$ of FIGS. 8C and 8E in order to provide ability of the material about the neck openings to undergo deformation to accommodate the wire diameter and then resiliently return to an original width.

For embodiments in accord with FIG. 8G, the wire of each conductor segment $W_i$ may be pushed through one or more of the neck openings and then be locked within a shaped position of varying width to form a layer $L_i$ which is spaced apart from each adjacent layer. See FIG. 8H. The spacing provided by each neck opening, in combination with the restricted opening size, relative to the wire diameter, assures separation between layers while also providing secure positioning of the layers under Lorentz forces. The spaces between layers $L_1$ may be used as cooling channels through which cooling liquid or gas may circulate to remove heat from the saddle coil.

Referring again to FIG. 8A, in a second example method applicable to forming the groove in any of the FIGS. 8A-8H, the design of the groove, G, can be created by first cutting the entire groove to a nominal second width required for the conductor placement, e.g., with the above-referenced second tool. At this stage, the groove opening 46 is not smaller than the width along interior portions of the groove. Next, the opening 46 and the adjoining surface 40 are covered with a thin overwrap layer of uncured epoxy resin impregnated glass tape. This overwrap does not have to cover the entire length of the groove, but can be limited to a few sections, mainly near bends or arcs in the path which the groove follows, as this is where the conductor may have a tendency to not stay well positioned in the groove during the winding process. After the epoxy resin of this overwrap has cured, the material can be cut on a CNC machine to re-create the groove opening with a small cutter or router bit, e.g., with the above-referenced first tool, the opening having the above-referenced first width for a restricted opening 46 while the interior of the groove continues to be of a second width, e.g., created with the above-referenced second cutting tool, so that the second width is larger than the first width.

FIGS. 4A through 4D are unrolled views of a fabrication sequence for constructing saddle coils according to the invention with four conductor segments, $W_i$, each configured as a layer, $L_i$, with i ranging from 1 through 4. As will be apparent from FIG. 4, with adjacent turns in different layers Li stacked, one over another, a transition section of winding wire and a crossing section of winding wire are each provided to initiate and continue placement of the winding wire of a subsequent layer over a winding wire of a previous layer so that each of the second, third and fourth segments of the continuous winding wire can be positioned over a prior placed segment of the continuous winding wire.

FIGS. 4A through 4D illustrate principles of a generic fabrication sequence applied to an exemplary one of multiple (e.g., four) saddle coils $SC_k$ formed about the axis, X. The exemplary saddle coil $SC_k$ is formed about a Cartesian (i.e., flat) plane of symmetry, PS, which passes through the axis, X. The generic fabrication sequence can be applied to form each of four saddle coil layers $L_i$ of conductor in one groove, G, in saddle coil windings such as shown in FIG. 3B. However, the sequence shown in the figures is illustrated for a simplified embodiment, in which each layer, $L_i$, is formed with a conductor segment, $W_i$, configured as a series of layers, $L_i$, each comprising only three helical turns, each being formed in or about a cylindrically shaped plane $P_i$ centered about the axis X. However, the principles can readily be applied the layers $L_i$ of the saddle coil shown in FIG. 3 as well as saddle coils comprising an arbitrary and large number layers (e.g., i>4) and turns (e.g., $T_j$>100) in each layer. In this example, the four layers of conductor are placed, one over another, in a groove, G, similar to the groove shown in FIG. 8A or FIG. 8C, as illustrated for one saddle coil winding of the quadrupole magnet shown in FIG. 3B.

Generally, for each layer of conductor segment $W_i$ in the saddle coil, a first length of the continuous winding wire is placed in the groove, G, to follow a helical (i.e., helical-like) path in or along one of multiple concentric cylindrically shaped planes in accord with a path defined by the groove. Reference in this description to positions, e.g., positions Q and V shown in FIG. 4C, is with regard to positions along the paths defined by a groove, G, irrespective of whether the position resides in a particular cylindrical plane $P_i$ or layer $L_i$ formed in the groove. In this sense, the term position is not limited to a single point, or a set of points in a single cylindrical plane, but can comprehend a series of points located at the same position along the trajectory of a path defined by the groove. Thus a series of points that lay one over another in different cylindrical planes centrally positioned about the axis, X may be referred to as being at the same position along the groove, G.

In this description and the accompanying figures, with each layer, $L_i$, comprising three turns $T_j$, (i.e., j=1, 2 or 3), turns of each layer are identified as $L_iT_j$. For example, the third turn of the second layer is designated $L_2T_3$.

Figure 6A:
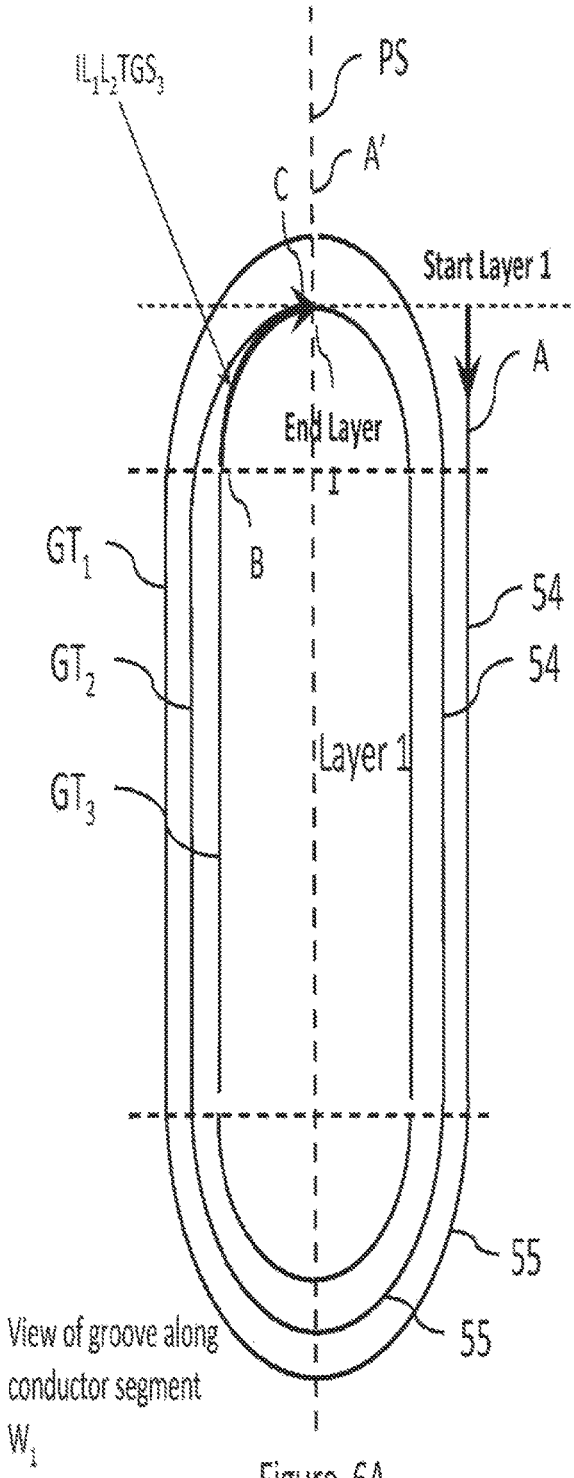
FIGS. 6A-6D are unrolled views of a groove formed in a layer of insulative material in the cylindrically shaped body, each view taken along the path of a conductor segment W1 in a different one of four winding turns, i.e., layers of conductor winding placed in the groove, illustrated in FIGS. 4 and 5.

With reference to FIGS. 4A, and 6A, for a lower-most and first layer $L_1$ of the conductor wire being positioned in the groove, placement starts at a position A and extends from the outside of the helical-like winding configuration (i.e., an outer-most turn in an outer region of the saddle coil) and winds inward in a spiral manner (e.g., in a clockwise direction) to complete three exemplary helical turns of the first layer $L_1$, e.g., $L_1T_1$, $L_1T_2$, $L_1T_3$.

In this illustration, the first turn $L_1T_1$ is referred to as a turn but is not a complete 360° turn because it begins at the position $A_1$ instead of a point A' in the Cartesian plane of symmetry, PS. The first and second helical turns $L_1T_1$, $L_1T_2$ and the majority of the third helical turn, $L_1T_3$, are positioned in the cylindrical plane $P_1$ about which the layer $L_1$ is primarily formed. Thus the majority of the layer $L_i$ is formed at a radial distance $R_1$ from the central axis, X. The third helical turn, $L_1T_3$, which is the inner-most turn of the first layer $L_1$, includes an InterLayer Transition Conductor Segment $IL_1L_2TCS_3$ (where $S_3$ designates that the segment is in the third turn of the layer $L_1$) that extends along the third turn from a position B and toward (e.g., up to) a position C. The segment $IL_1L_2TCS_3$ is indicated in the figures with a thickened line width relative to other portions of the third helical turn $L_1T_3$.

The unrolled view of FIG. 6A illustrates a view of the groove, G, along the path of the conductor segment $W_1$, starting at the position A and spiraling inward. The coil layer segment $W_1$ is inserted in three turns $GT_1$, $GT_2$ and $GT_3$ of the groove, G, primarily along the plane $P_1$. That is, for an embodiment of the groove according to FIGS. 8B and 8C, the view of FIG. 6A is taken through the repository position, $RP_1$, of the groove, and along the first and second groove turns $GT_1$, $GT_2$ as well as along the majority of the third groove turn, $GT_3$, i.e., in the cylindrical plane $P_1$ about which the layer $L_1$ is primarily formed.

Figure 9A:
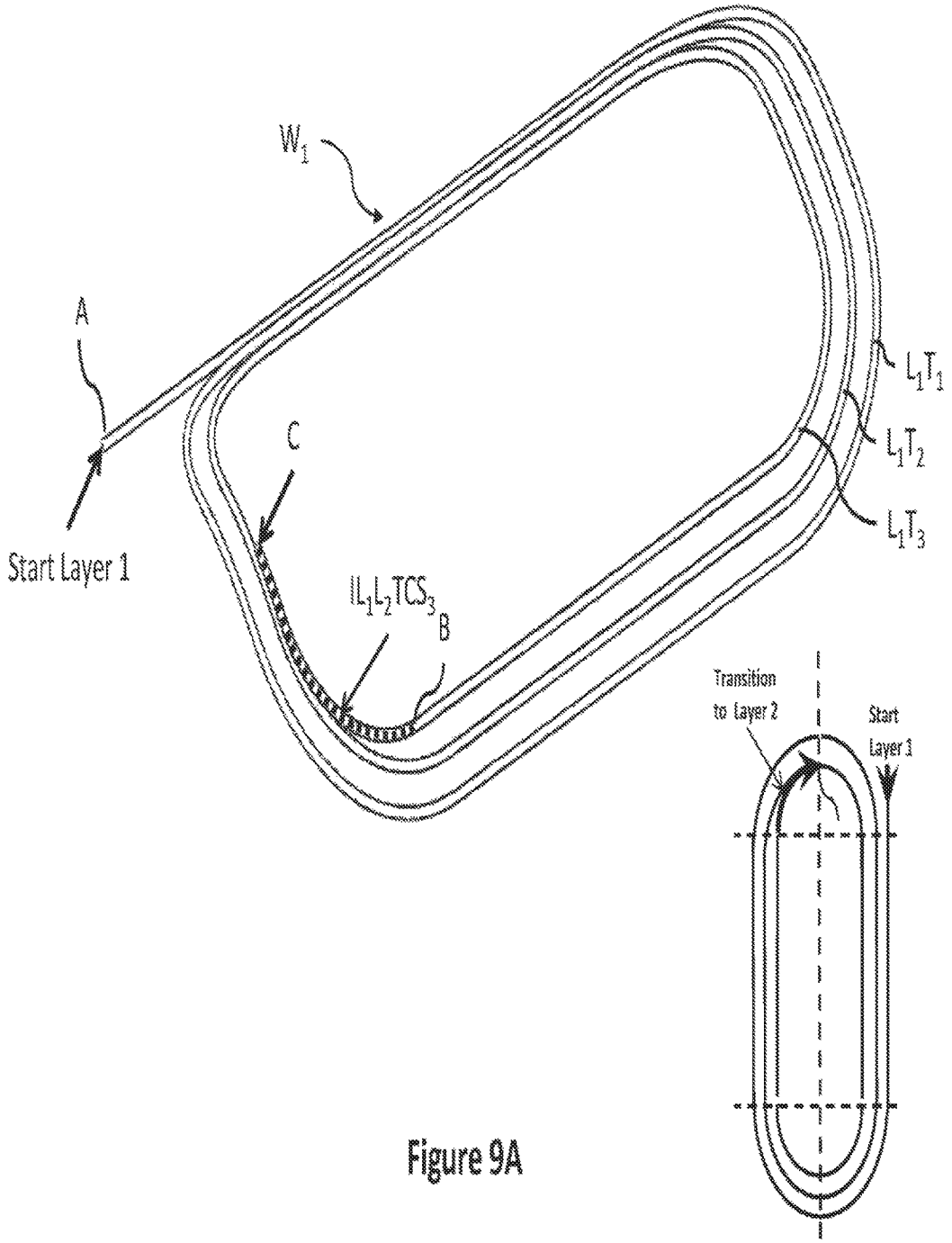
FIGS. 9A-9C are perspective views of conductor segment $W_1$ in a first layer of the saddle coil shown in FIG. 5.

FIG. 6A also illustrates a segment of the groove, $IL_1L_2TGS$, referred to as an interlayer transition groove segment, in the third groove turn, $GT_3$, that extends from the position B to the position C. The interlayer transition groove segment, $L_1L_2TGS$, is indicated in FIG. 6A with a thickened line width relative to other portions of the third groove turn $GT_3$. A feature of the interlayer transition groove segment, $L_1L_2TGS$, is that it defines the path along which the interlayer transition conductor segment $IL_1L_2TCS_3$ extends from within the plane $P_1$ and up to the plane $P_2$ as shown in FIG. 9.

Figure 9B:
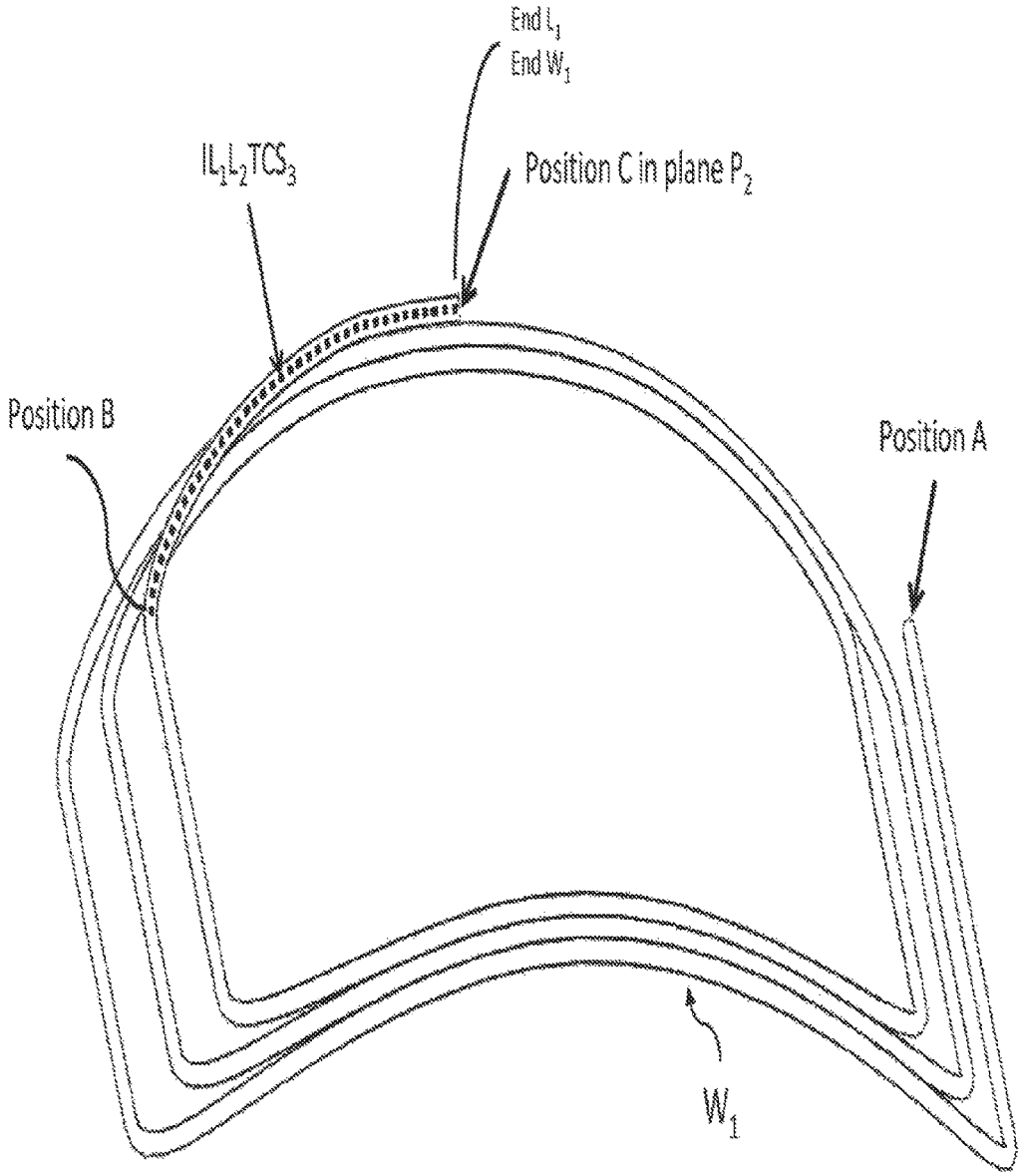
Figure 9C:
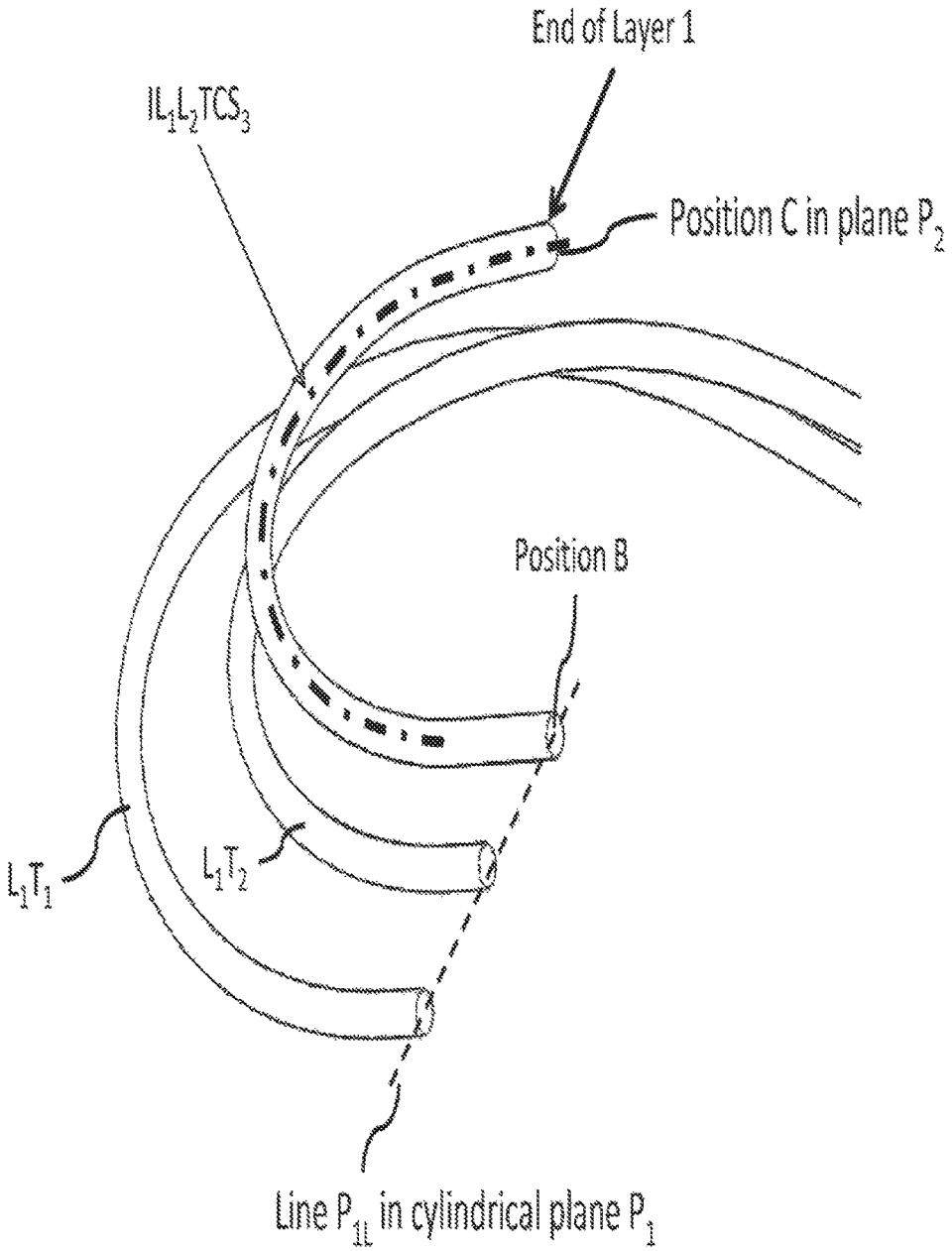

The Interlayer Transition Conductor Segment $IL_1L_2TCS_3$ extends out of the cylindrical plane $P_1$ and up to the cylindrical plane $P_2$ to transition the helical wiring path from the conductor segment $W_1$ along the layer $L_1$ in order to begin a first turn $L_2T_1$ of the conductor segment $W_2$ along the plane $P_2$ for the layer $L_2$. Transitions of the Interlayer Transition Conductor Segment $IL_1L_2TCS_3$ out of the plane $P_1$ and toward the plane $P_2$ are further shown in the full and partial perspective views of conductor segment $W_1$ of FIGS. 9A-9C. The perspective view of FIG. 9B illustrates the rise in the segment $IL_1L_2TCS_3$ from the position B in the plane $P_1$ and toward the position C which is in the plane $P_2$. The partial view of FIG. 9C illustrates the position C along a line $P_{1L}$ in the cylindrical plane $P_1$. Once the inner-most turn, e.g., $T_3$, of the layer $L_1$ is placed in the groove, and placement of the conductor segment $W_1$ of the continuous saddle coil winding wire ends, the first layer $L_1$ is complete.

Figure 6B:
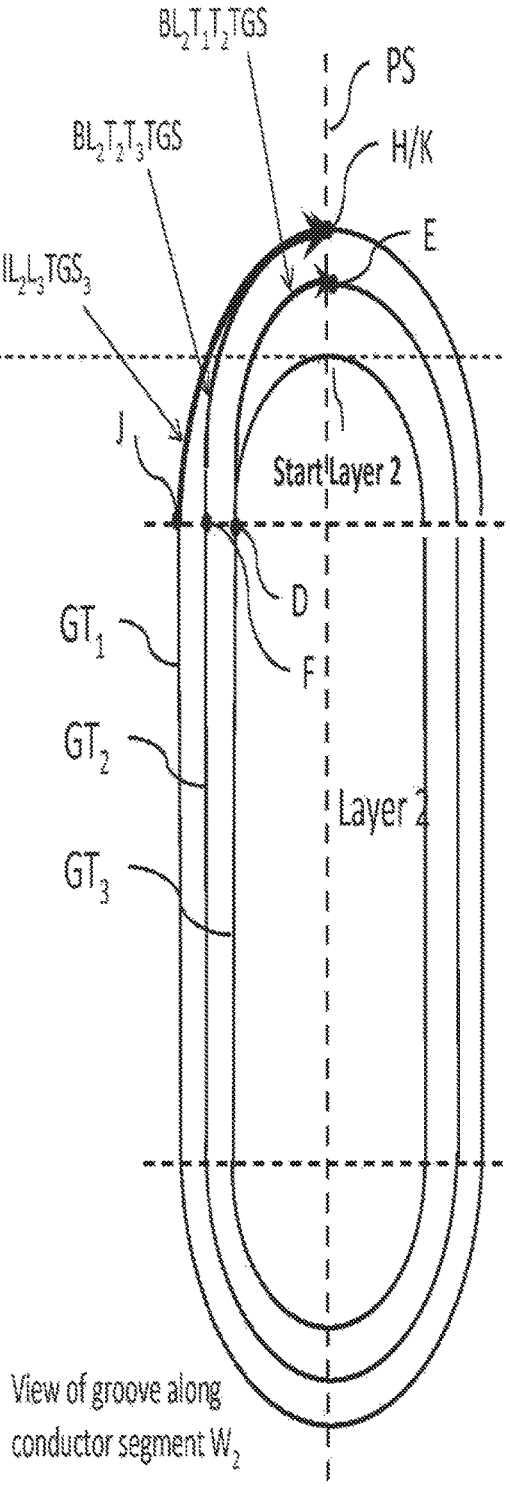

With reference to FIGS. 4B, and 6B, the winding process continues at the position C by placing the next portion in the continuous saddle coil winding, the conductor segment $W_2$ of the second helical layer $L_2$, in the same groove, G, and over the first wire segment $W_1$ of the first layer $L_1$. That is, placement of the segment $W_2$ of the second layer $L_2$ over the segment $W_1$ begins at position C and continues along a spiral path which winds outward from the inside of the helical-like winding configuration (e.g., continuing in a clockwise direction) to complete three exemplary helical turns of the second layer, e.g., $L_2T_1$, $L_2T_2$, $L_2T_3$. The first and second helical turns $L_2T_1$, $L_2T_2$ and the majority of the third helical turn, $L_2T_3$, are positioned in the cylindrical plane $P_2$ about which the layer $L_2$ is formed, i.e., a radial distance $R_2$ from the central axis, X.

In the second layer the first and second helical turns $L_2T_1$, $L_2T_2$ include a Bridge intraLayer Transition Conductor Segment $BL_2T_1T_2CS$ which follows a transition path defined by an intralayer bridge transition groove segment $BL_2T_1T_2TGS$ shown in FIG. 6B. The Bridge intraLayer Transition Conductor Segment $BL_2T_1T_2CS$ is indicated in the figures with a thickened line width relative to other portions of the first and second helical turns $L_2T_1$ and $L_2T_2$. The Bridge intraLayer Transition Conductor Segment $BL_2T_1T_2CS$ in the plane $P_2$ is also shown in the perspective views of FIGS. 10A-10C.

The Bridge Transition Groove Segment $BL_2T_1T_2TGS$ connects portions of the turns $L_2T_1$ and $L_2T_2$ in the groove, G, which each substantially conforms to a cos(mθ) function. Referring to FIG. 4B, the bridge transition groove segment $BL_2T_1T_2TGS$ extends between a point D of turn $L_2T_1$ (in plane $P_2$) in the groove, G, and a point E of the turn $L_2T_2$ (also in plane $P_2$) in the groove, G. This bridge transition groove segment $BL_2T_1T_2TGS$ is shown in FIG. 6B. The Bridge Intralayer Transition Conductor Segment $BL_2T_1T_2CS$ thus follows a path which departs from the path of the groove turn $GT_3$, which substantially conforms to a cos(mθ) function. That is, each of the groove turns GT1, GT2 and GT3 define a path which is consistent with a cos(mθ) function while the bridge transition groove segment $BL_2T_1T_2TGS$ departs therefrom in order to define a path for the Bridge intraLayer Transition Conductor Segment $BL_2T_1T_2CS$ which effects conductive connection between the two points D and E in the groove, G. The conductor segment $BL_2T_1T_2CS$ lies in the cylindrical plane P2 and is placed in intralayer bridge transition groove segment $BL_2T_1T_2TGS$.

Also in the second layer, the second and third helical turns $L_2T_2$, $L_2T_3$ include a Bridge intraLayer Transition Conductor Segment $BL_2T_2T_3CS$ which follows a transition path defined by an intralayer Bridge Transition Groove Segment $BL_2T_2T_3TGS$. The Bridge intraLayer Transition Conductor Segment $BL_2T_2T_3CS$ is indicated in the figures with a thickened line width relative to other portions of the first and second helical turns $L_2T_2$ and $L_2T_3$. The Bridge intraLayer Transition Conductor Segment $BL_2T_2T_3CS$ in the plane $P_2$ is also shown in the perspective views of FIGS. 10A-10C.

The Bridge Transition Groove Segment $BL_2T_2T_3TGS$ provides a path which connects portions of the turns $L_2T_2$ and $L_2T_3$ which substantially conform to a cos(mθ) function. The Bridge Transition Groove Segment $BL_2T_2T_3TGS$ extends between a point F of turn $L_2T_2$ (in plane $P_2$) in the groove, G, and a point H of the turn $L_2T_3$ (also in plane $P_2$) in the groove, G, departing from this cos(mθ) relationship to define a path for the Bridge intraLayer Transition Conductor Segment $BL_2T_2T_3CS$ which effects conductive connection between the two points F and H in the groove, G. The Bridge intraLayer Transition Conductor Segment $BL_2T_2T_3CS$ thus follows a path which departs from a path which substantially conforms to the cos(mθ) function to effect conductive connection between the two points F and H. The conductor segment $BL_2T_2T_3CS$ lies in the cylindrical plane P2 and is placed in intralayer Bridge Transition Groove Segment $BL_2T_2T_3TGS$. The Bridge Transition Groove Segment $BL_2T_2T_3TGS$ is shown in FIG. 6B.

Still referring to FIG. 4B, the third helical turn, $L_2T_3$, i.e., the outer-most turn of the second layer $L_2$, includes an Interlayer Transition Conductor Segment, $IL_2L_3TCS_3$, (where $S_3$ designates that the segment is in the third turn of the layer $L_2$) that extends between a position J and a position K. Note, while the position K appears coincident with the position H in FIG. 4B, the position K is in the plane $P_3$ while the position H is in the plane $P_2$. The Interlayer Transition Conductor segment, $IL_2L_3TCS_3$, is indicated in the figures with a thickened line width relative to other portions of the third helical turn $L_2T_3$. The InterLayer Transition Conductor Segment $IL_2L_3TCS_3$ extends out of the cylindrical plane $P_2$ and up to the cylindrical plane $P_3$ to transition the helical wiring path from the conductor segment $W_2$ along the layer $L_2$ in order to begin a first turn $L_3T_1$ of the conductor segment $W_3$ along the plane $P_3$ for the layer $L_3$. Transition of the segment $IL_2L_3TCS_3$ out of the plane $P_2$ and toward the plane $P_3$ is further shown in the perspective views of FIGS. 10A-10C. Once the outer-most turn, e.g., $T_3$, of the layer $L_2$ is placed in the groove, placement of the conductor segment $W_2$ of the continuous saddle coil winding wire extends up to the position K, rendering the second layer $L_2$ complete.

Figure 10A:
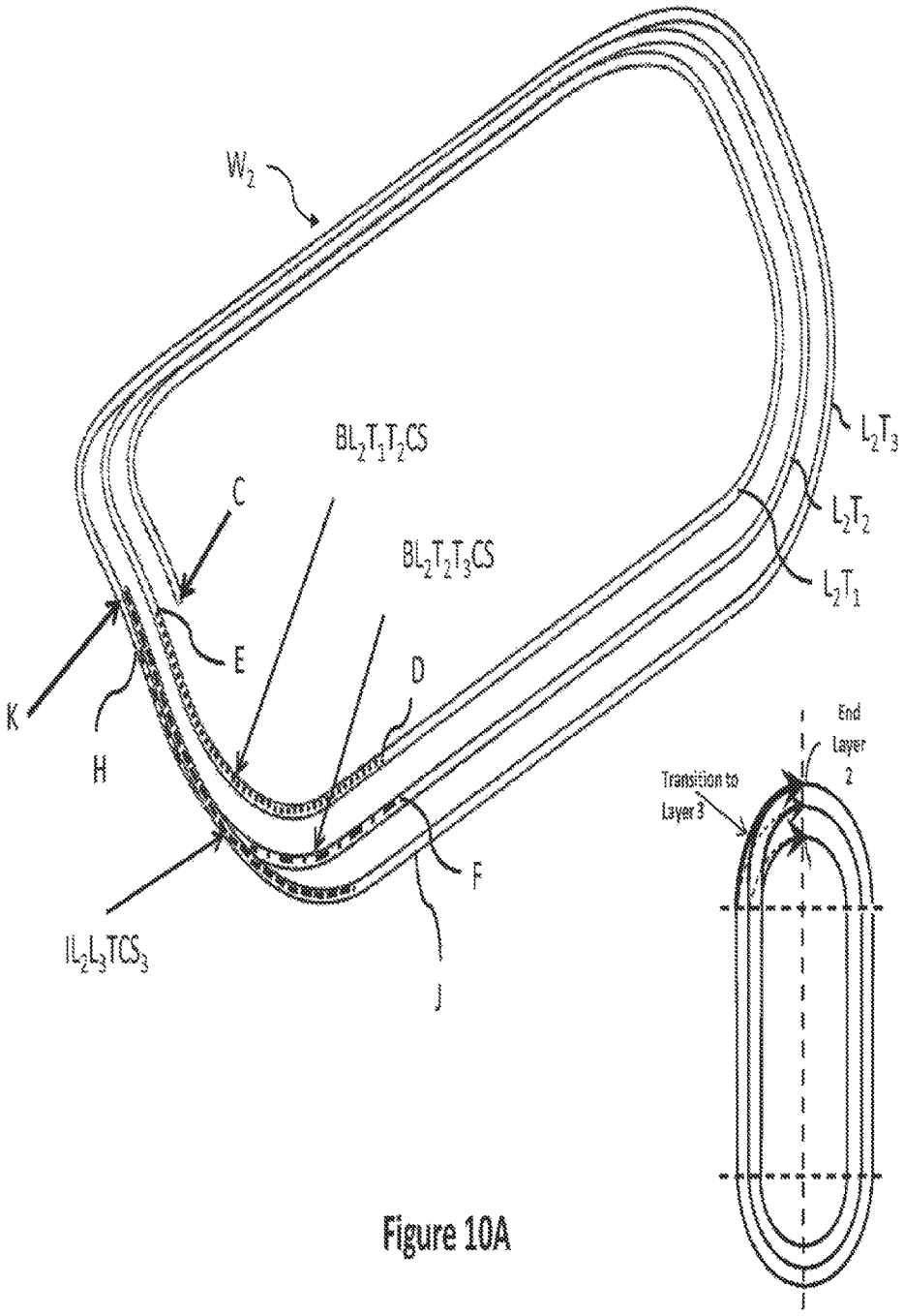
FIGS. 10A-10C are perspective views of conductor segment $W_2$ in a second layer of the saddle coil shown in FIG. 5.
Figure 10B:
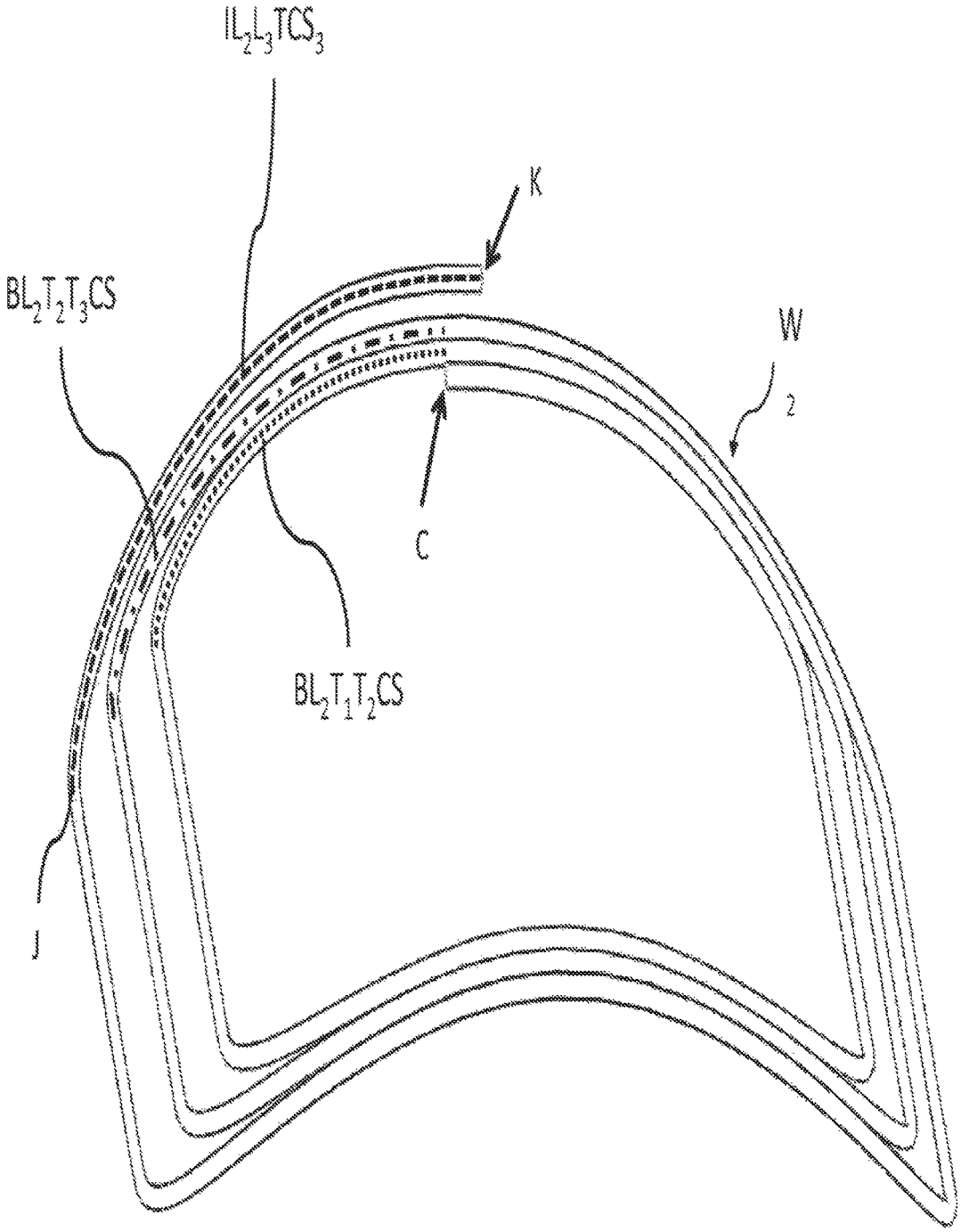
Figure 10C:
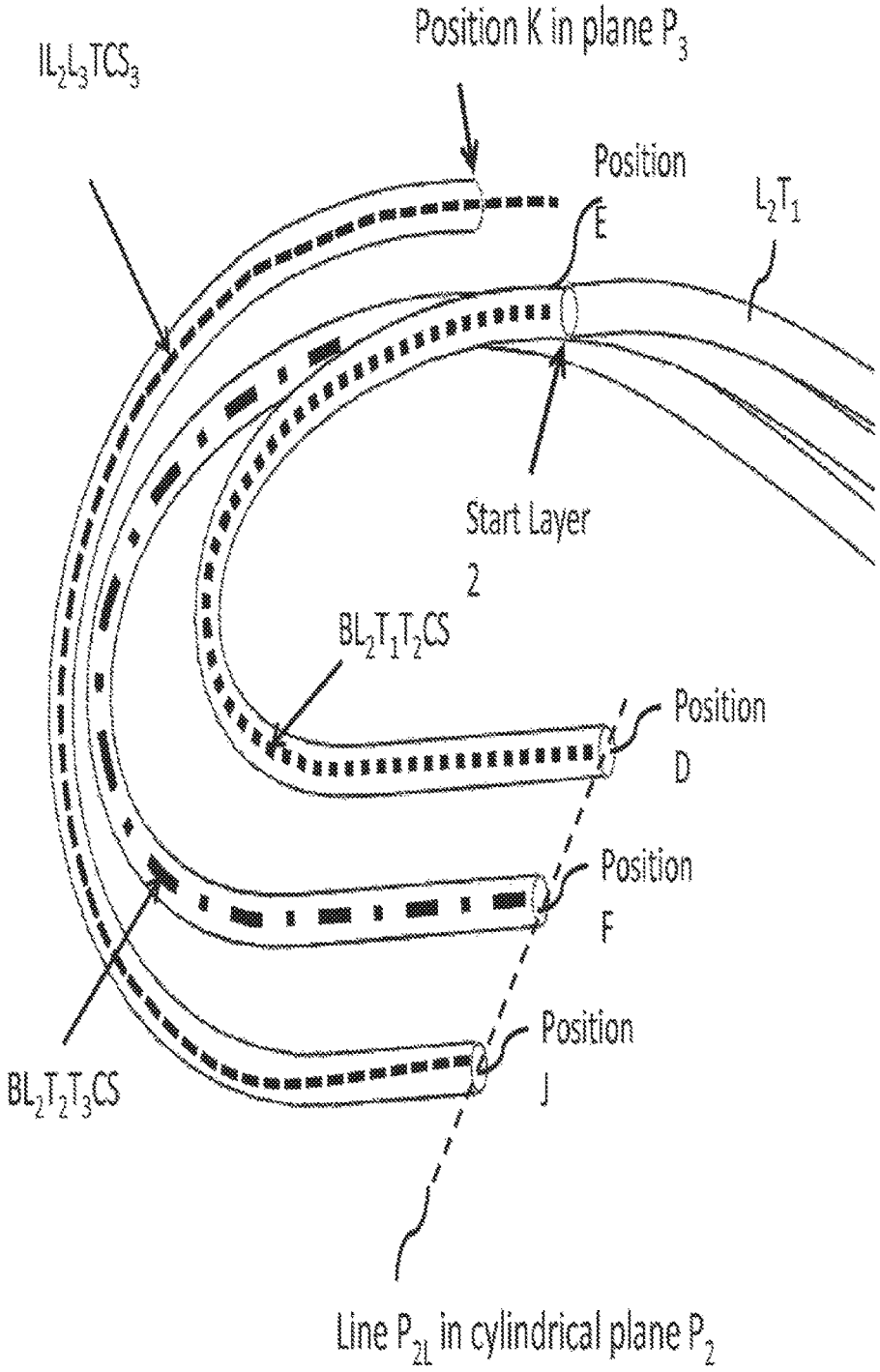

The perspective views of FIGS. 10A and 10B also illustrate the Bridge intraLayer Transition Conductor Segments $BL_2T_1T_2CS$ and $BL_2T_2T_3CS$. The partial perspective view of FIG. 10C illustrates the Bridge intraLayer segments $BL_2T_1T_2CS$ and $BL_2T_2T_3CS$ and the InterLayer Transition Conductor Segment $IL_2L_3TCS_3$ in relation to one another. FIG. 10C also illustrates the positions D, F and J on the same line $P_{2L}$ in the cylindrical plane P2 as well as position K in the cylindrical plane $P_3$.

Figure 6C:
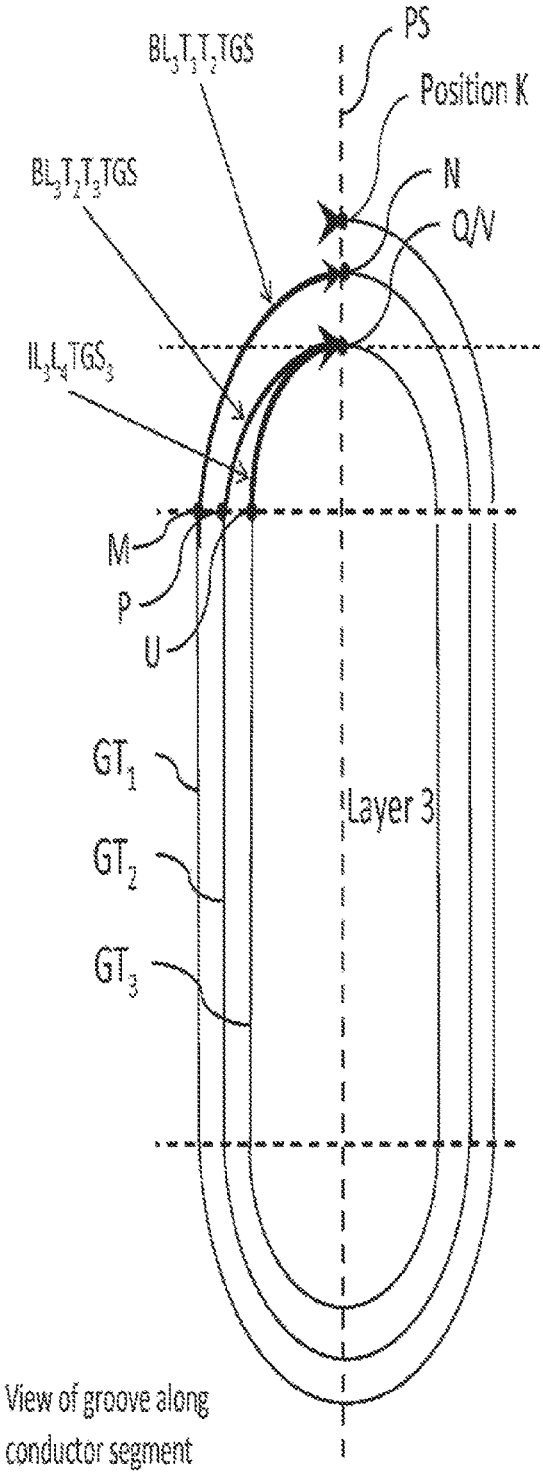

With reference to FIGS. 4C and 6C, the winding process continues through the position K by placing the next portion in the continuous saddle coil winding, which is the conductor segment $W_3$ of the third helical layer $L_3$, in the same groove, G, and over the second wire segment $W_2$ of the second layer $L_2$. Placement of the segment $W_3$ of the third layer $L_3$ over the segment $W_2$ begins at position K and continues along a spiral path which winds inward from the outside of the helical-like winding configuration (e.g., continuing in a clockwise direction) to complete three exemplary helical turns of the third layer: $L_3T_1$, $L_3T_2$, $L_3T_3$. The first and second helical turns $L_3T_1$, $L_3T_2$ and the majority of the third helical turn, $L_3T_3$, are positioned in the cylindrical plane $P_3$ about which the layer $L_3$ is primarily formed, i.e., a radial distance $R_3$ from the central axis, X.

In the third layer, $L_3$, the first and second helical turns $L_3T_1$, $L_3T_2$ include a first Bridge intraLayer Transition Conductor Segment $BL_3T_1T_2CS$ which follows a transition path defined by an intralayer Bridge Transition Groove Segment $BL_3T_1T_2TGS$ shown in FIG. 6C. The Bridge intraLayer Transition Conductor Segment $BL_3T_1T_2CS$ is indicated in the figures with a thickened line width relative to other portions of the first and second helical turns $L_3T_1$ and $L_3T_2$. The Bridge intraLayer Transition Conductor Segment $BL_3T_1T_2CS$, positioned in the plane $P_3$, is also shown in the perspective views of FIGS. 11A-11C.

The Bridge Transition Groove Segment, $BL_3T_1T_2TGS$, provides a path which connects portions of the turns $L_3T_1$ and $L_3T_2$ in the groove, G. The turns $L_3T_1$ and $L_3T_2$ each follow a path that substantially conforms to a cos(mθ) function. Referring to FIG. 4C, the Bridge Transition Groove Segment, $BL_3T_1T_2TGS$, extends between a point M of turn $L_3T_1$ (in plane $P_3$) in the groove, G, and a point N of the turn $L_3T_2$ (also in plane $P_3$) in the groove, G. This Bridge Transition Groove Segment, $BL_3T_1T_2TGS$, is shown in FIG. 6B. The Bridge intraLayer Transition Conductor Segment $BL_3T_1T_2CS$ thus follows a path which departs from the path of the groove turn $GT_1$, which substantially conforms to a cos(mθ) function. That is, the bridge transition groove segment defines a path for the Bridge intraLayer Transition Conductor Segment $BL_3T_1T_2CS$ which departs from the cos(mθ) relationship to effect conductive connection between the two points M and N in the groove, G. The Bridge intraLayer Transition Conductor Segment $BL_3T_1T_2CS$ lies in the cylindrical plane $P_3$ and is placed in the intralayer Bridge Transition Groove Segment $BL_3T_1T_2TGS$ shown in FIG. 6C.

Also in the third layer, the second and third helical turns $L_3T_2$, $L_3T_3$ include a Bridge intraLayer Transition Conductor Segment $BL_3T_2T_3CS$ which follows a transition path defined by an intralayer Bridge Transition Groove Segment $BL_3T_2T_3TGS$. The Bridge intraLayer Transition Conductor Segment $BL_3T_2T_3CS$ is indicated in FIG. 4C with a thickened line width relative to other portions of the second and third helical turns $L_3T_2$ and $L_3T_3$. The Bridge intraLayer Transition Conductor Segment $BL_3T_2T_3CS$, positioned in the plane $P_3$, is also shown in the perspective views of FIGS. 11A-11C.

The Bridge Transition Groove Segment $BL_3T_2T_3TGS$ connects portions of the turns $L_3T_2$ and $L_2T_3$ which substantially conform to a cos(mθ) function. The Bridge Transition Groove Segment $BL_3T_2T_3TGS$ extends between a point P of turn $L_3T_2$ (in plane $P_3$) in the groove, G, and a point Q of the turn $L_3T_3$ (also in plane $P_3$) in the groove, G, departing from this cos(mθ) relationship to define a path for the Bridge intraLayer Transition Conductor Segment $BL_3T_2T_3CS$ which effects conductive connection between the two points P and Q in the groove, G. The Bridge intraLayer Transition Conductor Segment $BL_3T_2T_3CS$ thus follows a path which departs from a path which substantially conforms to the cos(mθ) function to effect the conductive connection between the points P and Q. The conductor segment $BL_3T_2T_3CS$ lies in the cylindrical plane $P_3$ and is placed in intralayer Bridge Transition Groove Segment $BL_3T_2T_3TGS$.

The third helical turn, $L_2T_3$, which is the inner-most turn of the third layer $L_3$, includes a Bridge intraLayer Transition Conductor Segment $BL_3L_4TCS_3$ (where $S_3$ designates that the segment is in the third turn of the layer $L_3$) that extends between a position U in the plane $P_3$ and a position V in the plane $P_4$. Although the positions V and Q appear coincident in FIG. 8C, the positions are in different planes. The Bridge intraLayer Transition Conductor Segment $BL_3L_4TCS_3$ is indicated in the figures with a thickened line width relative to other portions of the third helical turn $L_3T_3$. The InterLayer Transition Conductor Segment $IL_3L_4TCS_3$ extends out of the cylindrical plane $P_3$ and up to the cylindrical plane $P_4$ to transition the helical wiring path from the conductor segment $W_3$ along the layer $L_3$ in order to begin a first turn $L_4T_1$ of the conductor segment $W_4$ along the plane $P_4$ for the layer $L_4$. Transition of the InterLayer Transition Conductor Segment $IL_3L_4TCS_3$ out of the plane $P_3$ and toward the plane $P_4$ is further shown in the perspective views of FIGS. 11A-11C. Once the inner-most turn, e.g., $T_3$, of the layer $L_3$ is placed in the groove, placement of the conductor segment $W_3$ of the continuous saddle coil winding wire extends up to the position V, rendering the third layer $L_3$ complete.

Figure 11A:
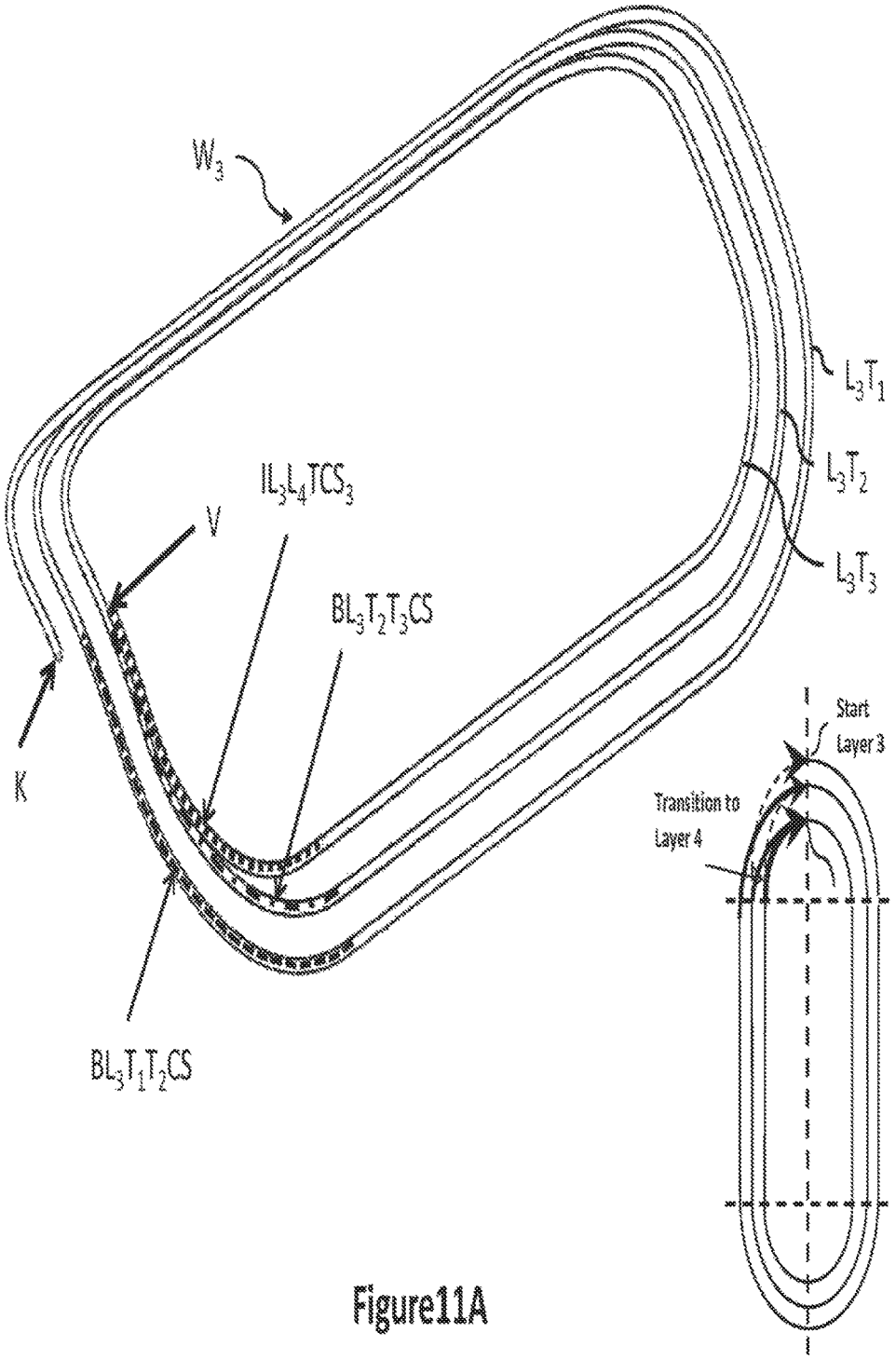
FIGS. 11A-11C are perspective views of conductor segment $W_3$ in a second layer of the saddle coil shown in FIG. 5.
Figure 11B:
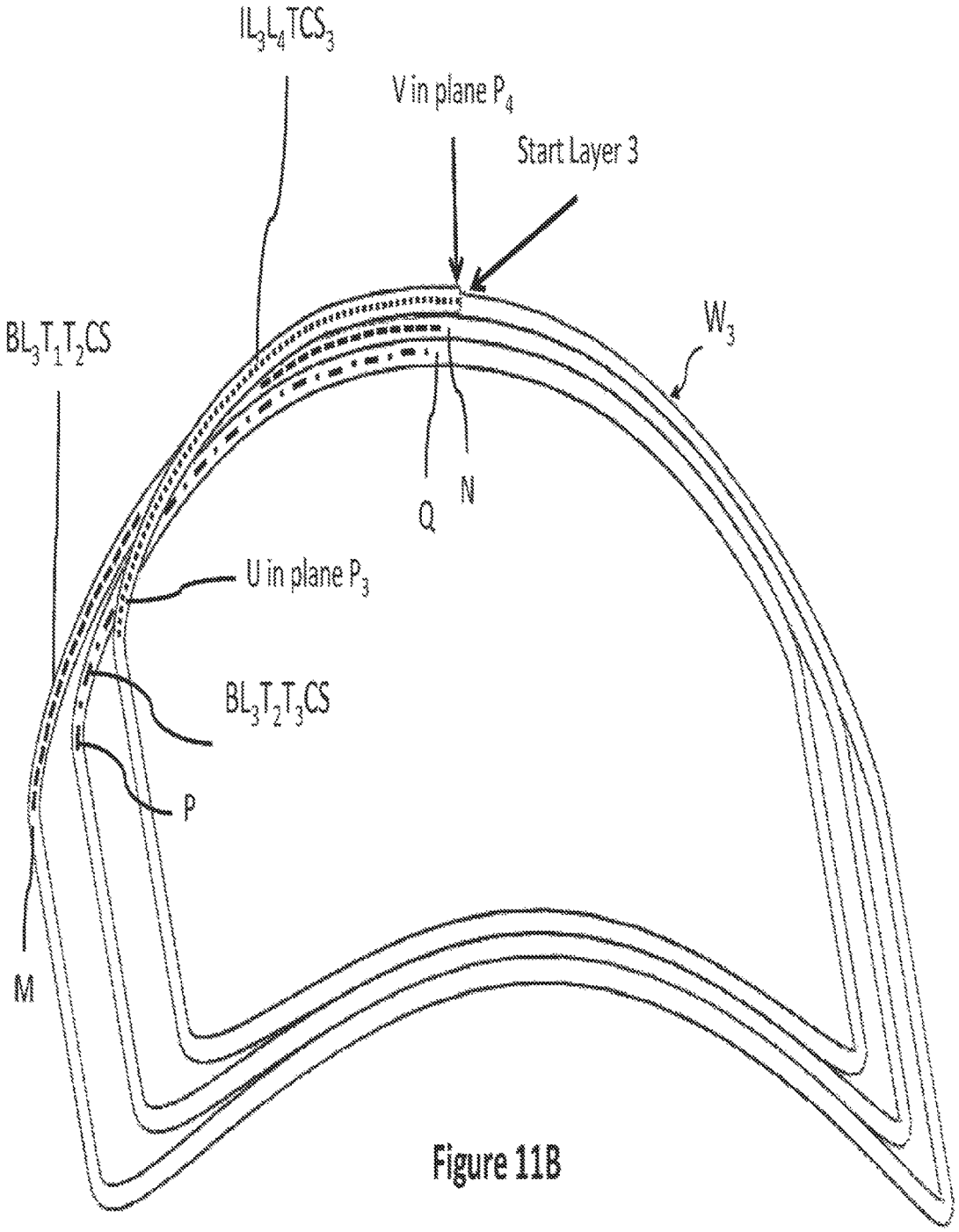
Figure 11C:
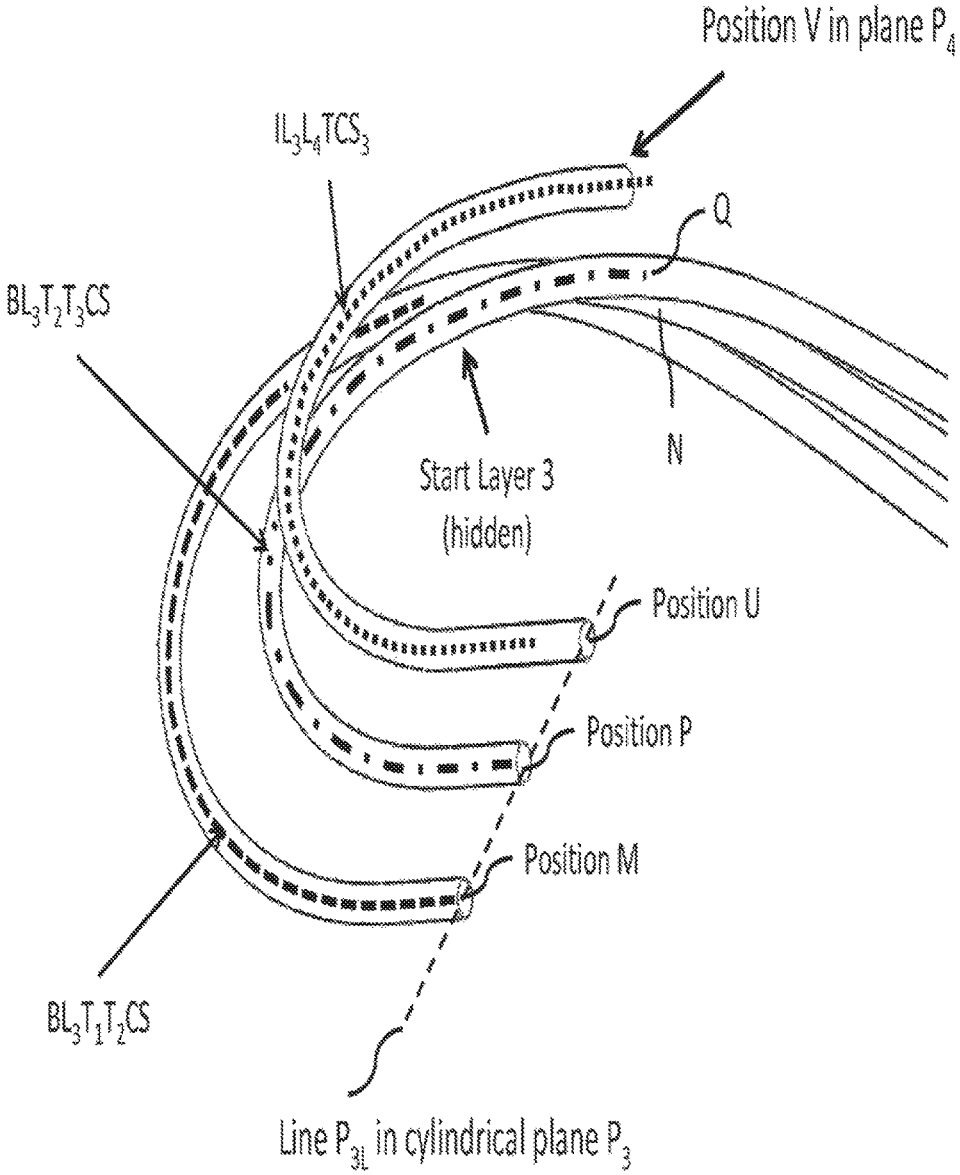

The perspective views of FIGS. 11A and 11B also illustrate the Bridge intraLayer Transition Conductor Segments $BL_3T_1T_2CS$ and $BL_3T_2T_3CS$. The partial perspective view of FIG. 10C illustrates the Bridge intraLayer Transition Conductor Segments $BL_3T_1T_2CS$ and $BL_3T_2T_3CS$ and the InterLayer Transition Conductor Segment, $IL_3L_4TCS_3$, in relation to one another. FIG. 10C also illustrates the positions M, P and U on the same line $P_{3L}$ in the cylindrical plane $P_3$ as well as position V in the cylindrical plane $P_4$.

Figure 6D:
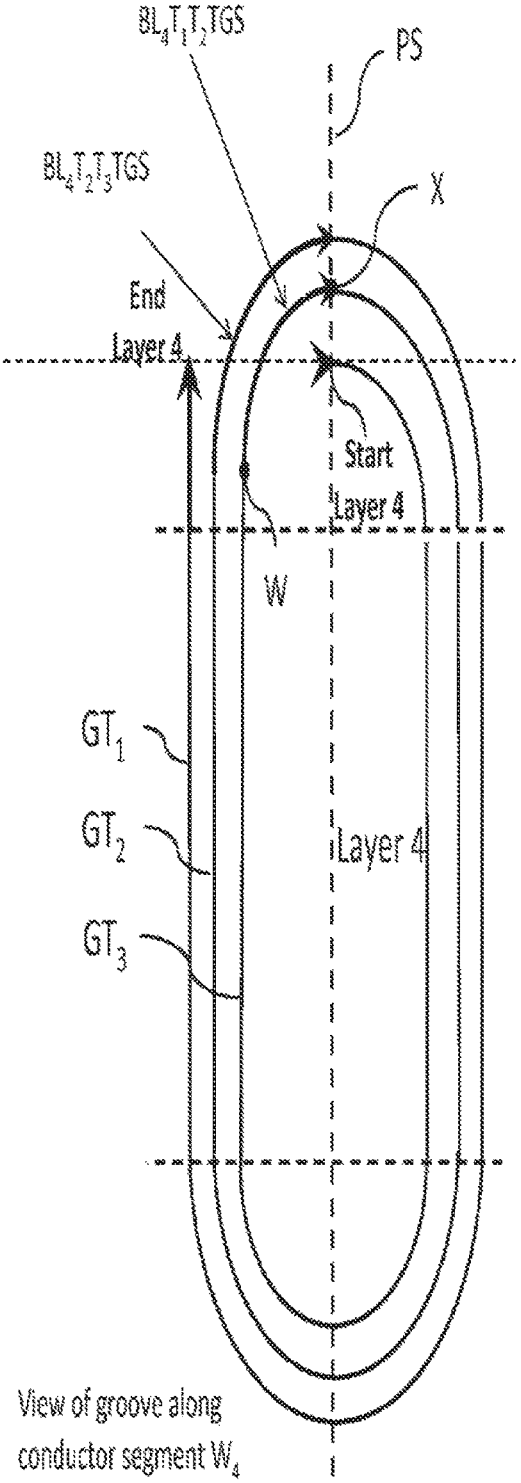
Figure 7A:
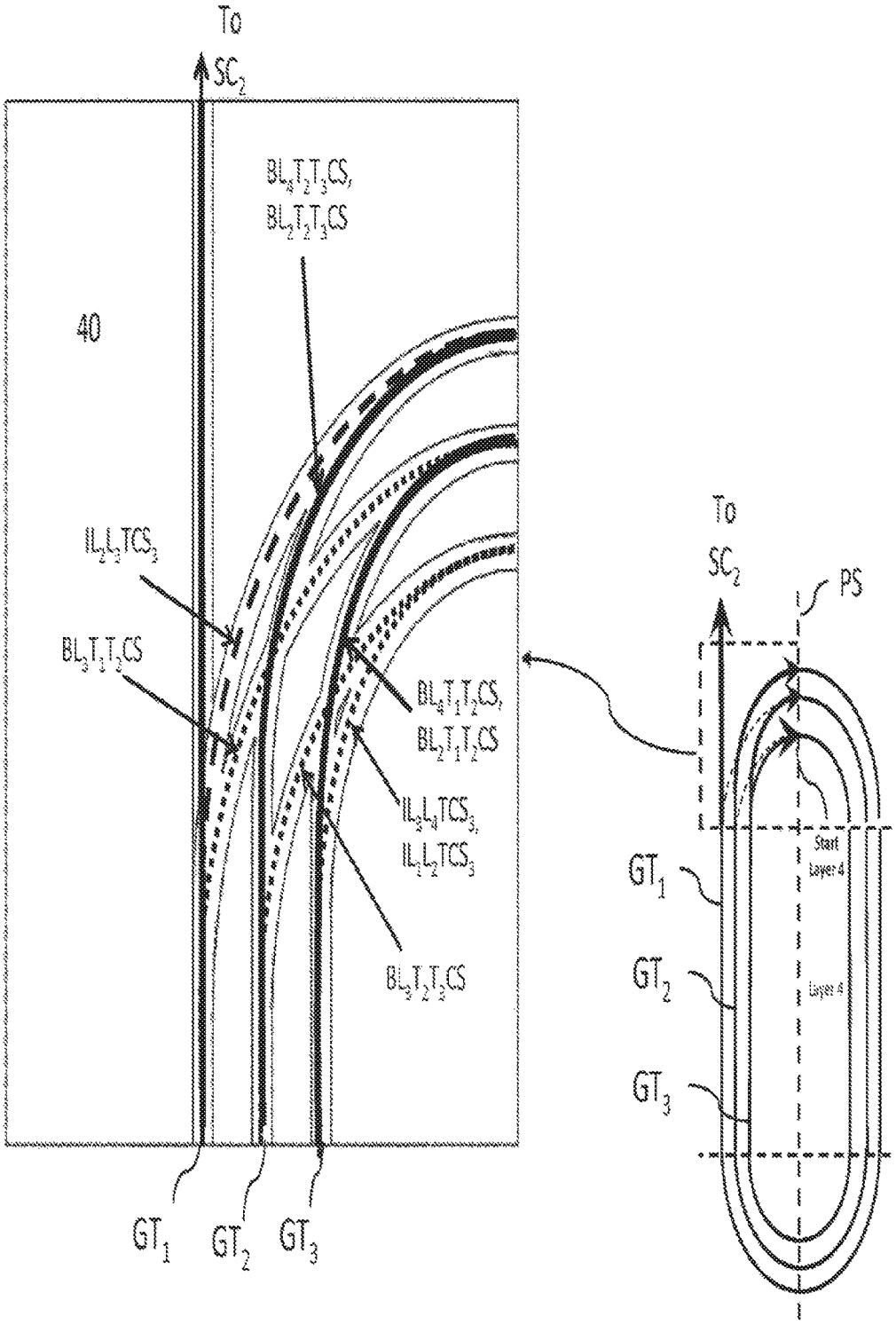
FIGS. 7A-7H area series of partial plan views and partial cut-away perspective views of the cylindrically shaped insulative body shown in FIG. 2, illustrating portions of the groove in which the winding turns shown in FIGS. 4, 5 and 6 are placed.
Figure 7B:
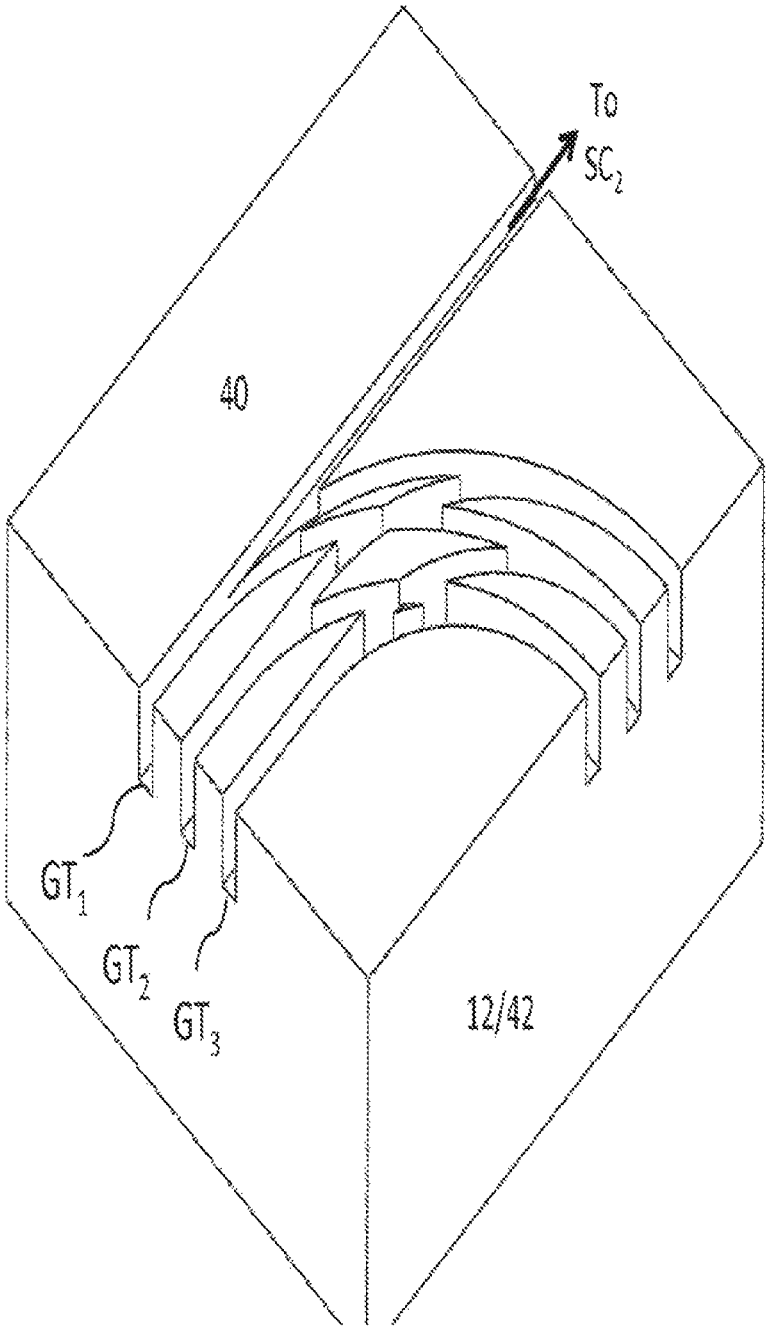
Figure 7C:
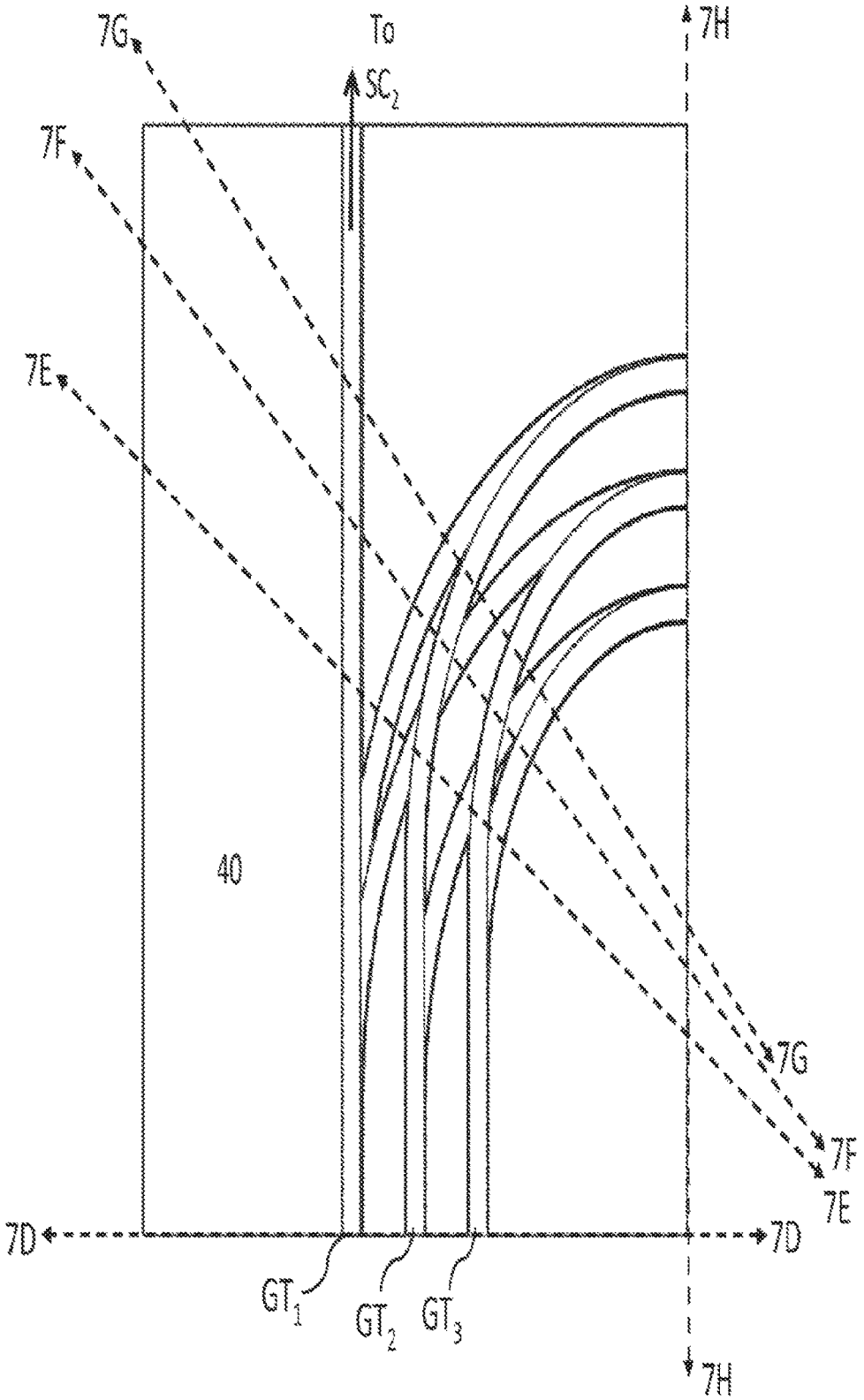
Figure 7D:
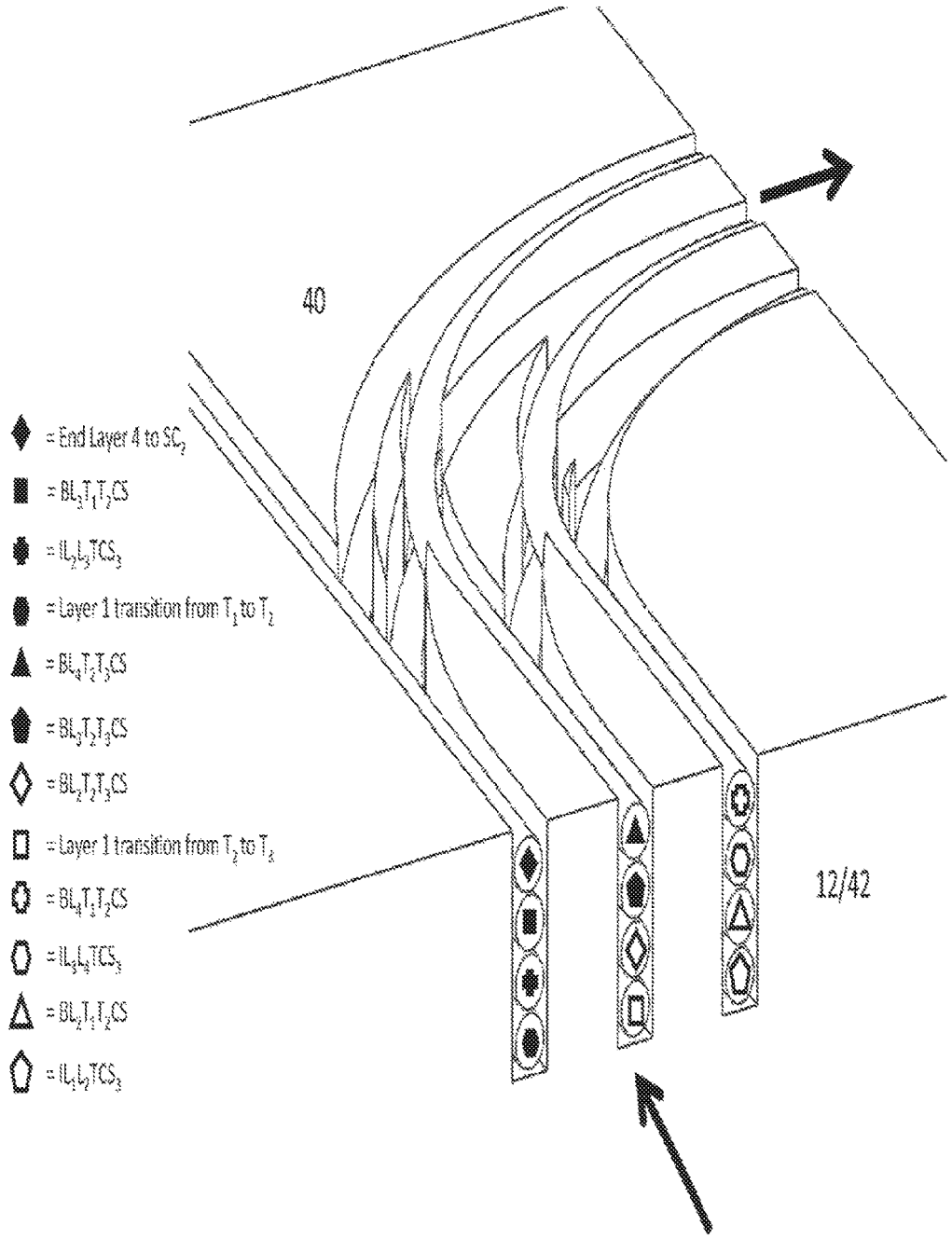
Figure 7E:
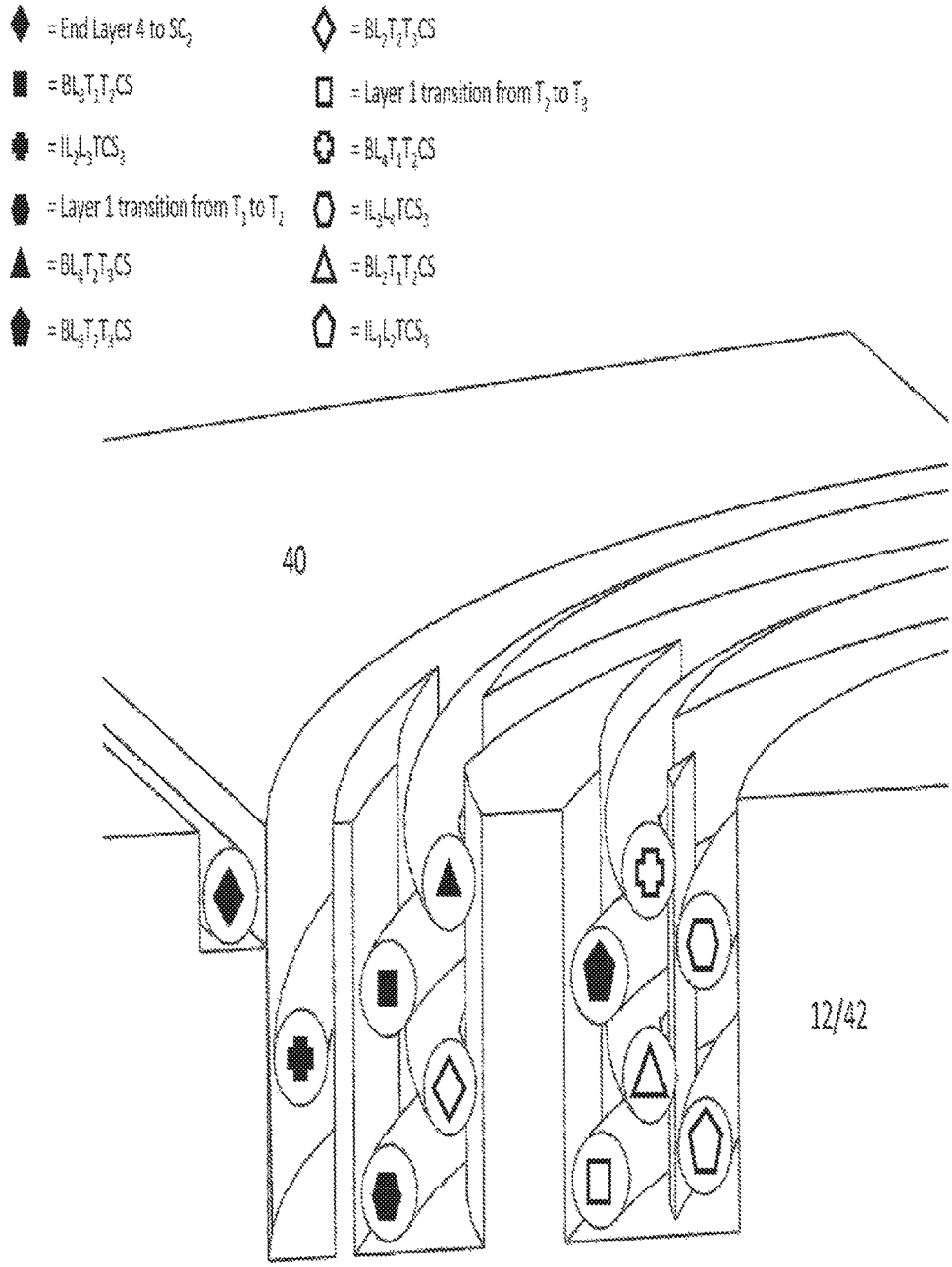
Figure 7F:
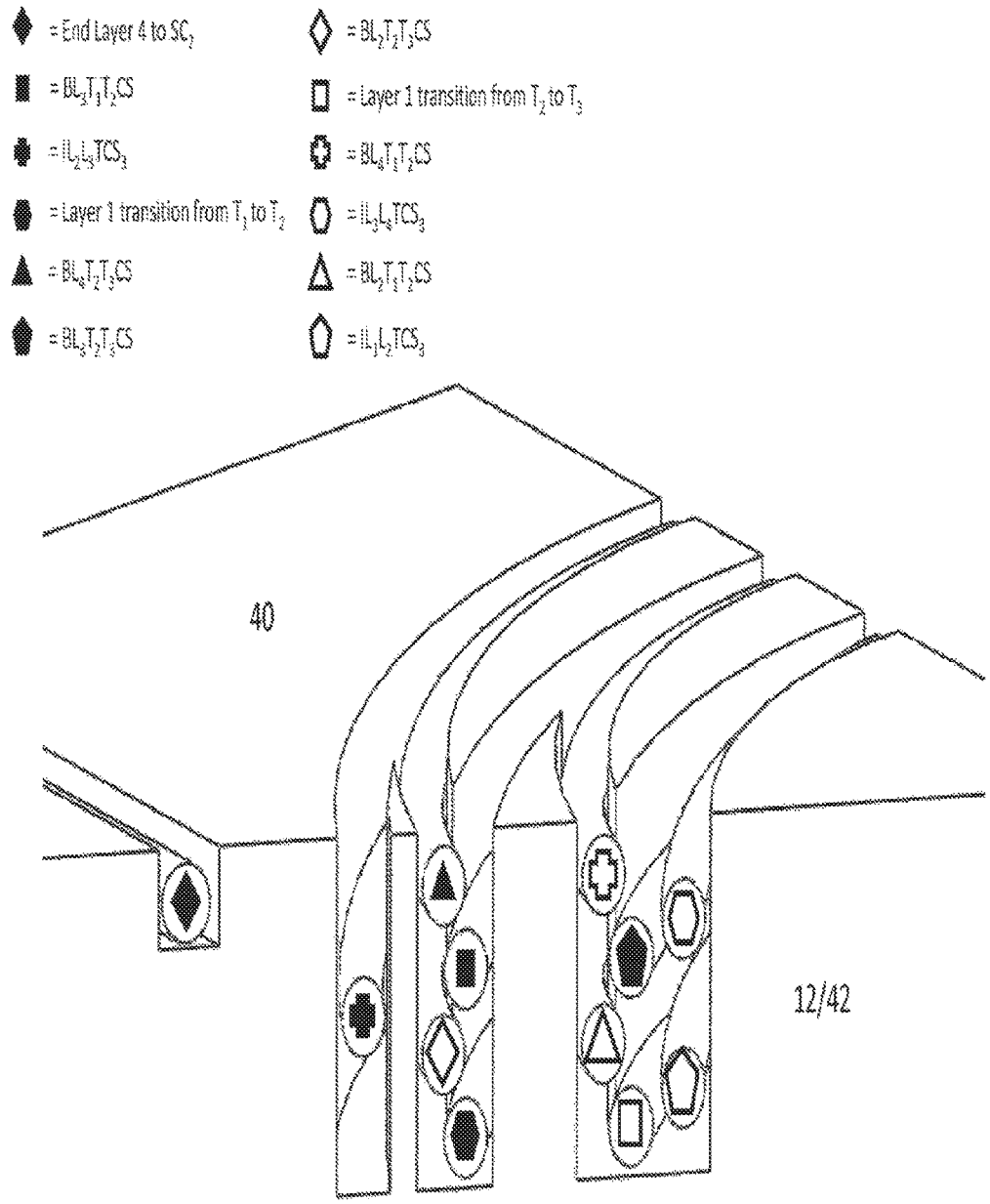
Figure 7G:
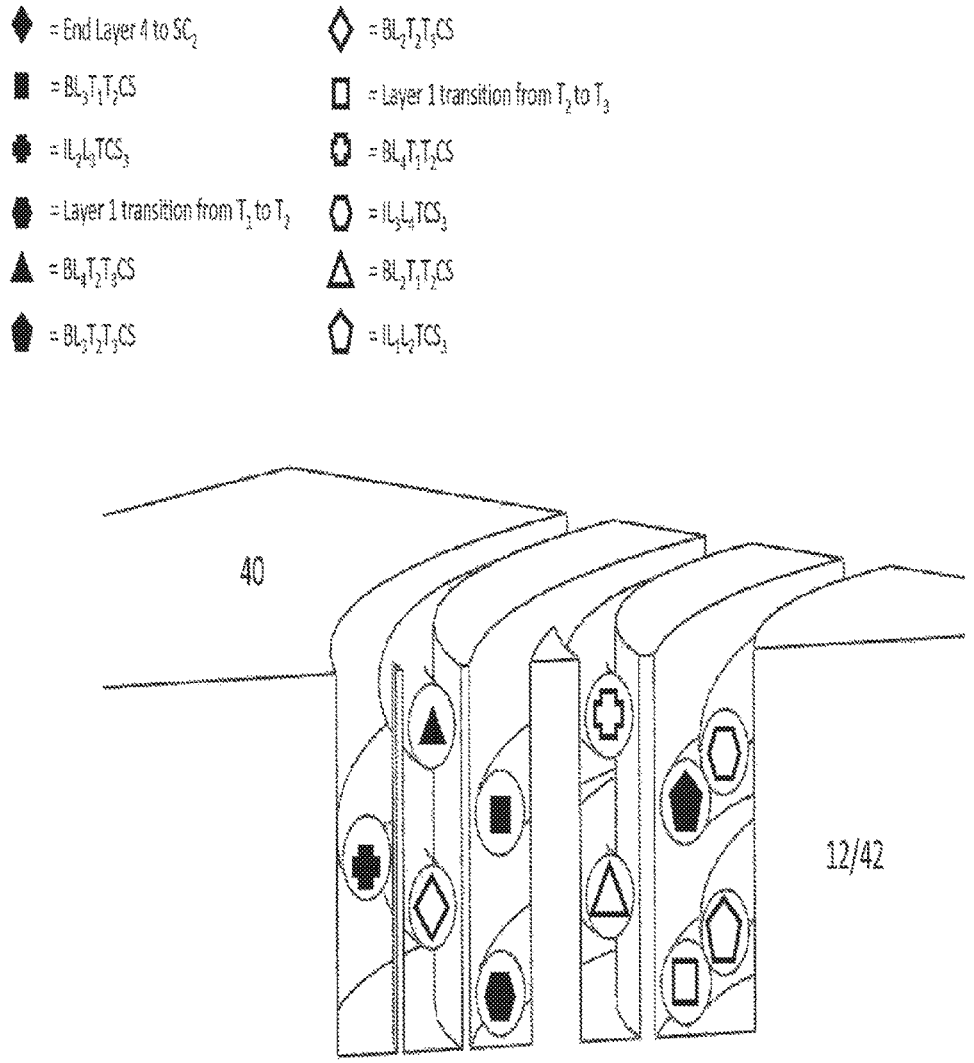
Figure 7H:
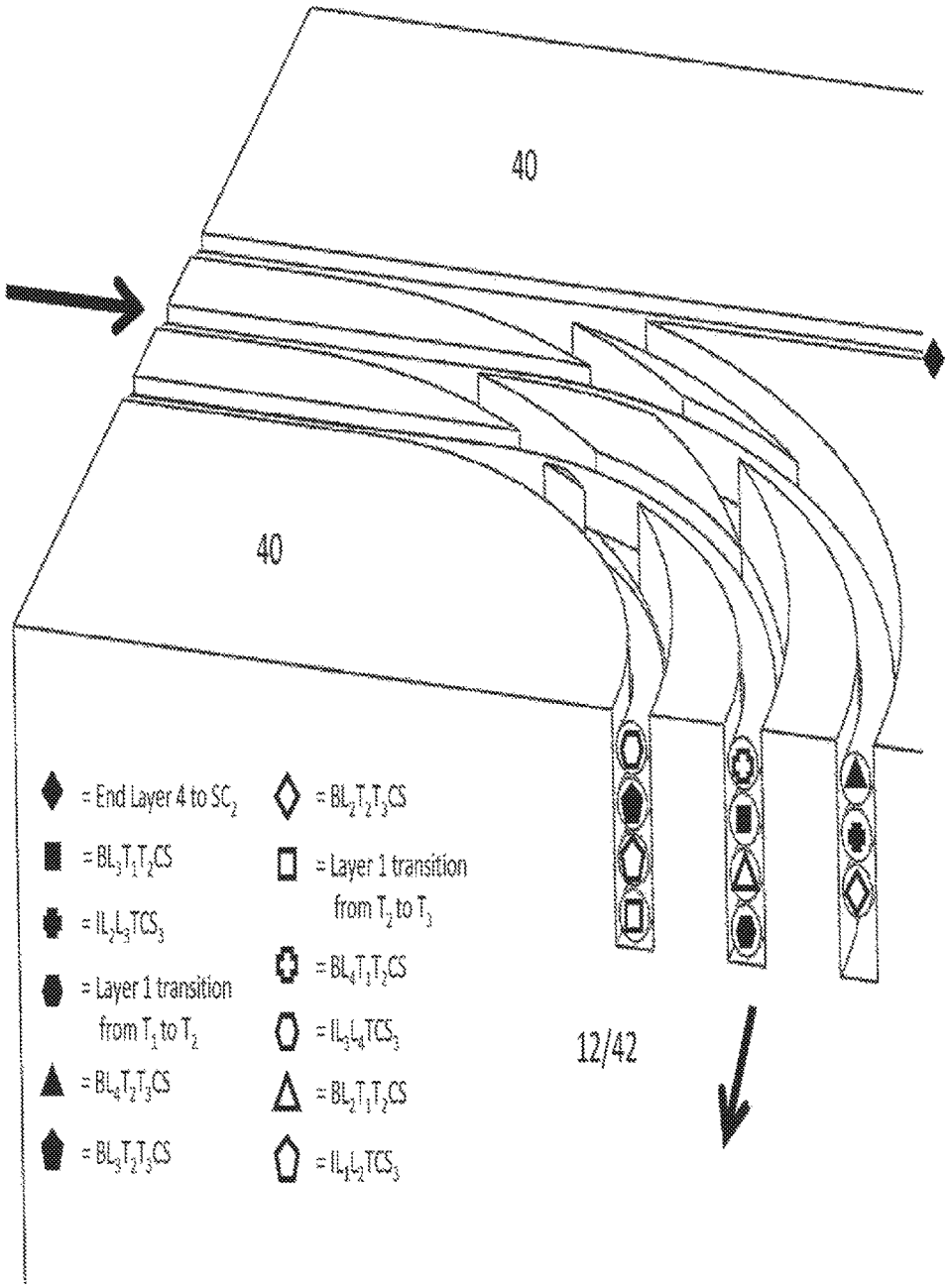

With reference to FIGS. 4D and 6D, the winding process continues at the position V by next placing the next portion in the continuous saddle coil winding, which is the conductor segment $W_4$ of the fourth helical layer $L_4$, in the same groove, G, and over the third wire segment $W_3$ of the third layer $L_3$. Placement of the segment $W_4$ of the fourth layer $L_4$ over the segment $W_3$ begins at the position V and continues along a spiral path which winds outward from the inside of the helical-like winding configuration, e.g., continuing in a clockwise direction, to complete three exemplary helical turns of the third layer: $L_4T_1$, $L_4T_2$, $L_4T_3$. The first and second helical turns $L_4T_1$, $L_4T_2$ and the majority of the third helical turn, $L_4T_3$, are positioned in the cylindrical plane $P_4$ about which the layer $L_4$ is primarily formed, i.e., a radial distance $R_4$ from the central axis, X.

Figure 12A:
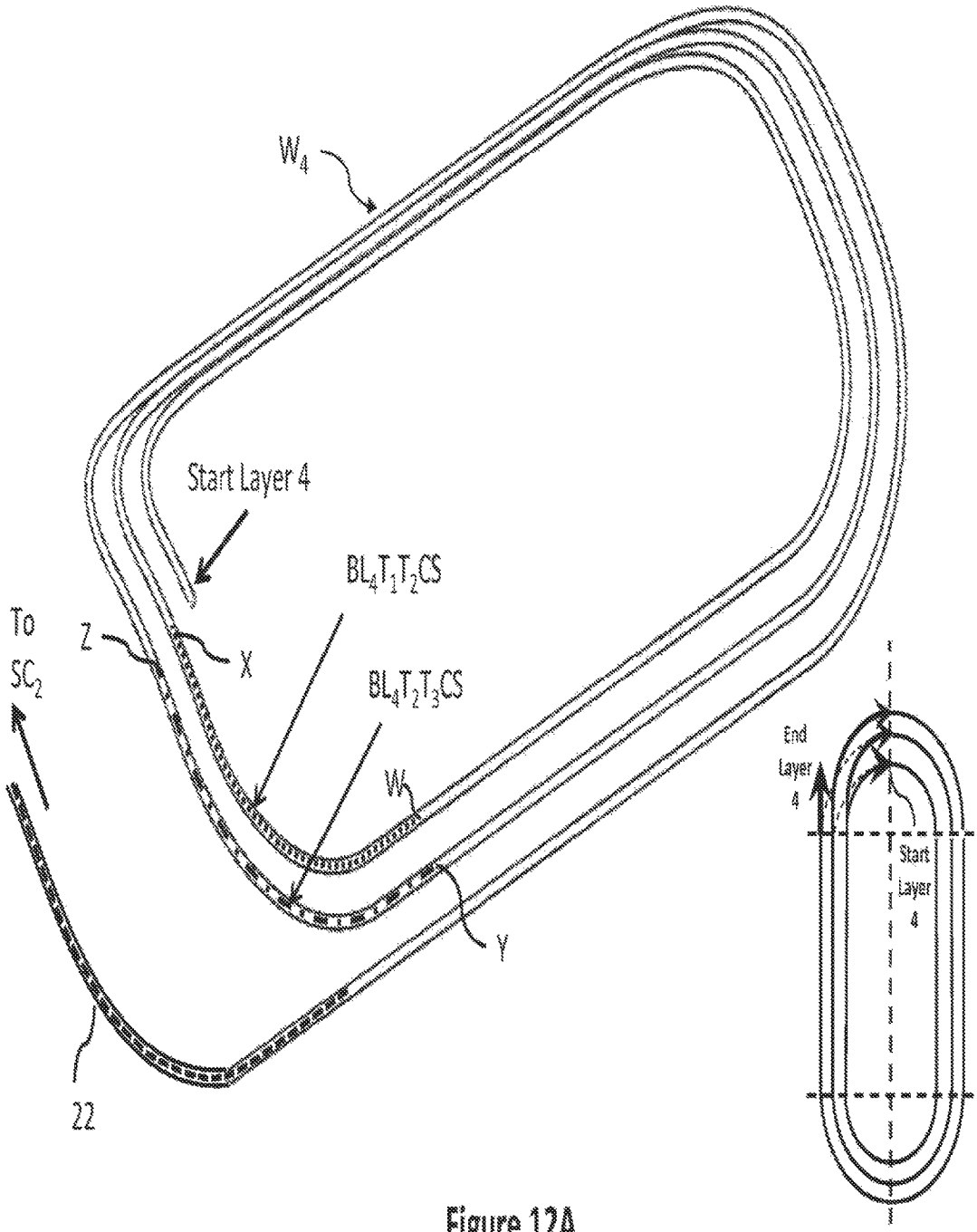
FIGS. 12A-12C are perspective views of conductor segment $W_4$ in a second layer of the saddle coil shown in FIG. 5.
Figure 12B:
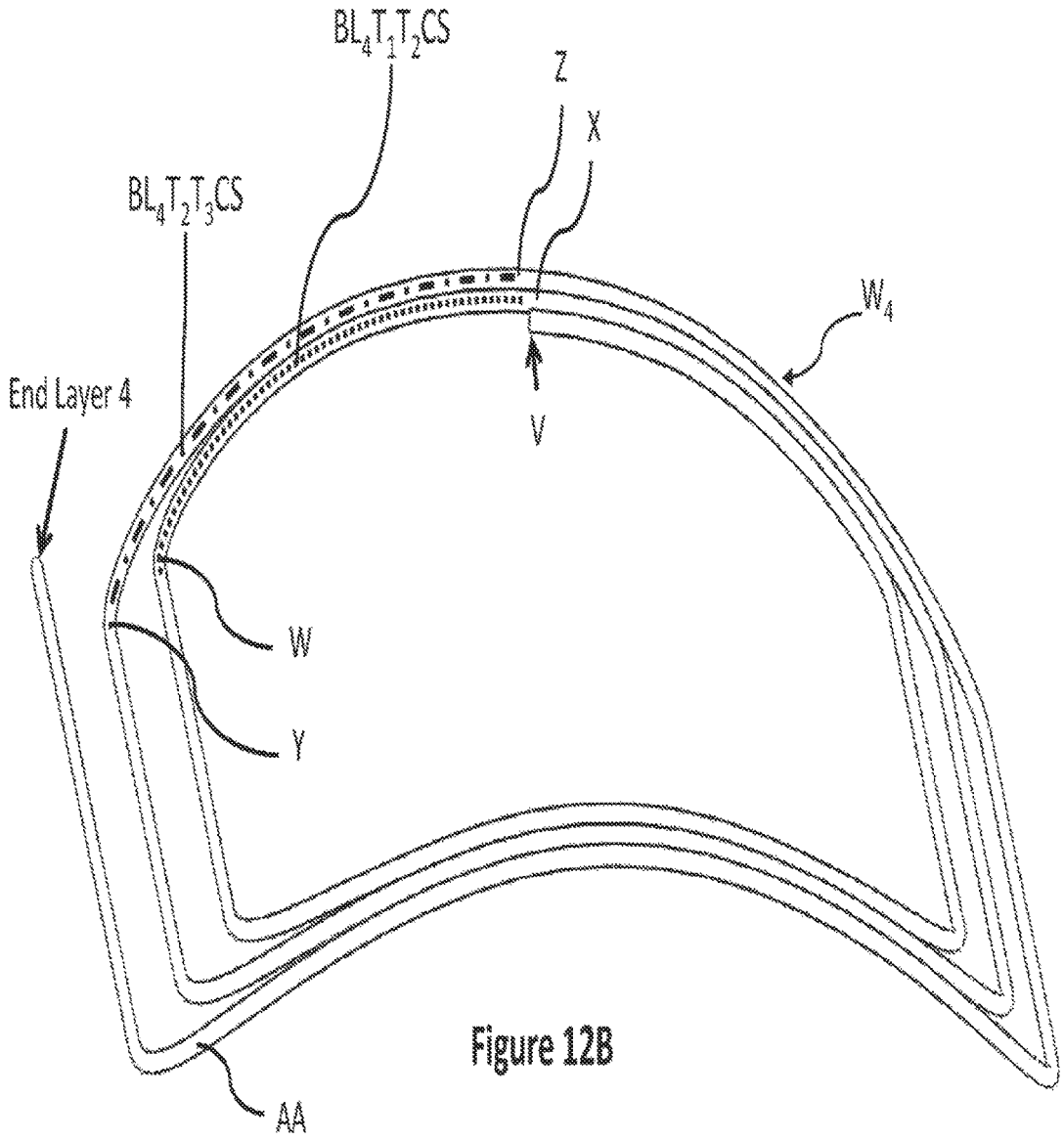
Figure 12C:
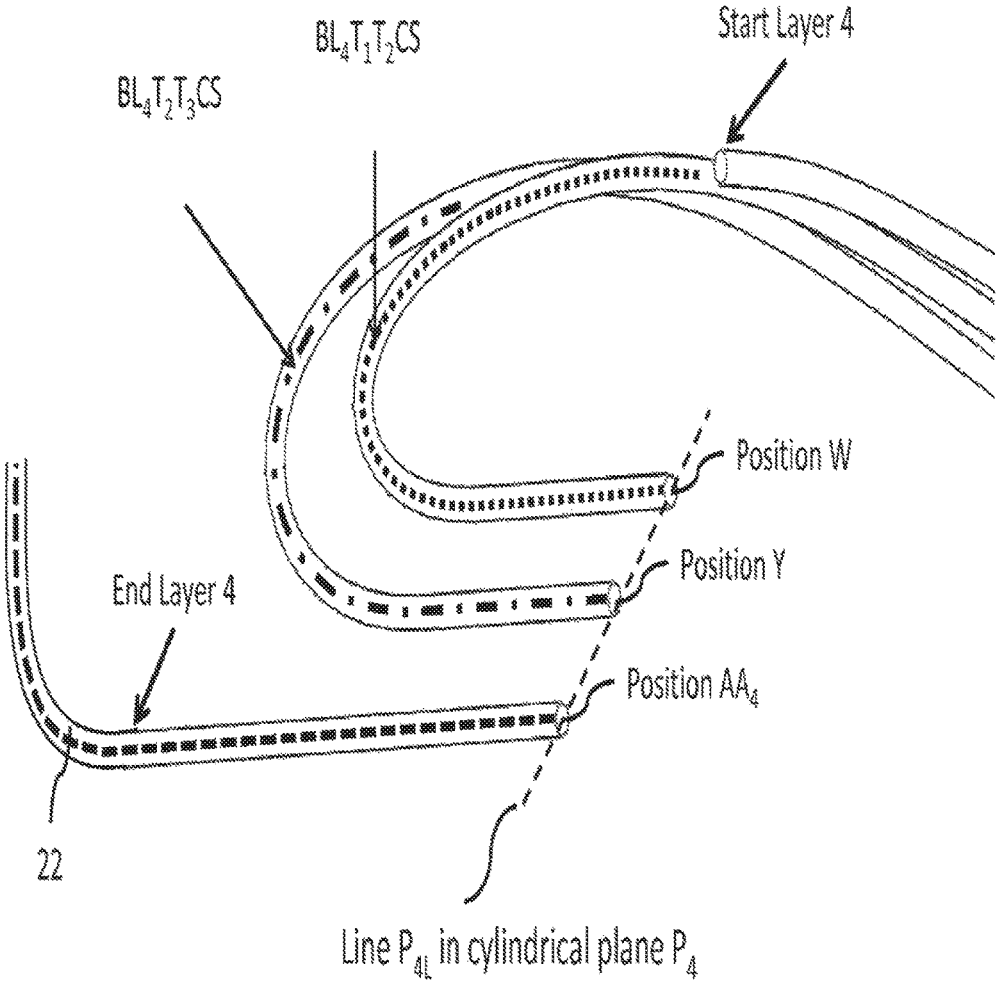

In the fourth layer the first and second helical turns $L_4T_1$, $L_4T_2$ include a Bridge intraLayer Transition Conductor Segment $BL_4T_1T_2CS$ which follows a transition path defined by an intralayer Bridge Transition Groove Segment $BL_4T_1T_2TGS$ shown in FIG. 6D. The Bridge intraLayer Transition Conductor Segment $BL_4T_1T_2CS$ is indicated in the figures with a thickened line width relative to other portions of the first and second helical turns $L_4T_1$ and $L_4T_2$. The Bridge intraLayer Transition Conductor Segment $BL_4T_1T_2CS$, positioned in the plane $P_4$, is also shown in the perspective views of FIGS. 12A-12C.

The Bridge Transition Groove Segment $BL_4T_1T_2TGS$ connects portions of the turns $L_4T_1$ and $L_4T_2$ in the groove, G, which each substantially conforms to a cos(mθ) function. Referring to FIG. 4B, the Bridge Transition Groove Segment $BL_4T_1T_2TGS$ extends between a point W of turn $L_4T_1$ (in plane $P_4$) in the groove, G, and a point X of the turn $L_4T_2$ (also in plane $P_4$) in the groove, G. See FIG. 6D. The Bridge intraLayer Transition Conductor Segment $BL_4T_1T_2CS$ follows a path which departs from a path of the groove turn $GT_3$, which substantially conforms to a cos(mθ) function. That is, the groove turn, $GT_3$, defines a path consistent with a cos(mθ) function while the Bridge Transition Groove Segment $BL_4T_1T_2TGS$ departs therefrom in order to define a path for the Bridge intraLayer Transition Conductor Segment $BL_4T_1T_2CS$ which effects conductive connection between the two points W and X in the groove, G. The Bridge intraLayer Transition Conductor Segment $BL_4T_1T_2CS$ lies in the cylindrical plane $P_4$ and is placed in the intralayer Bridge Transition Groove Segment $BL_4T_1T_2TGS$.

Also in the fourth layer, the second and third helical turns $L_4T_2$, $L_4T_3$ include a Bridge intraLayer Transition Conductor Segment $BL_4T_2T_3CS$ which follows a transition path defined by an intralayer Bridge Transition Groove Segment $BL_4T_2T_3TGS$. The Bridge intraLayer Transition Conductor Segment $BL_4T_2T_3CS$ is indicated in the figures with a thickened line width relative to other portions of the first and second helical turns $L_4T_2$ and $L_4T_3$. The Bridge intraLayer Transition Conductor Segment $BL_4T_2T_3CS$ in the plane $P_4$ is also shown in the perspective views of FIGS. 12A-12C.

The Bridge Transition Groove Segment $BL_4T_2T_3TGS$ provides a path which connects portions of the turns $L_4T_2$ and $L_4T_3$ in the groove, G, which substantially conform to a cos (mθ) function. The Bridge Transition Groove Segment $BL_4T_2T_3TGS$ extends between the point W of turn $L_4T_2$ (in plane $P_4$) in the groove, G, and a point X of the turn $L_4T_3$ (also in plane $P_4$) in the groove, G, departing from this cos(mθ) relationship to define a path for the Bridge intraLayer Transition Conductor Segment $BL_4T_2T_3CS$ which effects conductive connection between the two points W and X in the groove, G. The Bridge intraLayer Transition Conductor Segment $BL_4T_2T_3CS$ thus follows a path which departs from a path which substantially conforms to the cos(mθ) function to effect conductive connection between the points W and X. The Bridge intraLayer Transition Conductor Segment $BL_4T_2T_3CS$ lies in the cylindrical plane $P_4$ and is placed in the intralayer Bridge Transition Groove Segment $BL_4T_2T_3TGS$. The Bridge Transition Groove Segment $BL_4T_2T_3TGS$ is shown in FIG. 6D.

The third helical turn, $L_4T_3$, which is the outer-most turn of the fourth layer $L_4$, could include an Interlayer Transition Conductor Segment $IL_4L_5TCS_3$ (where $S_3$ designates that the segment is in the third turn of the layer $L_2$) if the illustrated saddle coil were to include a fifth layer $L_5$ of conductor segment $W_5$ in a fifth cylindrical plane $P_5$. Instead, the turn $L_4T_3$, is the last turn in the saddle coil $SC_1$ before the conductor is routed to another saddle coil in the magnet 10. The turn $L_4T_3$ is shown in the figures as a partial turn ending at point $AA_1$ (i.e., ending at the point $AA_1$ instead of a point AA' in the Cartesian plane of symmetry, PS). from which an inter-saddle coil conductor segment 22 extends from the saddle coil $SC_1$ to provide connection to the saddle coil $SC_2$. Generally, with reference to FIGS. 14A and 14B, an inter-saddle coil conductor segment 22 connects each of the saddle coils, one to another, to continue the winding process of the entire magnet 10 with each other saddle coil $SC_k$ in the magnet 10 being wound, substantially or identically, in accord with the process described for the coil $SC_1$.

In the past, conventional saddle coils in multi-pole magnets have been serially connected, but the manner in which saddle coils have been inter connected has not been recognized as an influential variable on field uniformity.

With the number of saddle coils used to generate a magnetic field being equal to the pole number, the winding configuration of a dipole magnet consists of two saddle coils, while a quadrupole magnet comprises four saddle coils. When such magnets are designed according to the invention (i.e., with saddle coil conductor segments $W_i$ positioned in predefined paths substantially in accord with afore-described cos(mθ) relationships) each of the saddle coils has to be identical and excited with currents of the same strength. Otherwise, the symmetry required for high field uniformity would not exist. It is therefore suitable to configure all of the saddle coils in series to operate each with a common excitation current.

Embodiments of the invention include electrical interconnections between the saddle coils of a magnet of given multipole order where the paths of current flowing through these inter saddle coil interconnections are configured in relation to one another to offset the magnetic fields generated by each current path and thereby further limit adverse effects on overall field uniformity. This concept can be applied to multipole configurations of arbitrary order. Generally, given a series of conductor segments providing electrical connections between one or more pairs of spaced apart winding configurations along a common plane, layout of pairs of conductor segments which effect the connections is configured to measurably offset, e.g., cancel or mitigate, adverse magnetic field components generated by each conductor segment in the pair when the segment is conducting current.

Figure 13A:
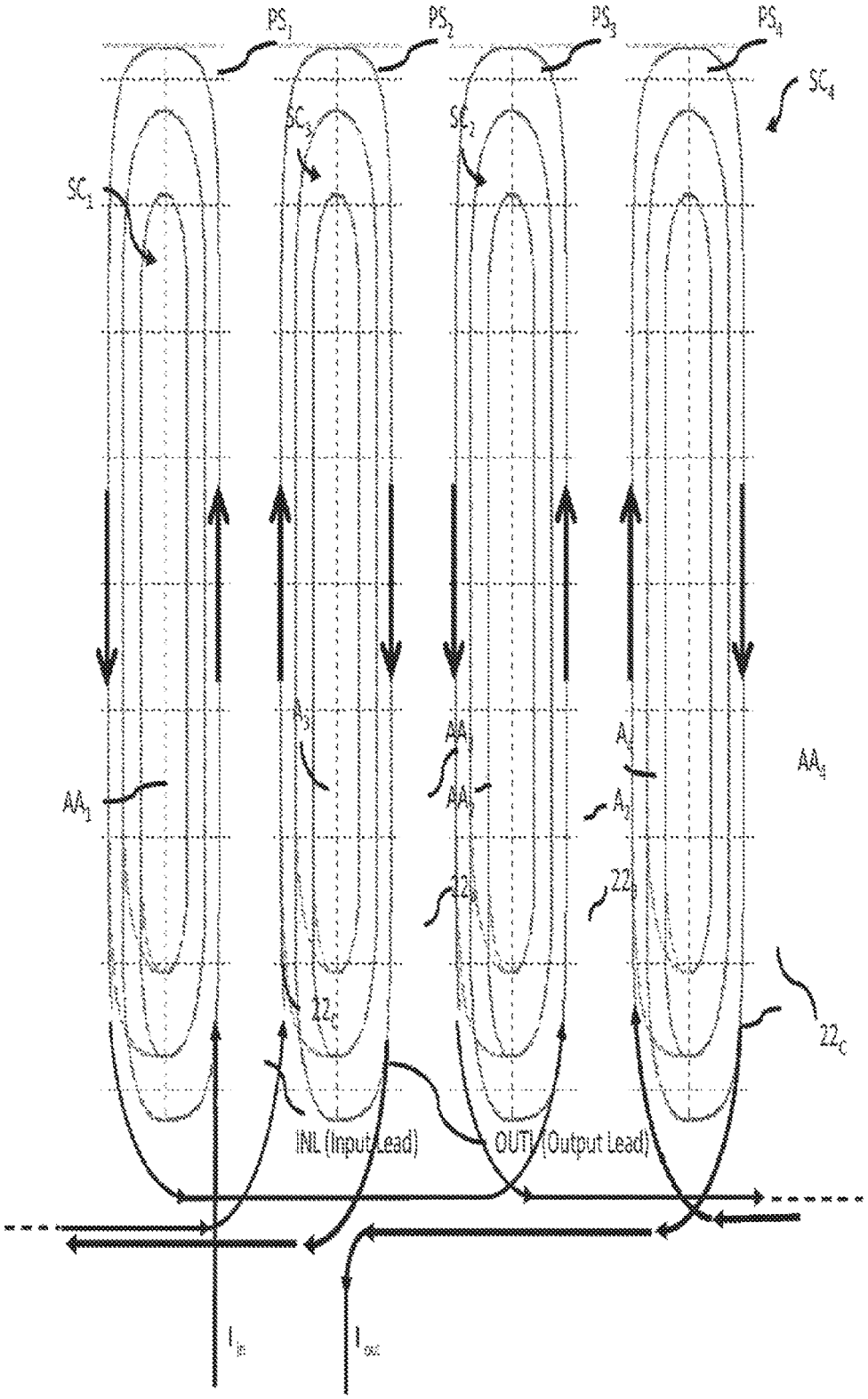
FIG. 13A is an unrolled view of an exemplary magnet constructed according to the invention, illustrating routing of inter-saddle coil conductor segments serially interconnecting multiple saddle coil windings $SC_k$ positioned along a cylindrical surface.
Figure 13B:
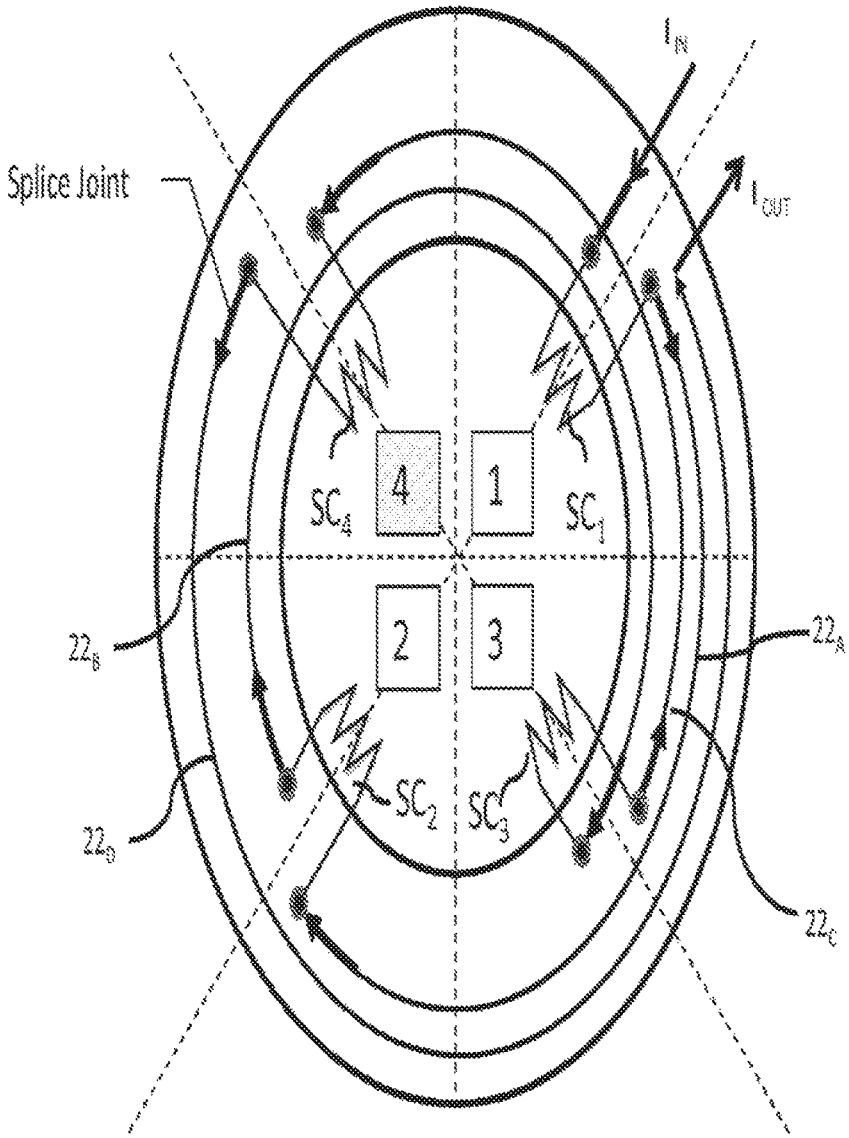
FIG. 13B is an axial view of the magnet of FIG. 13A illustrating relative positions of connections disposed in different cylindrical planes Pi and about the circumference of the cylindrically shaped body 12 on which the magnet is formed.

In one example implementation, the conductor routing scheme shown in FIGS. 13A and 13B further minimizes field errors for the quadrupole magnet 10 by limiting (i.e., offsetting or substantially canceling) undesired field contributions, generated by inter-saddle coil conductor segments 22. FIG. 13A provides an unrolled view of the magnet 10 illustrating all four saddle coils $SC_k$. FIG. 13B schematically illustrates an axial view of the routing scheme.

An input lead, INL, is connected to an input terminal of the magnet 10 to carry a current input $I_{IN}$ provided from an external power supply (not shown) to the point $A_1$ in the saddle coil $SC_1$. See FIG. 4A. After the current circulates through the first saddle coil $SC_1$, a first inter-saddle coil conductor segment $\mathbf{22}_A$ extends from position $AA_1$ of layer $L_4$ of the first saddle coil $SC_1$, clockwise approximately 180 degrees about the cylindrically shaped surface 40 to connect with the first layer $L_1$ of the second saddle coil $SC_2$ at a point $A_2$ in the first turn of a conductor segment $W_1$, (i.e., in a manner as shown for point $A_1$ in the saddle coil $SC_1$ in FIG. 4A). The current flows through the segment $\mathbf{22}_A$ is in a clockwise direction about the cylindrically shaped surface 40.

After the current circulates through the second saddle coil $SC_2$, a second inter-saddle coil conductor segment $\mathbf{22}_B$ extends clockwise from position $AA_2$ at the end of the third turn $T_3$ of layer $L_4$ of the second saddle coil $SC_2$, approximately 270 degrees about the cylindrically shaped surface 40, past the saddle coil $SC_1$, to connect with the first layer $L_1$ of the third saddle coil $SC_3$ at a point $A_3$ in the first turn of a conductor segment $W_1$, (i.e., also in a manner as shown for point $A_1$ in the saddle coil $SC_1$ in FIG. 4A). The current flow through the segment $\mathbf{22}_B$ is also in a clockwise direction about the cylindrically shaped surface 40.

After the current circulates through the third saddle coil $SC_3$, a third inter-saddle coil conductor segment $\mathbf{22}_C$ extends counterclockwise from position $AA_3$ at the end of the third turn $T_3$ of layer $L_4$ of the third saddle coil $SC_3$, approximately 180 degrees about the cylindrically shaped surface 40, past the saddle coil $SC_1$, to connect with the first layer $L_1$ of the fourth saddle coil $SC_4$ at a point $A_4$ in the first turn of a conductor segment $W_1$, (i.e., also in a manner as shown for point $A_1$ in the saddle coil $SC_1$ in FIG. 4A). After the current circulates through the fourth saddle coil $SC_4$, a current output lead, OUTL, is connected to an output terminal of the magnet 10 to carry an output current $I_{OUT}$ from the position $AA_4$ at the end of the third turn $T_3$ in the layer $L_4$ on the fourth saddle coil $SC_4$ back to the external power supply.

As further illustrated in the axial view of the magnet 10 shown in FIG. 13B, the current carrying inter-saddle coil conductor segments 22 are routed about the cylindrical surface 40 so that, at substantially all azimuthal angles, two interconnecting wires are positioned alongside one another to carry currents in opposite directions. The currents running clockwise and the currents running counter clockwise are substantially parallel with one another. Since the fields generated by parallel currents running in opposite directions cancel, collectively the net field resulting from the combination of these interconnections has a minimized influence on overall field uniformity of the quadrupole magnet. However, the general scheme of providing saddle coil interconnections, in which currents in opposing directions substantially cancel the resulting net magnetic field, can be applied to any multi-pole order magnet, including a dipole magnet. Other interconnection schemes providing balanced currents that cancel magnetic fields are possible. Generally, for a pair of conductor segments providing electrical connections between one or more pairs of spaced apart winding configurations in a magnet, layout of one or more pairs of the conductor segments measurably offsets the magnetic field contribution of order m generated by each conductor segment when the segments are conducting current. The measurement may be made at a position along the axis. The first and second conductor segments are positioned in sufficient proximity of one another that the magnitude of the net field contribution of order m resulting from the combined contributions of the first and second segments is less than the sum of the magnitudes of the individual field contributions of order m generated by each segment. Further, when the first and second conductor segments are positioned in sufficient proximity of one another the magnitude of the net field contribution of order m resulting from the combined contributions of the first and second segments is less than the magnitude of the individual field contribution of order m generated by either segment. Although the foregoing concepts have been described in the context of saddle coil magnets, they are not so limited in application.

The afore-described embodiments are based on formation of saddle coil windings along cylindrical planes in a structure having one or more grooves formed therein. In embodiments comprising multiple grooves, an arbitrary number of grooves, $G_k$, are concentrically formed about a central axis. Numerous variants of the illustrated designs are contemplated. For example, U.S. Pat. No. 7,889,042, "Helical Coil Design and Process for Direct Fabrication From a Conductive Layer", referred to as the '042 patent, incorporated herein by reference, teaches a modular structure comprising cylindrical sleeves or rows of conductor segments referred to as Direct Helix coils. Each conductor segment comprises a series of helical conductor turns. In accord with the invention, Direct Helix coils may be in the form of conductor segments, $W_i$, which each substantially comply with Equation (1) and Equation (2) herein to provide multiple spaced apart saddle coil windings along a cylindrical body. See FIG. 2A.

As described in the '042 patent, a Direct Helix coil may be formed from a tube-like structure comprising conductor material. The entire Direct Helix coil structure may be formed of conductor, or only portions (e.g., layers) may be conductor. For example, the tubular structure may predominantly comprise an insulative material with one or more layers of conductor formed over an outer or inner surface of the structure. In a similar manner, each layer of conductor in each of the four saddle coil windings shown in FIG. 2A may be machined or otherwise patterned into a conductor segment of the saddle coil according to the geometry illustrated in the figures with at least one conductor segment or layer of turns $T_i$ for each saddle coil row, i.e., Direct Helix coil. As described in the '042 patent, contact surfaces of conductor segments in adjacent ones of the concentric coil rows may come into direct contact with one another to effect current flow from layer to layer.

The conductor which forms the Direct Helix coils may be a normal conductor such as copper or one of several varieties of superconducting material or nano materials such as graphene. For example, when a superconducting Direct Helix design is implemented according to the invention, a superconductor such as YBCO may be deposited along the surfaces (e.g., along inner and outer surfaces or along all surfaces) of a hollow tubular structure before or after tooling to create the coil pattern for each layer of conductor. In this case, the tubular structure on which the deposition is performed may be primarily a normal conductor such as copper or aluminum body where the conductive metal serves as a stabilizer. A laminate structure comprising the YBCO conductor is deposited thereon by, for example, a vacuum deposition technique. Sublayers which facilitate formation of the YBCO conductor may be formed directly on the metal. The sublayers may typically include a barrier metal such as silver, over which YBCO, or another other rare earth composition (REBCO), is deposited. In addition, numerous other sublayers may be deposited on the barrier metal prior to deposition of the YBCO to enhance epitaxial growth of the YBCO layer.

According to a series of in situ superconductor formation embodiments, a magnet, also comprising one or more saddle coil windings, includes, for each saddle coil, one or more grooves or channels, each formed along a cylindrical plane. A superconductor is placed, or formed in each groove. For example, $MgB_2$ conductor may be formed in each groove with a reaction process in the temperature range of 600° C. to 950° C.

Figure 19A:
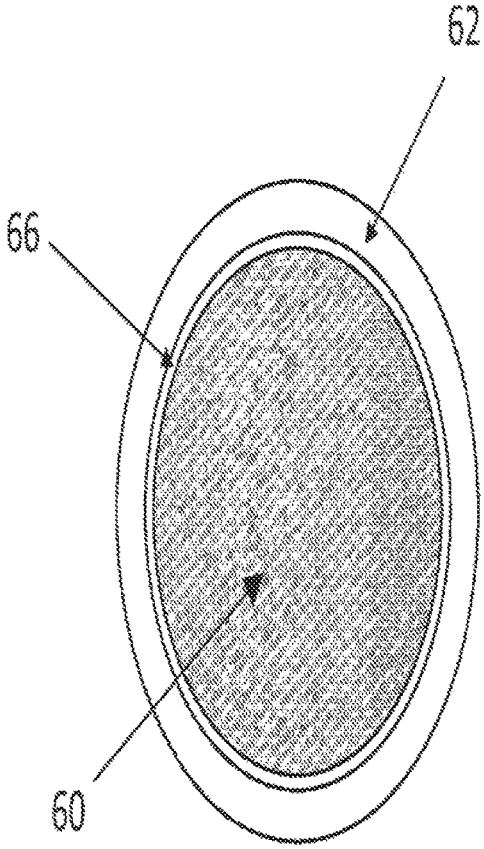
FIG. 19A is a view in cross section of a powder in tube process in which an unreacted mixture is placed in a metal tube.
Figure 19B:
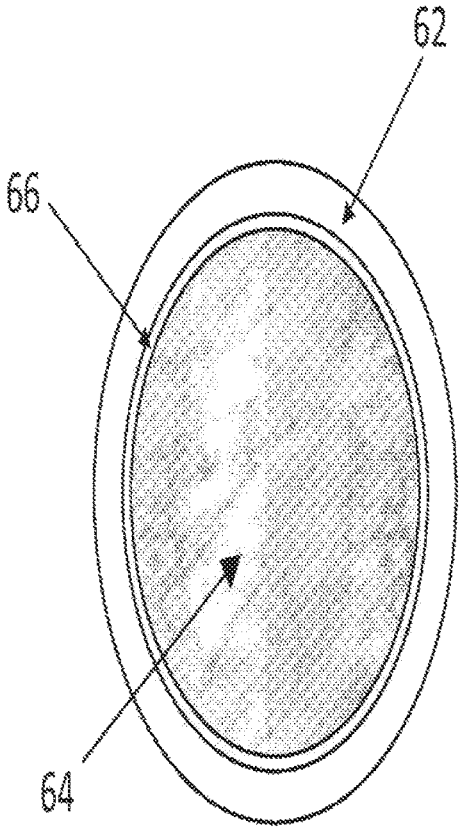
FIG. 19B is a view in cross section after formation of superconductor material according to the powder in tube process illustrated in FIG. 19A.

In a superconductor saddle coil structure, comprising a series of grooves formed in a ceramic material, concentric cylindrical surfaces are sequentially formed about the body 12 with the grooves formed along each sequentially formed concentric cylindrical surface 40. The precursor material for $MgB_2$ is placed in each groove to form one of the layers $L_i$. In one example, there is an in situ powder in tube (PIT) formation of $MgB_2$, where a precursor mixture 60, comprising magnesium and boron powders, is formed in a metal tube 62 of sufficient length to provide a conductive segment $W_i$. See FIG. 19A. After placing the unreacted mixture in the metal tube 62, the tube may be pressed, flattened or extruded to a smaller diameter in order to apply pressure which compresses the precursor constituents. The tube is then inserted in each groove during the sequential process of forming the series of concentric cylindrical surfaces in the body 12 with the grooves formed therein. After insertion of the tubes into the grooves the precursor constituents are reacted to form MgB2 superconductor 64. See FIG. 19B. Embodiments based on PIT formation may be subject to a constraint wherein performance of the superconductor is limited by the curvature, thereby limiting the groove curvature. In those applications where the curvature is acceptable for use of PIT formation, assembly may be effected by providing the metal formation tube out of an acceptable stabilizing metal which, as needed, is plated on the inside surface with a barrier metal 66. For example, a copper tube may be plated with niobium prior to insertion of the magnesium and boron powders.

In another embodiment, $MgB_2$ precursor constituents are mixed together in stoichiometric proportions but, in lieu of PIT formation, the precursor mixture is inserted directly into each groove without use of a tube. Introducing nano-sized artificial pinning centers in the magnesium boron powder mixture will significantly increase the current carrying capacity in applied magnetic fields of these conductors. Several concentric insulative layers are sequentially formed about the body 12, each over a prior formed insulative layer with a groove formed in each insulative layer. The mixture is then heated to a temperature in the range of 600° C. to 950° C. to form a well-connected, superconducting $MgB_2$ central filament inside the groove. Thus an advantageous embodiment of an in-situ methodology for producing $MgB_2$ superconductor can be incorporated into the afore-described coil manufacturing technology. However, superconductor embodiments according to the invention are not limited to those in which the cylindrically shaped body 12 is a ceramic material or embodiments where grooves are formed within exposed surfaces of an insulative body. Other insulative materials which can be tooled and which are stable at a temperature in the range of 600° C. to 950° C. can be suitable for synthesizing $MgB_2$ superconductor in a preformed channel such as a groove or a port. With the body 12 comprising a ceramic material having such properties, each groove is formed with a spiral geometry as described for the embodiment shown in FIGS. 2 and 3. Although the opening in which the conductor is placed is referred to as a groove, it is to be understood that the term "groove" refers to an opening which may be in the form of an open trench having vertical or canted walls and which is subsequently covered or coated with an additional insulative layer. The opening may be a closed passageway or port formed by various known techniques including molding processes which define channels with material that is subsequently etched to form a flow path or cavity. Accordingly, the $MgB_2$ precursor may be dissolved in a volatile carrier liquid which permits the $MgB_2$ to be injected into a port or groove. When the carrier liquid evaporates the $MgB_2$ is formed as a coating along a surface of the port or groove. The material is then heated to a reaction temperature. The injection, followed by the removal of volatiles from the precursor and the subsequent reaction to form the $MgB_2$ can all be performed in a pressure chamber or in a vacuum, which may facilitate compaction of powder crystals. Other forms of compaction may be applied. For example, the wall of a port having a circular shape in cross section may be plated with a first layer of metal having a relatively high coefficient of thermal expansion. The first metal layer may be a stabilizing layer or a stabilizing layer may be formed, e.g., plated, over the first layer of metal, followed by plating thereover with a barrier metal. When the first metal deposited in the port is formed with a substantial thickness relative to the diameter of the port, thermal expansion of the first metal can press against precursor material inserted thereafter. Accordingly, with the first metal being a plating of copper, over which a barrier metal is plated, the $MgB_2$ precursor is placed in the port. If the majority of the volume of the port is filled with the first metal, having a relatively high coefficient of thermal expansion, when the body is heated there can be significant thermal expansion of the first metal layer, compressing the precursor material into a smaller volume to assure sufficient contact of grains against one another during the synthesis reaction.

According to a series of embodiments, the port may not be completely filled with the metal system while still assuring sufficient contact of grains against one another during the synthesis reaction, e.g., with use of a pressure chamber. Consequently, with the metal structure formed against the wall of the port, a void may exist along the center of the port, providing a cooling passageway through which a fluid may pass. Further, by varying the area in cross section of the port as a function of position along the path of the spiral structure, it becomes possible to selectively deposit a higher volume of superconductor material along portions of the path to reduce the current density during operation of the winding assembly, thereby elevating the amount of current which can pass through the winding without exceeding the critical current density.

Another feature of embodiments for which the superconductor material is formed in ports is that the ports can extend between the cylindrical planes to provide continuous, i.e., splice-free, connections between windings in different planes.

For an open groove or trench, the spiral groove geometry can be created by tooling, or by formation of the body 12 in a mold, or with other known techniques for creating a groove pattern or passageway that will receive the metal system and the precursor material to create a spiral pattern of superconductor. With this approach, it becomes possible to provide a spiral pattern of conductor turns comprising multiple levels of superconductor, each as a winding layer, $L_i$, in a groove.

In embodiments comprising a cylindrically shaped ceramic structure, the material can be reinforced with ceramic or glass fibers, and the temperature characteristics of the body material may be controlled as needed, e.g., by limiting the reaction temperature or by using rapid thermal processing. Incorporation of the fibers can enhance the mechanical robustness of the coil support structure.

The assembly process for superconducting embodiments of the invention can incorporate many steps substantially identical to those described for a manufacturing process which results in normal conducting magnets. With use of MgB2 superconductor, the process may advantageously include in situ formation of the superconductor in a groove formed of insulative material that withstands necessary elevated temperature processing. Generally, after the mixture of magnesium and boron powders is placed in each groove, the groove is wrapped with an over-layer of tensioned cloth (e.g., fiberglass matt) impregnated with a ceramic putty. Either the putty or a resin can be applied in a process by which vacuum impregnation is performed to completely fill any voids in the groove. The over-layer covering each groove is hardened. In a structure having multiple concentric grooves, the over-layer is of sufficient thickness to cover the underlying groove and to machine therein another concentric groove in which an additional superconductor segment $W_i$ is placed. The process may be repeated to create a series of concentric grooves each filled with one or more superconductor segments of wire.

Figures 8I, 8J, 8K:
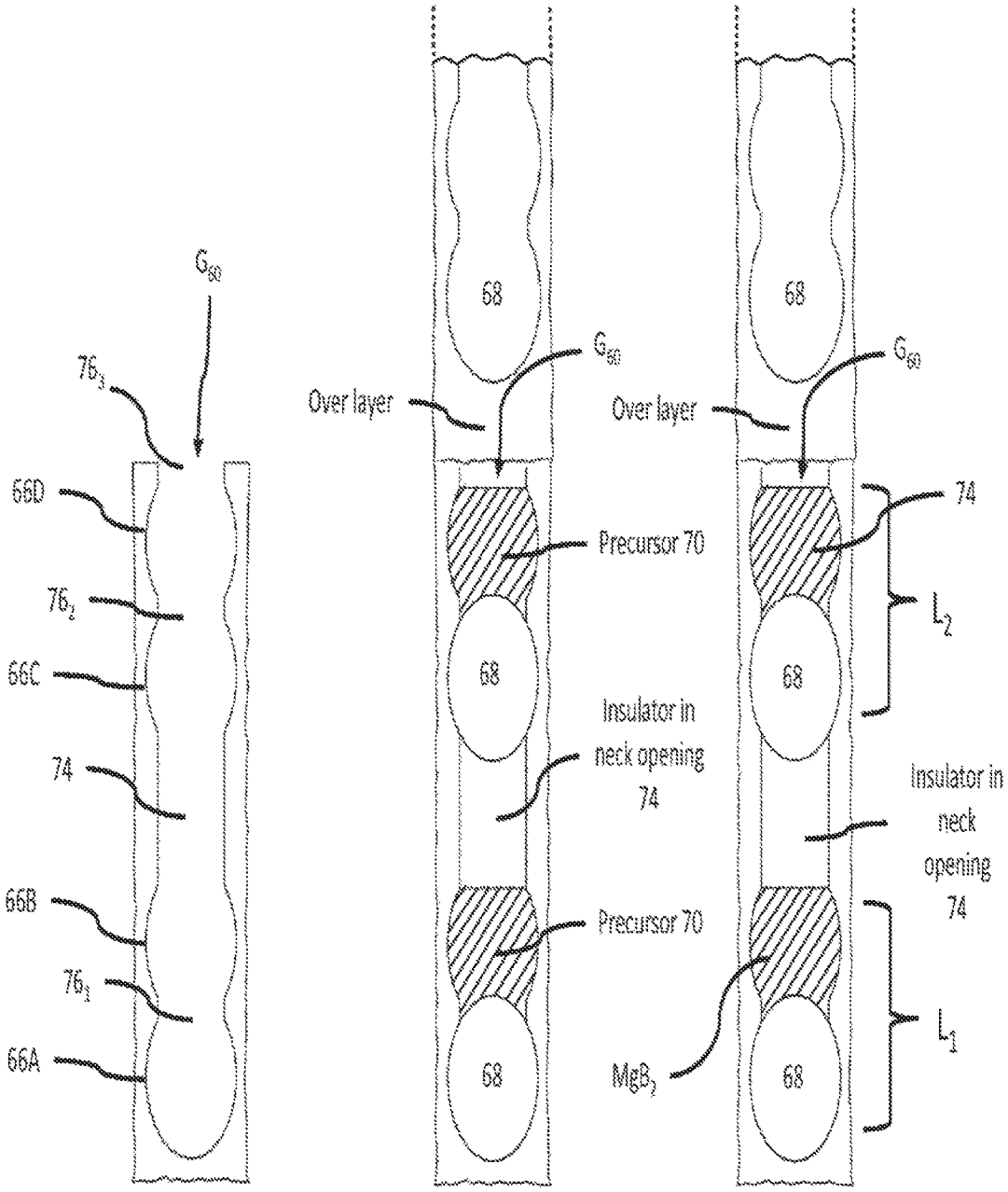

FIGS. 8I, 8J and 8K are views in cross section of a groove, $G_{60}$, illustrating an exemplary superconductor saddle coil design during stages of fabrication. At least two layers $L_i$ of conductor segments are formed in the one groove $G_{60}$. Each layer comprises a copper wire segment and a layer of in situ formed $MgB_2$ positioned over and against the copper wire segment. The copper wire segment is coated with a barrier metal.

The groove $G_{60}$, shown in FIG. 8I, without any conductor positioned therein, includes four repository positions 66A, 66B, 66C and 66D for configuring the two layers $L_i$ of superconductor in a saddle coil winding, but this is only exemplary. The groove could be configured to accommodate a single layer $L_i$ or more than two layers $L_i$. In this embodiment adjoining repository positions are paired, e.g., (66A, 66B) or (66C, 66D), to define individual layers $L_i$, where a normal, stabilizing wire conductor is positioned in electrical contact with a superconductor in each layer $L_i$. That is, separate repository positions are allocated for each, one position allocated for placement of the normal conducting material and the other repository position receiving precursor material for in situ formation of superconductor material. Thus, according to an associated fabrication process, the lowest most opening 66A and the next opening 66B each receive a member in a pair of conductors which are in electrical contact with one another. In one embodiment, a normal conducting material, e.g., a copper wire 68, is positioned is positioned as a superconducting stabilizing wire in the lowest-most repository opening 66A and the overlying adjacent repository opening 66B receives precursor material 70 for in situ formation of the $MgB_2$ superconductor. Similarly, a normal conducting material such as a copper wire 68 is positioned in the next lowest-most repository opening 66C as a superconducting stabilizing wire and the overlying adjacent repository opening 66D receives the precursor material 70 for in situ formation of the $MgB_2$ superconductor. See FIG. 8J. When the copper wire 68 is used as the stabilizing normal conducting material in repository openings 66A and 66C, it can be clad with a barrier metal, before being placed in the groove, to prevent reaction between the copper and a constituent of the precursor powder used to form the $MgB_2$. The suitable barrier metal may be plated on the copper. Niobium may be used to form the chemical barrier. An exemplary range of the barrier layer thickness is 0.1 micron to 0.5 micron.

To assure electrical isolation between layers, the groove design of FIGS. 8I-8K incorporates a neck opening 74 formed between the pairs of adjoining repository openings (66A, 66B) or (66C, 66D), i.e., between the openings 66B and 66C, to provide a spacer function between the precursor material 70 in the repository opening 66B and copper wire 68 in repository opening 66C. As described for neck openings 56B-56D, the neck opening 74 extends in the radial direction, i.e., in directions parallel with lines extending from the axis, X, and through the groove, $G_{60}$.

Generally, grooves according to the invention, such as the groove $G_{60}$, may have two or more pairs of adjoining repository positions. In each pair of positions, a normal conductor placed in one of the two positions is in electrical communication with the superconductor material placed in the other of the two openings, while each such pair of repository positions is spatially and electrically isolated from each adjoining pair of repository positions by a neck opening. Specifically, the neck opening can assure electrical isolation between a superconductor formed in one of a first pair of repository openings, e.g., (66A, 66B) and a normal conductor placed in one of another adjacent pair of repository openings, e.g., (66C, 66D). The neck opening may be filled with insulator, e.g., such as a low temperature deposited silicon oxide, or a ceramic based material, which facilitates electrical isolation between conductors in different pairs of repository openings.

After the repository openings in the groove $G_{60}$ for each of the layers $L_i$ have received the clad normal conducting wire 68 and the precursor 70 (e.g., prior to the heating step which results in two conductor segments of $MgB_2$ shown in FIG. 8K), the groove is wrapped with an over-layer of fiber material impregnated with ceramic putty which is then hardened. For embodiments incorporating multiple grooves formed in concentric cylindrical planes, a second groove for containing a next group of winding layers $L_i$ is machined in the outer surface of the over-layer to again provide one or more pairs of repository openings. The repository openings of the second groove are filled with the cladded normal conducting wire 68 and the precursor 70 for creating the superconductor as described for the first groove; and the exposed surface is wrapped with an over-layer comprising a tensioned cloth (e.g., fiberglass matt) impregnated with a ceramic putty. Either the putty or a resin can be applied in a process by which vacuum impregnation is performed to completely fill any voids in the groove. After the overlayer is cured the process sequence may continue in a like manner to form additional overlayers with grooves into which cladded normal conducting wire 68 and precursor 70 are inserted. After all the grooves are filled with precursor material and wrapped, the structure is heated to provide multiple layers $L_i$ of conductor segment for a superconductor saddle coil.

The groove $G_{60}$ includes three restricted repository openings $\mathbf{76}_i$ similar to the openings $\mathbf{46}_i$ shown for the design of FIGS. 8C-8F and which are all the same size as the opening 46 illustrated in FIG. 8A. During assembly a first superconducting stabilizing wire 68 passes through all two uppermost openings $\mathbf{76}_3$ and $\mathbf{76}_2$, the neck opening 74 and a third opening $\mathbf{76}_1$ for placement in the repository position 66A. A second superconducting stabilizing wire 68 passes through the two uppermost openings $\mathbf{76}_3$ and $\mathbf{76}_2$ for placement in the repository position 66C.

The repository openings $\mathbf{76}_i$ and the neck opening 74 of the groove $G_{60}$ may be deformable as described for openings in other example designs shown in FIGS. 8A through 8F but for a given wire diameter the width of the neck opening 74 may differ from that of the restricted repository positions $\mathbf{46}_i$ of FIGS. 8C and 8E in consideration the material properties, e.g., stiffness, resulting in lesser deformation occurring about the openings when wire 68 is inserted into the groove. The material may still permitting some bending to accommodate a given wire diameter, with the deformed material about the openings resiliently rebounding to return the associated opening to an original width. However, an insulative material chosen for this application, e.g., a ceramic material, while having desired thermal properties may have unsuitable bending properties which preclude deformation of material about the openings in order to first accommodate the relatively large wire diameter and then resiliently return to an original width.

Accordingly, in other embodiments, instead of providing pairs of repository positions, i.e., one opening for a cladded normal conducting wire and one adjoining opening for the precursor for the reaction which yields $MgB_2$ superconductor, the surface of each repository position formed in the groove can be clad with a thin copper layer over which the barrier layer is formed. Subsequently the precursor material is deposited into the copper clad repository positions. Electrical isolation between conductor material of different layers formed in the same groove can be achieved by depositing or otherwise placing an insulative material over the precursor material and between different layers of conductor formed along walls of the repository positions. The repository positions can thus be filled with normal conductor and superconductor precursor material in a sequential manner. The lowest opening is first clad with copper, then clad with the barrier layer and then the precursor material is deposited therein. After an electrical isolating material is formed over the precursor material and over exposed copper cladding (i.e., along walls of unfilled repository positions), the next lowest repository positions is then clad with copper, which is clad with another barrier layer. Then the precursor material is placed over the barrier layer. The process sequence continues for each additional repository positions in a direction toward the exposed surface 40 of the body 12.

Figure 15A:
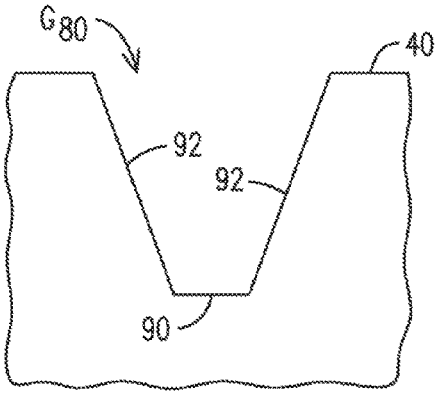
FIGS. 15A-15D illustrate formation of a coil structure with in situ formation of superconductor material in a channel.

In one specific embodiment, which does not require that repository positions be formed in a groove, FIGS. 15A-15D illustrate an alternate coil structure design and method for fabricating such coil structures with $MgB_2$ superconductor to create the magnet 10. With reference to FIG. 15A, the fabrication begins with formation of a groove or trench-like structure $G_{80}$ formed in an exposed cylindrical surface 40 of the predominantly ceramic body 12. The groove $G_{80}$ includes a bottom portion 90 and canted sidewalls 92 extending to the surface 40. The groove may be formed with a cutting tool. In other embodiments, including those where the body 12 may be formed of different material, the groove may be chemically etched.

Figure 15B:
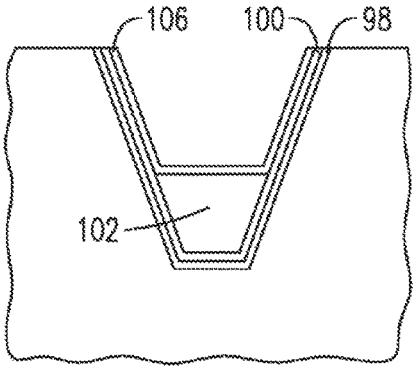

As shown in FIG. 15B, a layer 98 of copper is formed along the interior of the groove, covering the bottom portion 90 and the side walls 92. As a stabilizing layer, the thickness of the copper layer 98 is a design choice based on desired performance characteristics. Over the copper layer 98 there is deposited a barrier layer 100 which may be niobium. The thickness of the barrier layer is sufficient to assure there is no interaction between components of the precursor and copper atoms. Thickness of the barrier layer is kept small to reduce resistance when current passes from the $MgB_2$ into the copper, while still being of sufficient thickness to function as a chemical barrier. A possible thickness range for the barrier layer is 0.1 micron to 0.5 micron.

The layers 98 and 100 may be formed in the groove with a plating technique or by vapor deposition. Once the metal deposition is completed excess metal may be removed from the surface 40. Next, a precursor 102, comprising a stoichiometric mixture of Mg and B is placed in the groove $G_{80}$. The precursor 102 may be inserted within the groove in a powder form or may be injected as a slurry which is then dried and compacted. The precursor 102 may be injected, dried and compacted multiple times to build up a desired volume and to improve the electrical characteristics of the final product.

Figure 15C:
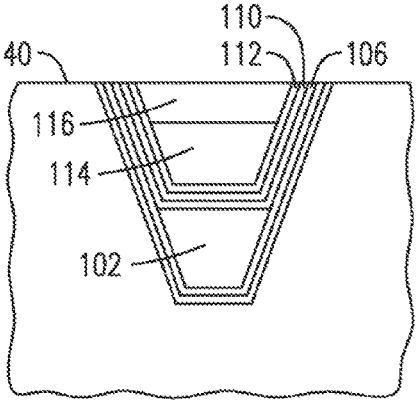
Figure 15D:
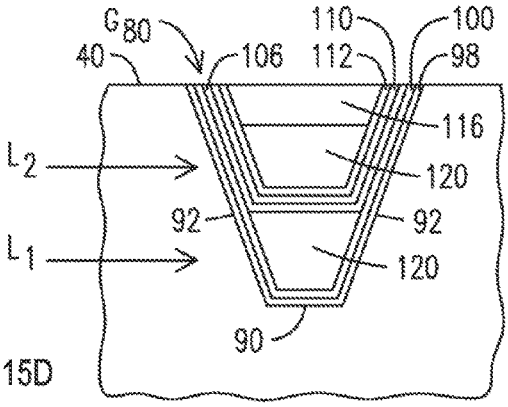
Figures 16A, 16B:
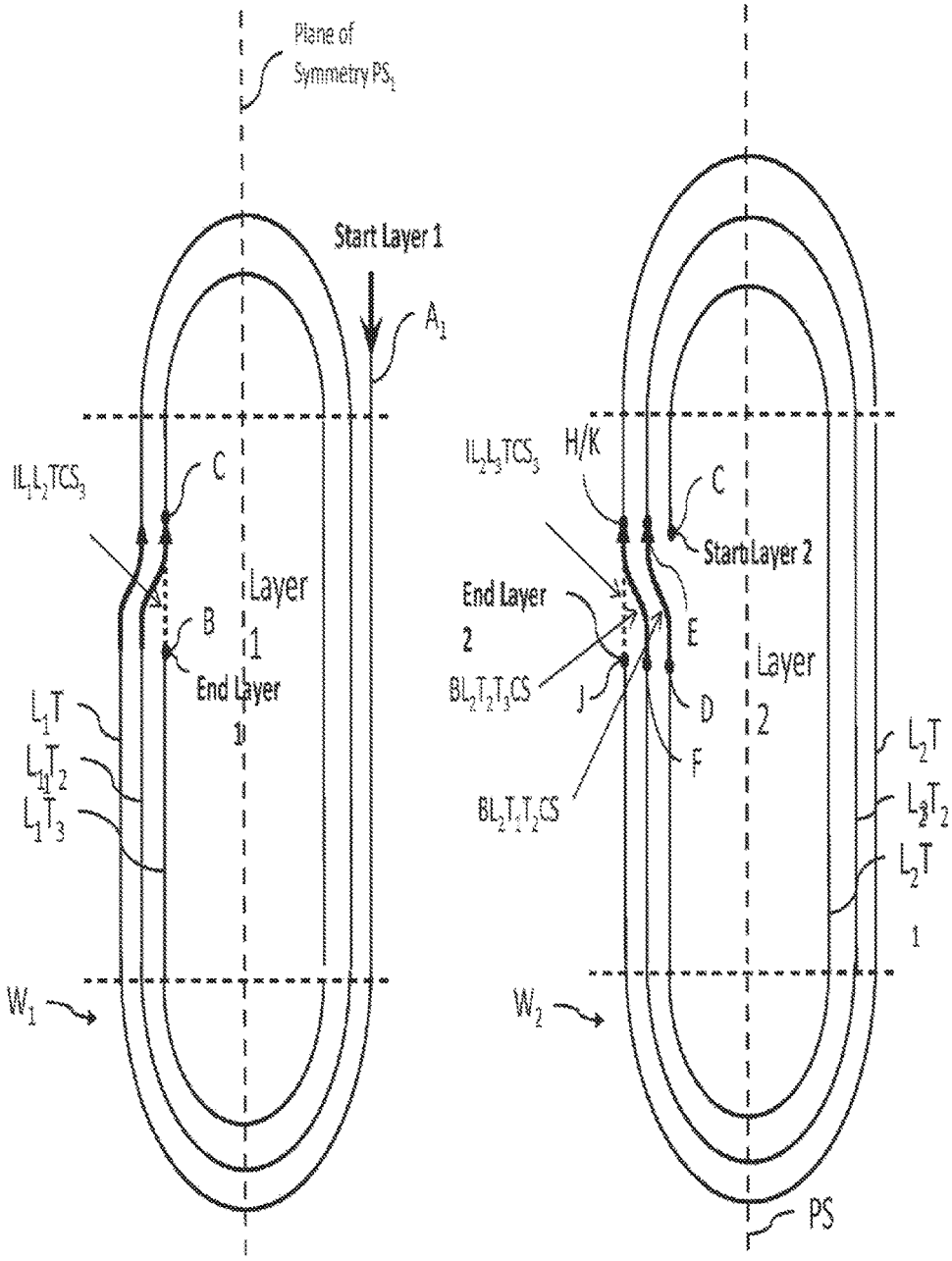
FIGS. 16A-16D are unrolled views of individual layers of conductor winding turns in the magnet of FIGS. 2 and 3, according to an alternate embodiment of a method for providing interlayer transistions and intralayer transitions in the series of conductor turns shown in FIG. 4 for four conductor layers to provide one continuous conductor winding.
Figure 16C:
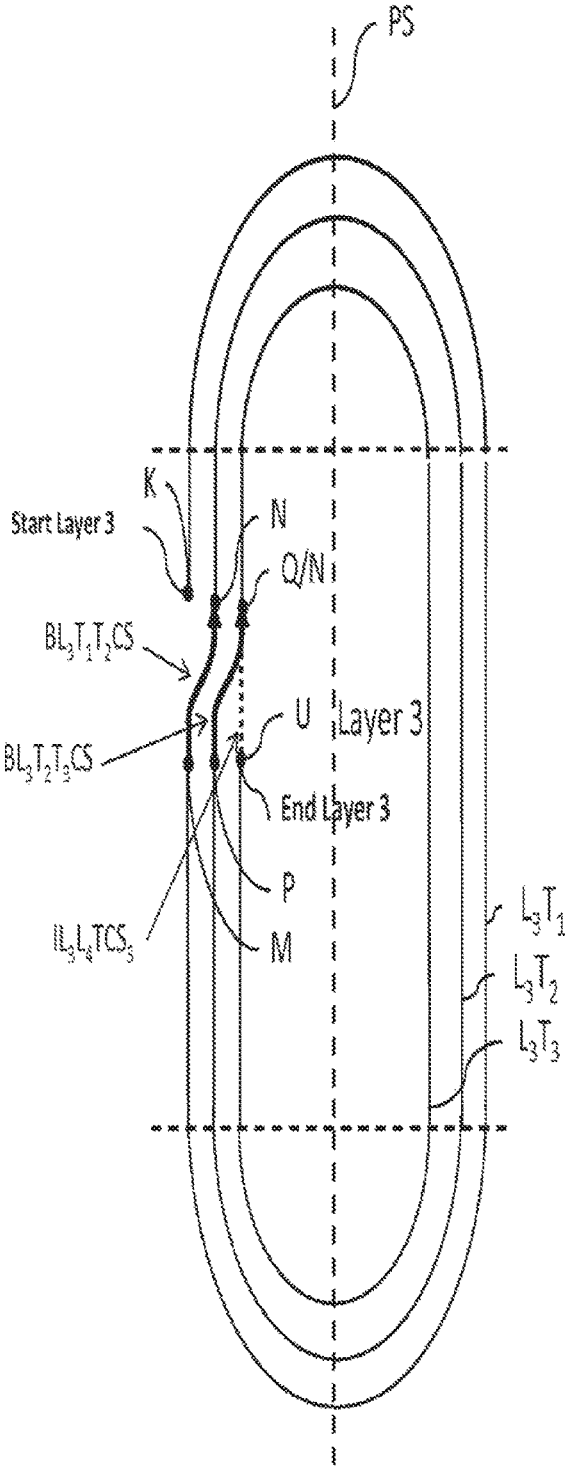
Figure 16D:
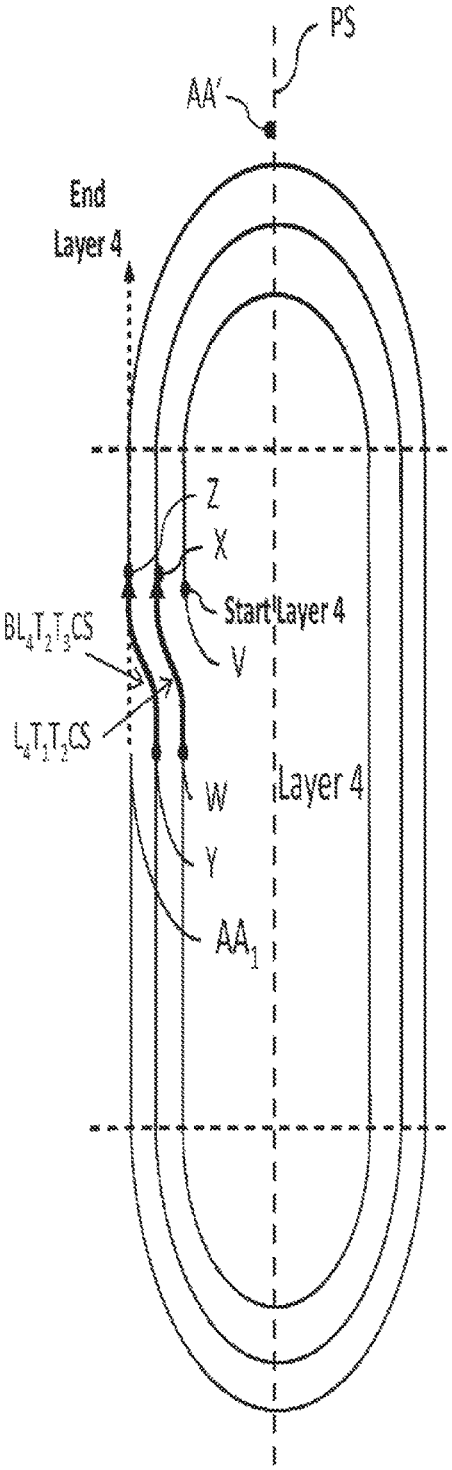
Figure 17A:
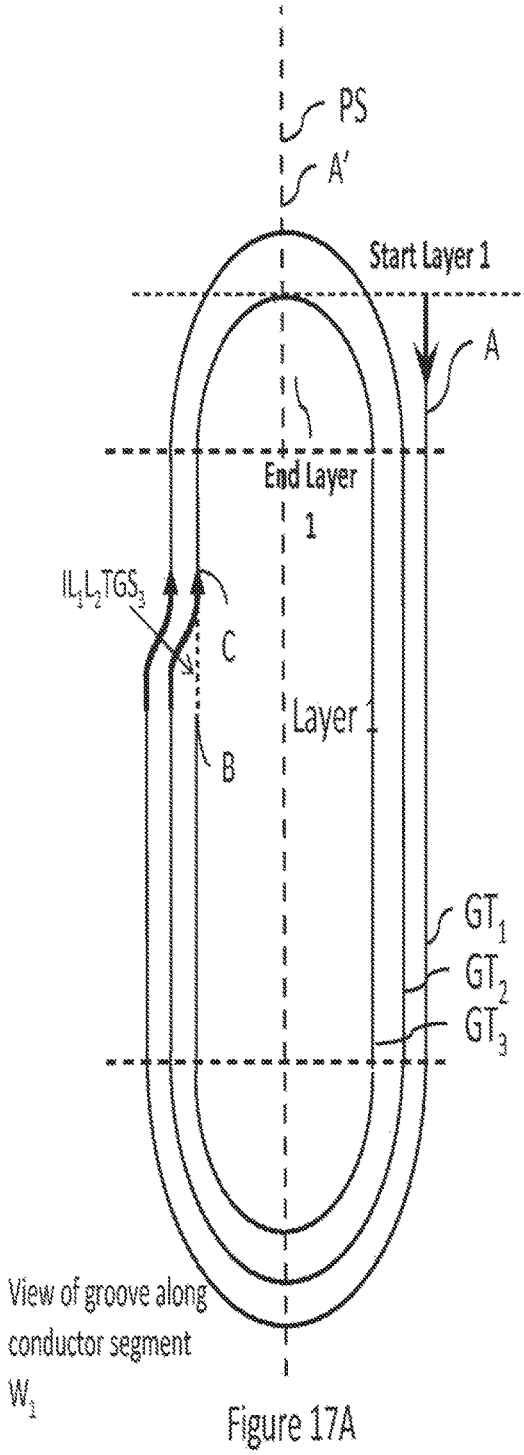
FIGS. 17A-17D are unrolled views of a groove formed in a layer of insulative material according to an alternate embodiment of a method for providing a series of conductor turns in the cylindrically shaped body, each view taken along the path of a conductor segment $W_i$ in a different one of four winding turns, i.e., layers of conductor winding placed in the groove, illustrated in FIG. 16.
Figure 17B:
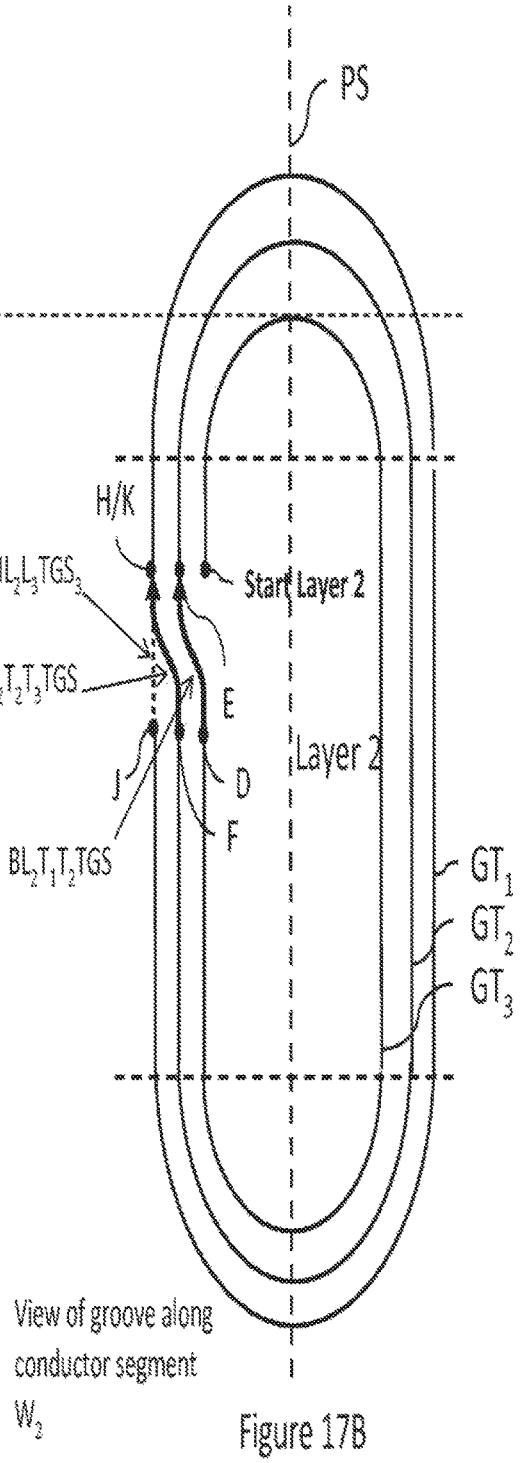
Figures 17C, 17D:
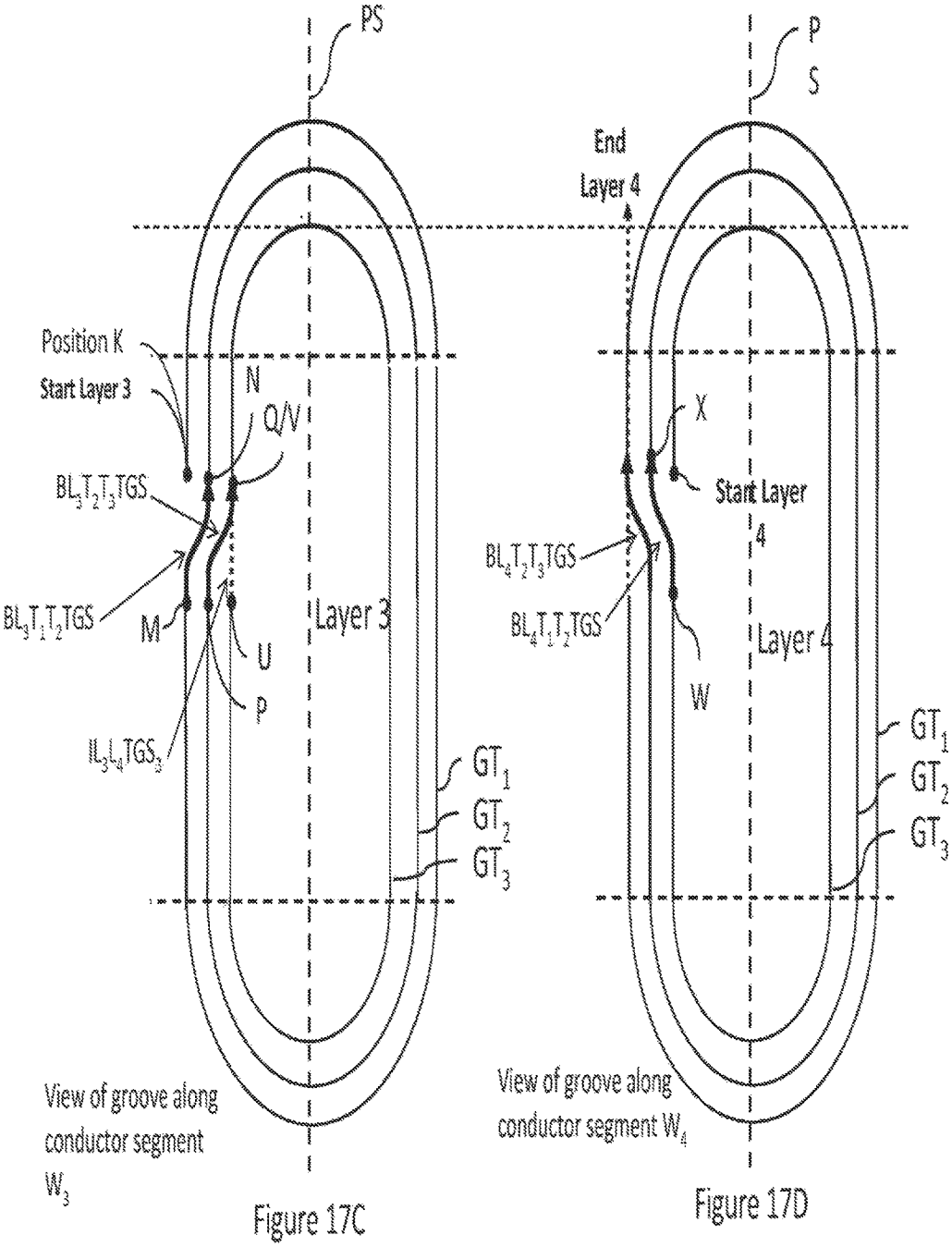

Once provision of the precursor is completed, a layer 106 of insulator is formed over all exposed surfaces of the groove, e.g., by a low temperature vapor deposition process. The insulator layer 106 may be a deposited silicon oxide (e.g., formed by chemical vapor deposition) or may comprise ceramic material. This completes formation of a first layer comprising a precursor 102 and stabilizing layer 90 in the groove. Next, a second layer, comprising a precursor and a stabilizing layer is formed in the groove as illustrated in FIG. 15C. The above process sequence is repeated to first deposit an additional layer 110 of copper over the insulator layer 106. This is followed by deposit of another barrier layer 112 (e.g., niobium, according to a plating or vapor deposition process), of sufficient thickness to prevent chemical interaction, on the copper layer 110. A second layer 114 of the precursor, comprising a stoichiometric mixture of Mg and B, is placed over the barrier layer 112.

The precursor layer 114 may be injected, dried and compacted multiple times to improve the electrical characteristics of the final product. A second layer 116 of insulative material is deposited or otherwise applied to fill the trench-like groove to or above the surface 40. The insulative material of the layer 116 may be a ceramic putty or a deposited silicon oxide. Although FIG. 15 only illustrate formation of two layers $L_i$ of superconductor in one groove $G_{80}$, this is exemplary of a process sequence which can be repeated multiple times to create more than two layers.

Once fabrication of the several layers of metal, precursor and insulator is completed in the groove $G_{80}$, one or more additional over layers of ceramic are formed over the surface 40 to create in each layer an additional groove $G_{80}$ and fill each additional groove $G_{80}$ with layers of superconductor. When a desired number of grooves are completed the body 12 is heated to react all of the deposited precursor, e.g., layers 102 and 114, in each groove and create superconductor layers $L_i$ in each of the grooves $G_{80}$. Each layer $L_i$ comprises a $MgB_2$ conductor 120 in electrical contact with a stabilizer conductor 98 or 110.

The above described processes for fabrication of superconducting saddle coils provide features and advantages previously unavailable. In the past, there has been limited ability to form $MgB_2$ wire with bends which conform to desired wiring paths, having small radii of curvature, rendering it more difficult to use $MgB_2$ in small geometries. Straight lengths of pre-formed $MgB_2$ wire, i.e., already reacted, can only undergo turns having relatively large radii of curvature. For example, a straight wire of $MgB_2$ one mm in diameter only has a limited bending radius of about 200 mm. This renders the wire unsuitable for many applications.

Even coil windings of $MgB_2$ superconductor manufactured with the wind-and-react technology (i.e., where unreacted conductor is put in place to form a coil winding configuration before heating to form the $MgB_2$ superconductor) have limitations in bending radii or acceptable performance. Although the PIT process compacts wire after being filled in a metal tube, if the wire is wound into a coil before reacting the precursor, bending of the tube can lessen the extent to which there is contact between crystals. This may be because bending creates compression along the inside curve of the bend and expansion along the outside curve of the bend, creating gaps along the outside curve of the bend. A feature of the invention is placement of the precursor in a path having a pre-existing (i.e., pre-defined) radii of curvature instead of creating a curved path after placing the precursor along a straight path, e.g., along a straight tube. To the extent the precursor is compressed before reacting the powder mixture, the compression is performed after imparting radii of curvature.

The described incorporation of $MgB_2$ synthesis into coil manufacturing processes according to the invention enables very small and fully scalable bending radii since the wiring configuration is established with the precursor material according to the path of the groove in which it is placed, i.e., prior to formation of $MgB_2$. In small geometries, i.e., even nano scale dimensions, ideal or nearly ideal fields can be generated with saddle coil magnets. Similarly, YBCO paste can be inserted in the groove $G_{60}$ in lieu of $MgB_2$. Photolithographic and etch processes can be applied to create these geometries in grooves or, more simply, in patterned layers, that can be built up over one another to generate desired configurations of substantially pure fields.

There have been disclosed a series of structures and methods for producing magnetic fields with saddle coils which fields are substantially free of undesirable harmonics. Application of these improvements to fully superconducting machines (e.g., having superconducting windings in both the rotor and stator) is advantageous because the AC currents induced in the stator would otherwise be subject to magnetization, coupling of filaments and eddy current losses due to AC coupling which rapidly increase with frequency created by the rotating field winding. Further, currents in the stator winding can be subject to higher harmonics and therefore high frequency losses due to higher order fields formed about the coil ends in the stator windings. These effects compound the problems resulting from the field enhancement in the coil ends, which limit the current carrying capacity of superconductors. The AC losses are small and tolerable at low rotational velocities such as experienced with low RPM wind generators. However, because these losses rapidly increase with the frequency of the AC currents, they can easily be the cause of substantial heat generation and drive the conductor closer to critical conditions. High speed superconducting generators have not been technically and commercially viable because prior winding configurations with nominal pole numbers have typically produced higher-order undesired field harmonics of significant magnitudes. Generally, manifestation of a larger number of magnetic poles than the intended nominal pole number introduces higher frequencies into the armature which create unacceptable losses. On the other hand, with saddle coils according to the invention, superconducting electrical machines are less sensitive to the constraints resulting from higher order, undesirable harmonics.

In rotating machines incorporating conventional saddle coil configurations with an intended number of poles, the resulting higher-order harmonics have largely resulted from the conductor paths along the coil ends of the winding. This effect is more pronounced in coils having small aspect ratios, i.e., the ratio of coil length to rotor diameter. Since the torque is proportional to the square of the distance from the rotational axis of the rotor electrical machines with small aspect ratios could be most advantageous for motors and generators. With saddle coil windings according to the invention, superconducting electrical machines with smaller aspect ratios are achievable because AC losses and cogging resulting from the unwanted higher order error fields are minimized. That is, the winding configurations which more closely conform to pure $\cos(m\theta)$ current density distributions enable coil configurations having smaller aspect ratios accompanied by higher-order harmonics having reduced effects.

Further comparison between application of the inventive concepts and conventional design limitations are apparent when considering a four pole electrical machine having sufficient coil winding symmetry that systematic field errors are non-existent. In such a winding the next predominant higher-order pole numbers (i.e., without regard to random errors in conforming to the ideal conductor path) that occur as harmonics are 12-pole and 20-pole. The frequencies introduced into the armature of a generator due to these harmonics are three times and five times higher than that of the main pole. With the AC losses in the superconducting machine being proportional to the square of the frequency, losses from the unwanted higher order pole numbers can significantly reduce the efficiency of a generator and eliminate any potential advantage of using superconductors. Substantial or complete avoidance of the AC losses results from fabrication of saddle coil winding configurations as disclosed in this application to achieve substantially pure cos(mθ) current density distributions. In summary, this technology enables useful fully-superconducting electrical machines.

Figure 20A:
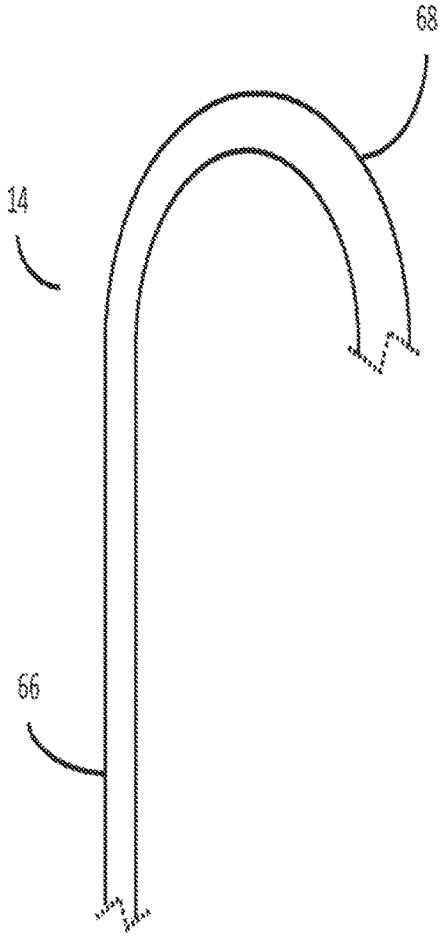
FIG. 20A is a plan view of a length of superconductor material having a relatively small area in cross section along a straight portion and a relatively large area in cross section along a curved portion.
Figure 20B:
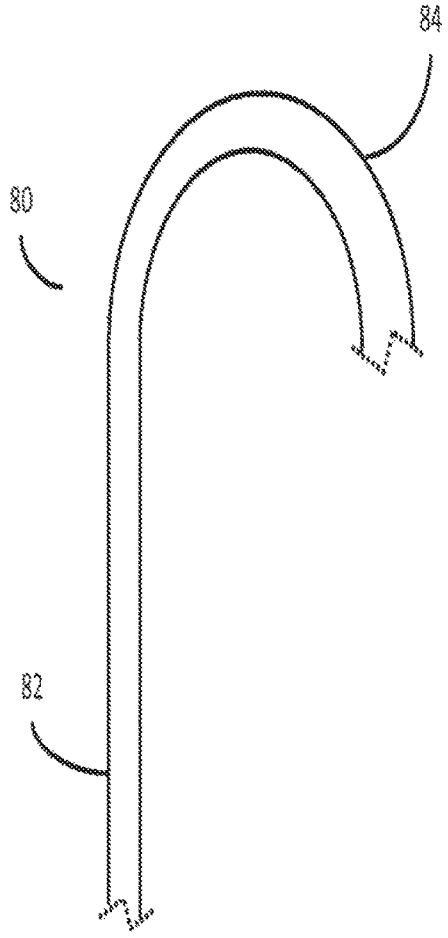
FIG. 20B is a plan view of a channel of variable cross section, in which the superconductor material shown in FIG. 20, is formed.

Still another feature of the invention is an ability to increase the current carrying capacity in the coil ends of a superconductor winding and thereby improve the ability to operate at high currents without the field enhancement effects causing the field to exceed critical level. Recognizing that the peak field along a saddle coil winding is always highest about the coil ends, the area in cross section of the current carrying superconductor can be increased to reduce the current density in portions of coil turns along the coil ends. This can be effected in embodiments where $MgB_2$ is formed in a groove or port by increasing the cross sectional area of the groove or port. Consequently, a greater volume of precursor can be placed in portions of the groove path along the coil ends. The resulting superconductor will have a larger area in cross section and carry a lower current density relative to portions of the wire along straight portions of the groove and having smaller area in cross section. Thus, to increase the margin between operating conditions and critical conditions the current density is controlled. FIG. 20A is a plan view of a conductor 14 having a relatively small area in cross section along a straight portion 66 of the conductor 14 and a relatively large area in cross section along a curved portion 68 of the conductor 14. FIG. 20B is a plan view of a channel 80 in which the superconductor material is formed in situ, the channel having a relatively small area in cross section along a straight portion 82 and a relatively large area in cross section along a curved portion 84.

A process for substrate coil manufacturing has been described which incorporates a composite type structure that can have one level of grooves or multiple levels of grooves. By way of example, for a quadrupole structure comprising multiple concentrically formed grooves for four coils, fabrication may begin with formation of the composite "base" structure using a wet layup process which includes a conventional fiber mat (e.g., fiberglass cloth) and an epoxy resin. The shaped structure is cured and machined to form a smooth base surface corresponding to the surface 40 identified in the figures. A groove is then machined into the surface of the structure to define the path for one or more layers of coil conductor positioned in the groove. The groove can be formed to a depth by which the groove holds multiple conductor layers, each layer comprising multiple conductor coil turns. After the groove receives all of the conductor layers a next step involves application of another wet composite layup (e.g., comprising a fiber mat, applied under tension, and an epoxy resin) which encapsulates the multiple conductor layers formed in the groove. With an appropriate application of the resin, into which loose fiber may be mixed, vacuum impregnation process may be applied to fill voids in the groove with resin. Multiple layers of composite are wrapped about the structure to provide another layer of material of sufficient thickness to both wrap the previous layer and form a base substrate for a next set of coil grooves. Once the wrapping is complete, the entire magnet is vacuum impregnated and cured at room temperature or under heat. An Autoclave vessel can be used to perform these steps, this enabling provision of pressure during the curing and impregnation process. A feature of the process is assurance that satisfactory stability is imparted to the one or several layers of conductor in the groove. This is especially pertinent when the conductor placed in the groove is a superconductor for which there should be no movement under Lorentz forces. Once the partially fabricated magnet body has sufficiently cured, it is machined to form a cylindrically shaped surface in which a next set of grooves can be machined. The process can be repeated to provide the series of concentric grooves, with each groove containing multiple layers of conductor.

While the invention has been described with reference to particular embodiments, it will be understood by those skilled in the art that various changes may be made and equivalents may be substituted for elements thereof without departing from the scope of the invention.

What is claimed is:

1. A method of forming a conductor assembly of the type which, when conducting current, generates a magnetic field or which, in the presence of a changing magnetic field, induces a voltage, comprising:

(i) defining a series of closed conductor paths, n, where n ranges from 1 to N, all of the closed paths residing in one cylindrical plane positioned about an axis in accord with the relationship $$F(x) * \sin(m * \theta_n) = \frac{n - 1/2,}{N}$$

where m is an integer value greater than one; θ is the azimuthal angle of each position measured in a plane orthogonal to the axis and relative to a reference point in the plane orthogonal to the axis, said relationship providing a suitable approximation for an ideal current density distribution according to cos(mθ); x is a position along the axis; and F(x) is a shape function which varies in value from zero to one; and (ii) a set of conductive winding turns is created by modifying the contours of the closed conductor paths with respect to the axial direction, x, to transform the closed shapes into a set of open shapes which each connect to another open shape to create a spiral configuration which departs from the ideal current density distribution.

2. A method for constructing a conductor assembly of the type which, when conducting current, generates a magnetic field or which, in the presence of a changing magnetic field, induces a voltage, comprising:

providing a conductor having a spiral configuration, positioned along a path in a first cylindrical plane, which conductor extends along an axis central to the cylindrical plane, positions along the path varying in azimuthal angle where:

the azimuthal angle of each position is measured in a plane orthogonal to the axis and relative to a reference point in the plane orthogonal to the axis, the configuration comprises a first plurality of N turns, $T_n$, connected to one another in a continuous series in the first cylindrical plane, each turn, $T_n$, including first and second coil ends which are each a portion of a turn not parallel with the axis, for a given value of n, each of the turns $T_n$ is spaced apart from an adjacent turn $T_{n+1}$ or $T_{n-1}$, and for at least one turn, $T_n$, the positions along a majority of the length of the turn are in accord with the relationship $$F(x) * \sin(m * \theta_n) = \frac{n - 1/2,}{N}$$

where m is an integer greater than zero, x is a position along the axis and F(x) varies in value along the coil ends between zero and one, and wherein multipole content which would otherwise be present in a field generated by the spiral configuration, relative to a pure multipole field of order m, which would theoretically be generated by a configuration having an ideal cos(nθ) current distribution, is reduced by applying a numerical optimization technique which modifies the shapes of turns to more closely conform the field pattern generated by the spiral configuration to the pure multipole field of order m.

3. A method for constructing a conductor assembly of the type which, when conducting current, generates a magnetic field or which, in the presence of a changing magnetic field, induces a voltage, a channel in the assembly having a spiral configuration for a multipole field configuration of order m, the method comprising:

inserting multiple layers of the conductor in the channel to conform each layer of the conductor to the spiral configuration, with each layer of the conductor positioned along a path in a different one of multiple concentric cylindrical planes, which paths extend along an axis central to the cylindrical planes, positions along the paths varying in azimuthal angle, where:

the azimuthal angle of each position is measurable in a plane orthogonal to the axis and relative to a reference point in the plane orthogonal to the axis, each layer in the configuration comprises a plurality of N turns, $T_n$, connected to one another in a continuous series in the first cylindrical plane, each turn, $T_n$, including first and second coil ends which are each a portion of a turn not parallel with the axis, and for a given value of n, each of the turns $T_n$ is spaced apart from an adjacent turn $T_{n+1}$ or $T_{n-1}$; and defining paths in the channel for straight portions of the channel or for curved portions of the channel which result in path segments which deviate from ideal channel path segments into which one or more segments of conductor turns in one or more conductor layers are placed.

4. The method of claim 3 wherein, for at least one turn, $T_n$, the positions along a majority of the length of the turn are in accord with the relationship $$F(x) * \sin(m * \theta_n) = \frac{n - 1/2,}{N}$$

where m is an integer greater than zero, x is a position along the axis and F(x) varies in value along the coil ends between zero and one.

5. The method of claim 4 wherein multipole content which would otherwise be present in a field generated by the spiral configuration, relative to a pure multipole field of order m is reduced by applying a numerical optimization technique which modifies the shapes of turns to more closely conform the field pattern generated by the spiral configuration to the pure multipole field of order m.

6. The method of claim 5 wherein multipole content which would otherwise be present in a field generated by the spiral configuration because of path segments which deviate from ideal channel path segments, relative to a multipole field which would theoretically be generated by a configuration having an ideal cos(mθ) current distribution, is reduced by applying a numerical optimization technique which modifies the shapes of turns to more closely conform the field generated by the spiral configuration to the multipole field which would theoretically be generated by a configuration having an ideal cos(mθ) current distribution.

* * * * *